US008011218B1

(12) United States Patent
Schell et al.

(10) Patent No.: US 8,011,218 B1
(45) Date of Patent: Sep. 6, 2011

(54) MATERIAL FORMING MACHINE INCORPORATING QUICK CHANGEOVER ASSEMBLY

(75) Inventors: Ronald W. Schell, Firestone, CO (US); Jeffrey A. Fry, Denver, CO (US); Adam J. Binderup, Westminster, CO (US); John W. DeBerard, Elizabeth, CO (US)

(73) Assignee: New Tech Machinery, Denver, CO (US)

( * ) Notice: Subject to any disclaimer, the term of this patent is extended or adjusted under 35 U.S.C. 154(b) by 0 days.

(21) Appl. No.: 12/551,665

(22) Filed: Sep. 1, 2009

Related U.S. Application Data

(62) Division of application No. 12/551,113, filed on Aug. 31, 2009, which is a division of application No. 12/547,710, filed on Aug. 26, 2009.

(60) Provisional application No. 61/091,763, filed on Aug. 26, 2008, provisional application No. 61/120,714, filed on Dec. 18, 2008.

(51) Int. Cl.
*B21B 31/00* (2006.01)
*B21D 5/08* (2006.01)

(52) U.S. Cl. ..... 72/237; 72/181

(58) Field of Classification Search ..... 72/164, 72/178, 237, 181
See application file for complete search history.

(56) References Cited

U.S. PATENT DOCUMENTS

| | | | |
|---|---|---|---|
| 29,559 | A | 8/1860 | Barker |
| 1,106,026 | A | 8/1914 | Barber |
| 1,347,912 | A | 7/1920 | Richardson |
| 1,348,899 | A | 7/1920 | Bombard |
| 1,414,340 | A | 5/1922 | Crowe |
| 1,673,787 | A | 6/1928 | Frahm at al. |
| 2,218,352 | A | 10/1940 | Fischer |
| 2,346,990 | A | 4/1944 | Oftedal at al |
| 2,352,675 | A | 7/1944 | Yoder |
| 2,481,162 | A | 9/1949 | Seely |
| 2,505,241 | A | 4/1950 | Gray et al. |
| 2,569,256 | A | 9/1951 | Thompson |
| 2,794,409 | A | 6/1957 | Freeze |
| 2,826,235 | A | 3/1958 | Gudmestad |
| 2,907,389 | A | 10/1959 | Brauer |
| 2,912,038 | A | 11/1959 | Harper |

(Continued)

FOREIGN PATENT DOCUMENTS

| | | |
|---|---|---|
| DE | 1777039 | 10/1971 |

(Continued)

OTHER PUBLICATIONS

Notification of Transmittal of international Preliminary Examination Report for PCT/US96/05595 mailed Jul. 18, 1997.

(Continued)

*Primary Examiner* — Edward Tolan
*Assistant Examiner* — Mohammad I Yusuf
(74) *Attorney, Agent, or Firm* — Holland & Hart LLP

(57) ABSTRACT

A clamp block kit for use on a machine having an adjustment mechanism employing a shaft and associated nut. The clamp block kit comprises a clamp block assembly securable about the nut and a mounting rail fastenable to the clamp block assembly with at least one second fastener. The clamp block assembly includes a first clamp including at least one threaded first hole, a second clamp including at least one second hole alignable with a respective first hole when in an assembled state, and at least one first fastener for extending into the aligned first and second holes.

7 Claims, 52 Drawing Sheets

U.S. PATENT DOCUMENTS

| | | | | |
|---|---|---|---|---|
| 2,931,277 | A | | 4/1960 | Bombard |
| 3,009,511 | A | | 11/1961 | Le Bouef |
| 3,150,706 | A | | 9/1964 | O'Brien |
| 3,183,701 | A | | 5/1965 | Cain, Jr. |
| 3,227,026 | A | | 1/1966 | Werntz |
| 3,319,448 | A | | 5/1967 | Bottom |
| 3,394,524 | A | | 7/1968 | Howarth |
| 3,417,591 | A | | 12/1968 | Babbitt |
| 3,441,234 | A | | 4/1969 | Barten |
| 3,442,429 | A | | 5/1969 | McLellen |
| 3,529,461 | A | | 9/1970 | Knudson |
| 3,595,056 | A | | 7/1971 | Hutton |
| 3,748,884 | A | | 7/1973 | Colbath |
| 3,775,821 | A | | 12/1973 | Somerville |
| 3,791,185 | A | | 2/1974 | Knudson |
| 3,815,398 | A | | 6/1974 | McClain |
| 3,847,071 | A | | 11/1974 | Goodley |
| 3,886,779 | A | | 6/1975 | McClain |
| 3,898,783 | A | | 8/1975 | Matlock et al. |
| 3,903,723 | A | | 9/1975 | Colbath |
| 3,914,971 | A | | 10/1975 | Colbath |
| 3,921,424 | A | | 11/1975 | Pearson |
| 3,945,232 | A | | 3/1976 | Colbath |
| 4,120,123 | A | | 10/1978 | Knudson |
| 4,218,946 | A | | 8/1980 | Witzler |
| 4,269,055 | A | | 5/1981 | Sivachenko et al. |
| 4,412,443 | A | * | 11/1983 | Stoehr ..... 72/181 |
| 4,471,641 | A | | 9/1984 | Mitchell |
| 4,487,046 | A | | 12/1984 | Abbey, III |
| 4,495,743 | A | | 1/1985 | Ellison et al. |
| 4,505,143 | A | | 3/1985 | Knudson |
| 4,597,234 | A | | 7/1986 | Simpson |
| 4,660,399 | A | | 4/1987 | Suter et al. |
| 4,716,754 | A | | 1/1988 | Youngs |
| 4,721,504 | A | | 1/1988 | Cogswell et al. |
| 4,787,233 | A | | 11/1988 | Beymer |
| 4,796,797 | A | | 1/1989 | Nakako |
| 4,811,587 | A | | 3/1989 | Knudson |
| 4,878,331 | A | | 11/1989 | Taylor |
| 4,899,566 | A | | 2/1990 | Knudson |
| 4,947,671 | A | | 8/1990 | Lindstrom |
| 5,072,563 | A | | 12/1991 | Menegoli |
| 5,140,793 | A | | 8/1992 | Knudson |
| 5,148,694 | A | | 9/1992 | Pearson et al. |
| 5,394,722 | A | | 3/1995 | Meyer |
| 5,470,687 | A | | 11/1995 | Mayama et al. |
| 5,740,687 | A | | 4/1998 | Meyer et al. |
| 5,746,459 | A | * | 5/1998 | Giroux et al. ..... 292/341.16 |
| 5,787,748 | A | | 8/1998 | Knudson et al. |
| 6,981,397 | B2 | * | 1/2006 | Meyer ..... 72/181 |
| 2003/0094027 | A1 | * | 5/2003 | Cunningham ..... 72/181 |

FOREIGN PATENT DOCUMENTS

| | | |
|---|---|---|
| GB | 2110134 | 6/1983 |
| IT | 257 | 3/1882 |
| JP | 55-100826 | 8/1980 |
| JP | 27723 | 2/1984 |
| SU | 721141 | 3/1980 |

OTHER PUBLICATIONS

Written Opinion for PCTIUS96/05595 mailed Apr. 14, 1997.
Notification of Transmittal Search Report or the Declaration for PCT/US02/04338 mailed Jun. 13, 2002.
Notification of Transmittal of International Preliminary Examination Report for PCT/US94/09289 mailed Dec. 7, 1995.

* cited by examiner

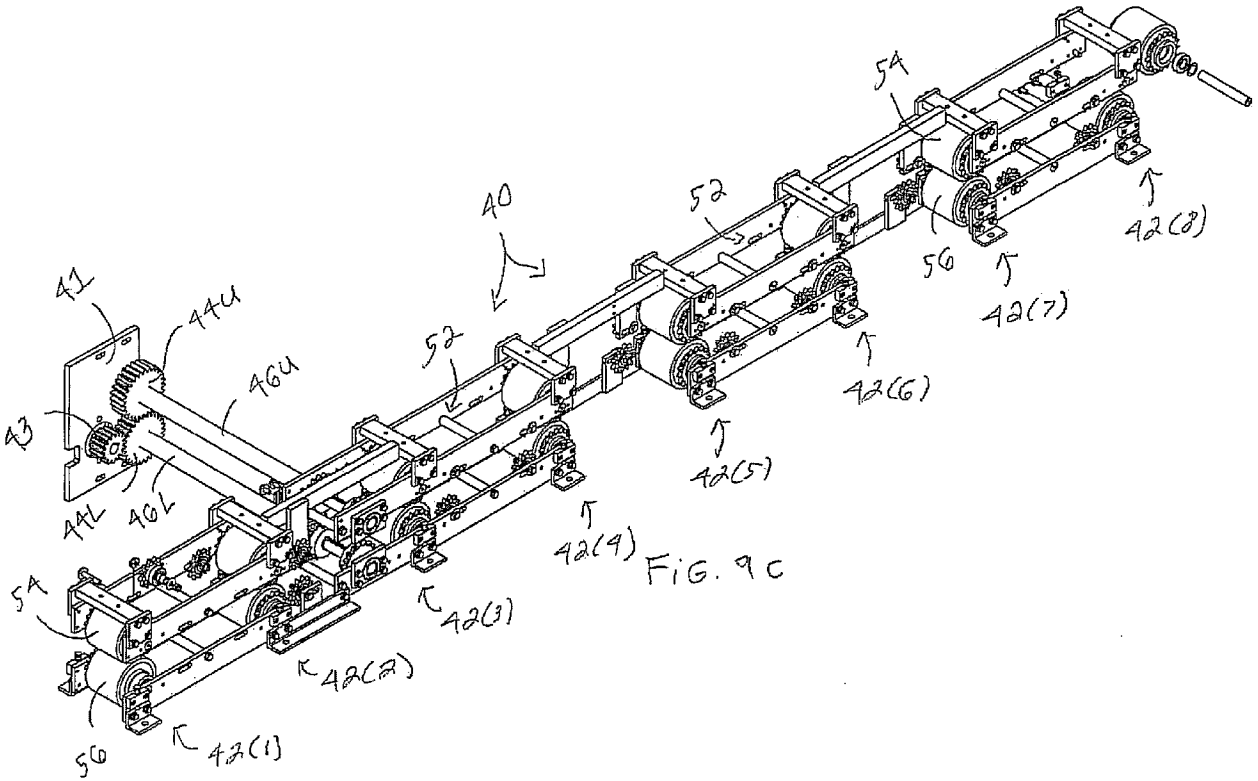
A2(8)
A2(7)
A2(6)
A2(5)
A2(4)
A2(3)
A2(2)
A2(1)
A0
A1
A3
A4
A5
A6
A7
A8
A9
A10
A11
A12
A13
A14
A15
A16
A17
A18
A19
A20
A21
A22
A23
A24
A25
A26
A27
A28
A29
A30
A31
A32
A33
A34
A35
A36
A37
A38
A39
A40
A41
A42

DETAIL B

DETAIL A

DETAIL B

DETAIL A

DETAIL B

DETAIL A

MATERIAL FORMING MACHINE INCORPORATING QUICK CHANGEOVER ASSEMBLY

CROSS-REFERENCE TO RELATED APPLICATIONS

The present application is a divisional of application Ser. No. 12/551,113, filed Aug. 31, 2009, which is a divisional of application Ser. No. 12/547,710, filed Aug. 26, 2009, which claims the benefit of U.S. Provisional Application Ser. No. 61/091,763, filed on Aug. 26, 2008 and U.S. Provisional Application Ser. No. 61/120,714, filed on Dec. 8, 2008, the disclosures of which are hereby incorporated by reference in their entireties.

BACKGROUND

Material forming machines play a significant role in modern industry and include, for example, machines which stamp, roll, form, cut and extrude metal, to name a few. One type of machine, and the type to which the present invention is directed, receives an elongate strip of material at an entryway and advances the strip of material progressively through the machine against longitudinally positioned forming elements to configure longitudinal margins of the strip into desired useful cross-sections, or profiles. After formation, the strip is discharged at an exit location, and a shear may be positioned at the exit to cut preformed material into selected lengths. A representative selectively actuable shear assembly is described, for example, in U.S. Pat. No. 5,740,687 issued Apr. 21, 1998 to Meyer et al. The '687 patent has been assigned to New Tech Machinery Corp. of Denver, Colo., the assignee of the present invention. The strips of material that are fed into the machine may either be at discrete lengths or, as is more typically the case, a continuous feed is provided from a coil, such as a coil of metal to be formed. The formed strip is then cut into usable lengths at the exit location or downstream end of the machine. Specific examples of such apparatus include commercial/residential roof panel forming machines, gutter forming machines, siding panel forming machines and soffit panel forming machines.

Existing material forming machines typically have a framework which supports a drive assembly for advancing the elongated strip of material in a downstream direction from the entrance to the exit. The drive assembly is coupled to one or more pairs of co-acting rollers centrally located along the pathway of the strip. Until the late 1990s the co-acting pairs had included two driven rollers each journal for synchronous rotation about first and second axis, respectively, which rollers were located above and below the strip as it was advanced through the framework. However, the '687 patent noted above also disclosed a forming apparatus wherein the pairs of co-acting rollers each comprise a driven roller connected to the drive assembly and a free-wheeling roller adjustably mounted to its associated driven roller. Representative forming machines from New Tech Machinery Corp. which incorporate the teachings of both the '687 patent are available under the designations "BG7" and "Mach II".

Also in existing material forming machines it is known to provide a plurality of forming rollers disposed along the pathway of the strip to configure one or both margins into a desired profile. This is accomplished by progressively bending the margins into a particular shape. Sometimes these forming rollers are each independently mounted to the framework at selected locations, but another technique involves grouping forming elements together as forming station sets along the pathway of the strip. For example, in U.S. Pat. No. 5,425,259 issued Jun. 20, 1995 to Coben et al., also assigned to New Tech, a forming machine is disclosed for bending strips wherein an elongated rail structure is removably secured within the interior of the framework of the machine and its removable out, for example, the one entrance or exit of the framework. The rail structure is mounted at discrete mounting locations that are spaced laterally of the drive mechanism, and a plurality of forming elements are disposed on the rail structure to define at least two longitudinally spaced forming stations. The rail structure is removable from the framework without detaching the forming stations. Alternative sets of rail structures can then be interchangeably mounted in the framework as forming sets to allow formation of different profiles without the need to individually change each forming station. Representative forming machines which incorporate the use of such features are available from New Tech Machinery under the designations "SSP MultiPro", "SSH MultiPro", "SSR MultiPro Jr.", "5VC 5V Crimp" and "FWM Flush Wall".

While forming machines have been quite useful and effective in fabricating metal strips into shaped members, such as panels and gutters, in the past such machines were only able to form a single profile so that the fabricator would have to require separate machines for each profile desired to be configured, or for each change of dimensions within a given profile. Alternatively, the entire set of forming elements would need to be replaced by individually detaching each forming element or, in certain cases, by replacing a forming station box comprising a set of forming rollers. In U.S. Pat. No. 5,394,722 issued Mar. 7, 1995 to Meyer, an apparatus for forming profiles on strip materials is disclosed wherein a standard profile can be formed of two different sizes or physical dimensions. The machine shown in the '722 patent utilizes rollers that may be positioned toward and apart from one another for selected spacing between the two relative positions, thereby to selectively vary the profile formed.

A further advancement in the art of material forming machines is described in U.S. Pat. No. 6,772,616 issued Aug. 10, 2004 to Cunningham et al., also assigned to the assignee of the present invention. This patent describes a forming machine wherein greater flexibility of fabrication is achieved because the machine is constructed to accommodate a variety of different sets of metal forming stations mounted as sets on rail structures, or support beams, so that the different sets may be easily interchanged to allow fabrication of different panel profiles. As such, an easily adjustable forming machine is described for varying profile dimensions, such as profile height and profile separation, with a minimum of downtime for the machine during a changeover.

While all of these existing machines are quite useful and effective in fabricating material strips into shaped members, they do suffer from inflexibility during calibration, changeover and offset adjustment in particular. In order to calibrate these machines, for example, it is necessary to ensure that the rollers which comprise the drive assembly and the forming assembly are properly aligned within the machine. More particularly, it is important that these members be properly positioned relative to a "pass line", which is an imaginary line contained within an imaginary plane through which the sheet material travels through the machine during use. In essence, then, this imaginary plane extends centrally through the machine just above the bottom one of each co-acting pair of drive rollers. The traditional approach for properly positioning the drive assembly within the machine begins with attaching a string, fishing line or the like, between two fixed points within the machine so that it is coextensive with, or parallel to, the pass line. Upstream and downstream ones of the drive assembly's bottom/drive rollers are then shimmed so that they are higher than the intermediate drive rollers, and set to the specific height of the pass line. The remaining intermediate drive rollers are then adjusted so that their upper surfaces are then all situated on the pass line. Each top drive roller, which is adjustably mounted to upper cross members of the machine's framework via set screws, may then be adjusted downwardly into position.

From time to time during use of the forming machine it becomes necessary to make other adjustments. For example, changeovers and/or offset adjustments become necessary so that the machine can be adjusted to accommodate different panel widths or different profiles for a given width. For a complete changeover, for example, it is necessary to replace existing tooling, while an offset adjustment requires moving selected portions of the tooling relative to others within the machine itself. A typical changeover in an "SSP MultiPro" roof panel machine or the like, requires the removal of rails within the machine that support the tooling, along with their associated adjustment blocks. For example, within the "SSP MultiPro" there are eight (8) aluminum angle blocks that mount to the frame and the right hand side tooling is secured above these blocks. To remove the tooling requires feeding the rails on each side of the machine, with the tooling mounted to them, out through either the entry or sheer end of the machine. Depending on the existing tooling profile, there are typically one to two rails within each side of the machine. These rails or rail segments are quite heavy and cumbersome with tooling mounted to them. Moreover, to provide a suitable clearance and ease of maneuverability, it is necessary to disassemble or remove various other components of the fabricating machine such as its cover portions (top covers, side covers) and other subassemblies (e.g., entry drum assemblies and guide system).

Once the old tooling has been removed, a new tooling set needs to be assembled inside the machine. On the fixed (or right-hand side of the machine from the perspective of an observer looking in the downstream direction from the entry way to the exit) the replacement tooling needs to be mounted such that the faces of their associated angle blocks are positioned a particular distance from fixed points on the machine, with this distance being dictated by the particular profile to be run. This distance is often established, again, through the use of a string line extending between two known, fixed points. It is quite common to use a tape measure or other suitable measuring device to ensure that the tooling is properly positioned at the desired distance from the string line. Set screws are provided to assist with the process to make "fine tune" adjustments.

The left side of the machine has adjustable subassemblies so that the tooling can be moved laterally inwardly or outwardly through the use of an Acme shaft with Acme nuts. In the "SSP MultiPro" unit for example, tooling is affixed to the face side of the rails which themselves mount to the clamp blocks, each clamp block having two threaded holes and two through holes. Here again, it is necessary to set the distance from the face angle of clamp blocks to another string line, and this can be accomplished via a nut, of which there are at least five. Once the tooling is adjusted, a crankshaft is employed to manually adjust the left side relative to the right side, via the Acme shafts, to accommodate for different sheet material.

It should be appreciated that a complete changeover is a very tedious process and requires that the tooling be precisely positioned within the machine to ensure seamless operation. Indeed, one complete changeover from one leg configuration profile to another can be a 4-5 hour process. An offset adjustment, whereby the offset spacing between the face of one rail segment on the left side of the machine is adjusted relative to another downstream of it, can also be time consuming. To accomplish this, one of the rail segments must be set, and then the other rail segment positioned relative to it based on whether a positive or negative offset is required. This process requires independent manual adjustment of the rail segments which is quite tedious. In the past it has been known to utilize an Acme shaft having a coupler which can be disengaged to allow one rail segment to be adjusted relative to another on the same side of the machine. However, the engaged or disengaged state of the coupler cannot be manually adjusted and requires hand tools. Even then, it remains necessary to adjust each rail segment using the approach discussed above wherein set screws, string lines and tape measures are employed.

SUMMARY

The present application provides a mechanism for use in adjusting the position of components in a machine, including an elongate shaft assembly that includes at least one primary shaft segment and at least one secondary shaft segment removably coupled to the primary shaft segment. The primary and secondary shaft segments may be joined by a half-lap joint. The secondary shaft segment includes a first gear element disposed thereon. The first gear element may be keyed to the secondary shaft segment.

The mechanism also includes at least one projection shaft extending in a direction transverse to the elongate shaft assembly and includes a second gear element disposed on a proximal end portion thereof. The first and second gear elements may be mitre gears. The projection shaft may be comprised of an ACME shaft threadably engaged with an ACME nut that is capable of being coupled to the components. The second gear element is coupled to the first gear element so that rotation of the elongate shaft assembly translates into rotation of the projection shaft. The projection shaft is capable of being coupled to the components such that rotation of the projection shaft operates to adjust the position of the components in a direction perpendicular to the shaft assembly, for example. A support frame, which may include at least one bearing for supporting the secondary shaft segment, accommodates the secondary shaft segment and the proximal end portion. At least a portion of the secondary shaft segment may be of reduced diameter as compared to the primary shaft segment.

The mechanism may include a plurality of primary shaft segments, where at least one secondary shaft segment is coupled between two primary shaft segments. The mechanism may also include a plurality of secondary shaft segments, each removably coupled to an associated primary shaft segment. The secondary shaft segments may each have an associated first gear element disposed thereon and an associated projection shaft that includes an associated second gear element disposed on a proximal end portion thereof. The second gear elements each being coupled to an associated first gear element.

The machine components may be comprised of upstream components and downstream components and the adjusting mechanism may include an upstream portion including at least one secondary shaft segment and at least one projection shaft capable of being coupled to the upstream components and a downstream portion including at least one secondary shaft segment and at least one projection shaft capable of being coupled to the downstream components. A coupler may be interposed between the upstream and downstream portions. The coupler has a coupled state wherein the upstream and downstream portions operate concurrently, and a decoupled state wherein at least one of the upstream and downstream portions operates independently of the other.

Also contemplated is a forming machine adapted to form a longitudinal margin of a strip of material into a desired profile. The forming machine is comprised of a framework having side frames interconnected to one another by transverse members. The framework has an interior including a forming region through which the strip may be advanced from an upstream entrance to a downstream exit. A drive mechanism is disposed in the interior of the framework and operative to engage the strip and advance the strip in a downstream direction from the entrance to the exit. An elongated rail structure is mounted relative to the framework and spaced laterally from the drive mechanism. A plurality of forming elements are secured to the rail structure to define at least one forming station that is positioned to receive the longitudinal margin and operative to contribute to forming the longitudinal margin into the desired profile as the strip is advanced through the forming region by the drive mechanism. A mechanism for adjusting a lateral distance between the rail structure and the drive mechanism is also included in the forming machine. The adjusting mechanism is comprised of an elongate shaft assembly, at least one projection shaft extending in a direction transverse to the elongate shaft assembly, and a support frame accommodating the secondary shaft segment and the proximal end portion. The elongate shaft assembly includes at least one primary shaft segment and at least one secondary shaft segment removably coupled to the primary shaft segment. The secondary shaft segment including a first gear element disposed thereon. The projection shaft includes a second gear element coupled to the first gear element whereby rotation of the elongate shaft assembly translates into rotation of the projection shaft. The projection shaft may be coupled to the rail structure such that rotation of the projection shaft operates to adjust the position of the rail structure.

An improvement to a metal forming machine that is adapted to bend a longitudinal margin of a strip of metal into a desired profile is also contemplated. Such a machine includes: a framework having side frames interconnected to one another by transverse members, the framework having an interior including a forming region through which the strip may be advanced from an upstream entrance to a downstream exit. A drive mechanism is disposed in the interior of the framework and operative to engage the strip and advance the strip in a downstream direction from the entrance to the exit. An elongated rail structure is mounted relative to the framework and spaced laterally from the drive mechanism and a plurality of forming elements are secured to the rail structure to define at least one forming station that is positioned to receive the longitudinal margin and operative to bend the longitudinal margin as the strip is advanced through the forming region by the drive mechanism. The improvement comprises a mechanism for adjusting a lateral distance between the rail structure and the drive mechanism. The adjusting mechanism includes an elongate shaft assembly, at least one projection shaft extending in a direction transverse to the elongate shaft assembly, and a support frame accommodating the secondary shaft segment and the proximal end portion. The elongate shaft assembly includes at least one primary shaft segment and at least one secondary shaft segment removably coupled to the primary shaft segment, the secondary shaft segment including a first gear element disposed thereon. The projection shaft includes a second gear element disposed on a proximal end portion thereof. The second gear element being coupled to the first gear element whereby rotation of the elongate shaft assembly translates into rotation of the projection, which is coupled to the rail structure such that rotation of the projection shaft operates to adjust the position of the rail structure.

A method of replacing a portion of a mechanism for use in adjusting the position of components in a machine is also contemplated. The mechanism includes an elongate shaft assembly that includes at least one primary shaft segment, and at least one secondary shaft segment removably coupled to the primary shaft segment. The secondary shaft segment includes a first gear element disposed thereon. At least one projection shaft extends in a direction transverse to the elongate shaft assembly and includes a second gear element. The second gear element is coupled to the first gear element and a support frame accommodates the secondary shaft segment and the proximal end portion. The method of replacing comprises decoupling the secondary shaft segment from the primary shaft segment and removing the first gear element from the secondary shaft segment without disturbing the primary shaft segment or projection shaft. The first gear element may be removed without disturbing the frame. The secondary shaft segment may also be slidably extracted from the frame. The frame may include a backing plate and a pair of ears such that the ears may be removed from the backing plate along with the first gear element and second shaft segment.

The present application also provides a mounting block assembly for positionally adjusting machine components including a mount for attachment to a framework of the machine and a component interface pivotably mounted to the mount about a pivot axis. The component interface is capable of supporting at least one component. The mount may be attached to a mounting pad disposed on the framework.

The component interface includes a slide block pivotably mounted to the mount about the pivot axis and a tie block adjustably mounted to the slide block along an adjustment axis parallel to the pivot axis. The slide block may include an elongate slot parallel to the adjustment axis and the tie block is adjustably mounted along the slot. The slide block may include upper and lower legs, the upper leg including a slideway along which the tie block is mounted and the lower leg forms an obtuse angle having a vertex about which the slide block pivots.

In an alternative construction the tie block includes an elongate slot parallel to the adjustment axis and the tie block is adjustably mounted to the slide block along the slot. The slide block may include opposed limit stops between which the tie block is adjustably positionable.

The slide block is slidably mounted to the mount along a mount axis parallel to the pivot axis. The slide block is mounted to the mount by at least one threaded mounting fastener and including at least one threaded adjustment bolt extending through the slide block whereby rotation of the threaded adjustment bolt pivots the slide block about the pivot axis. The slide block may include a threaded slide screw extending parallel to the adjustment axis and aligned with the threaded adjustment bolt whereby rotation of the threaded slide screw adjusts the slide block along the mount axis. The threaded mounting fastener may extend through a slot formed through the slide block and an end portion of the threaded slide screw confronts the shank of the mounting fastener.

The mount may include a tapered surface oriented at an acute angle relative to an upper surface of the mount that provides clearance for pivoting the slide block. The slide block may also include a tapered surface facing the mount oriented at an obtuse angle relative to a side surface of the slide block for providing clearance for pivoting the slide block. Preferably, the mount and the slide block are machined to tolerance.

A method for calibrating the position of at least one machine component relative to a framework of the machine is also contemplated. The method comprises establishing a longitudinal datum reference along the framework and providing a mounting block assembly for installation between the component and the framework. The mounting block assembly includes a mount capable of being fastened to the framework and a component interface pivotably mounted to the mount about a pivot axis, the component interface capable of supporting at least one component. The method also includes leveling the mount to the framework in a direction transverse to the datum reference to define a mount leveled orientation and fixedly positioning the mount to the framework in the mount leveled orientation. Leveling the mount to the framework may be accomplished by shimming. The component interface is also pivoted about the pivot axis in order to level it to the framework in a direction parallel to the datum reference to define a component interface leveled orientation and fastening the component to the component interface.

The component interface may include a slide block pivotably mounted to the mount about the pivot axis so that the slide block is slidably mounted to the mount along a mount axis that is parallel to the pivot axis. The slide block may be slid along the mount axis in order to adjust the transverse location of the slide block relative to the datum reference. The component interface may also include a tie block capable of supporting the component and adjustably mounted to the slide block along an adjustment axis that is parallel to the pivot axis. The tie block may be adjusted by moving it along the adjustment axis.

Also contemplated is a rail structure for use in a forming machine that is adapted to form a strip of material into a desired profile comprising a pair of mounting block assemblies and a mounting rail extending between and mounted to the mounting block assemblies. Each mounting block assembly including a mount for attachment to a framework of the machine, a slide block pivotably mounted to the mount about a pivot axis, and a tie block adjustably mounted to the slide block along an adjustment axis that is parallel to the pivot axis. A tool set including a tooling rail and a plurality of forming elements may be mounted to the mounting rail. A spacer may be disposed between the tooling rail and the mounting rail.

A forming machine adapted to form a longitudinal margin of a strip of material into a desired profile is also provided herein. The forming machine comprising a framework having an interior including a forming region through which the strip may be advanced from an upstream entrance to a downstream exit. A drive mechanism is disposed in the interior of the framework and operative to engage the strip and advance the strip in a downstream direction from the entrance to the exit. The forming machine includes a rail structure that includes at least a pair of mounting block assemblies that each include a mount fastened to the framework, a slide block pivotably mounted to the mount about a pivot axis, and a tie block adjustably mounted to the slide block along an adjustment axis that is parallel to the pivot axis. A mounting rail extends between and is mounted to the pair of mounting block assemblies. A plurality of forming elements are supported by the rail structure to define at least one forming station that is positioned to receive the longitudinal margin and operative to contribute to forming the longitudinal margin into the desired profile as the strip is advanced through the forming region by the drive mechanism.

An improvement to a metal forming machine adapted to bend a longitudinal margin of a strip of metal into a desired profile is also contemplated. Such a machine includes: a framework having an interior including a forming region through which the strip may be advanced from an upstream entrance to a downstream exit; a drive mechanism disposed in the interior of the framework and operative to engage the strip and advance the strip in a downstream direction from the entrance to the exit; an elongated rail structure mounted relative to the framework and spaced laterally from the drive mechanism; and a plurality of forming elements connected to the rail structure to define at least one forming station that is positioned to receive the longitudinal margin and operative to bend the longitudinal margin as the strip is advanced through the forming region by the drive mechanism. The improvement to the metal forming machine comprises a plurality of mounting block assemblies disposed between the rail structure and the framework, each including a mount fastened to the framework, a slide block pivotably mounted to the mount about a pivot axis, and a tie block supporting the rail structure. The tie block being adjustably mounted to the slide block along an adjustment axis that is parallel to the pivot axis.

The present application further provides a clamp block kit for use on a machine having an adjustment mechanism employing a shaft and associated nut, comprising a clamp block assembly securable about the nut. The clamp block assembly includes a first clamp including at least one threaded first hole, a second clamp including at least one second hole alignable with a respective the at least one first hole when in an assembled state, and at least one first fastener for extending into the aligned the first and second holes. A mounting rail is fastenable to the clamp block assembly with at least one second fastener.

The mounting rail is fastenable adjacent to the first clamp. The at least one threaded first hole is a through hole and the at least one second fastener extends into the at least one threaded first hole. The at least one threaded first hole may be a pair of first holes, the at least one second hole may be a pair of second holes, and the at least one first fastener may be a pair of first fasteners.

Also contemplated is a mounting rail assembly for use on a machine having an adjustment mechanism employing at least a pair of projection shafts and associated nuts, comprising at least a pair of clamp block assemblies each securable about a respective the nut and an elongate mounting rail fastenable to the clamp block assemblies.

A mounting rail assembly for positionally adjusting machine components is further contemplated herein. The mounting rail assembly comprises a projection shaft capable of being rotatably mounted to the machine, a nut threadably engaged with the projection shaft, and a clamp block assembly secured about the nut. The clamp block assembly including a first clamp including at least one threaded first hole, a second clamp including at least one second hole aligned with a respective the at least one first hole, and at least one first fastener extending into the aligned the first and second holes. An elongate mounting rail is fastened to the first clamp and capable of supporting at least one component. The mounting rail may include at least one transversely extending slot, and may include at least one second fastener extending through the slot to engage the threaded first hole, whereby the mounting rail is selectively adjustable along the slot. The mounting rail assembly may include indicia on the mounting rail indicative of an offset mounting rail position.

A rail structure for use in a machine that is adapted to form a strip of material into a desired profile is also provided for herein. The rail structure comprises at least one projection shaft capable of being rotatably mounted to the machine, at least one nut threadably engaged with the projection shaft, a clamp block assembly secured about the nut, and an elongate mounting rail fastened to the clamp block assembly. The rail structure may further include a tool set including a tooling rail and a plurality of forming elements secured thereto.

The present application also provides a forming machine adapted to form a longitudinal margin of a strip of material into a desired profile comprising a framework having an interior including a forming region through which the strip may be advanced from an upstream entrance to a downstream exit. A drive mechanism is disposed in the interior of the framework and operative to engage the strip and advance the strip in a downstream direction from the entrance to the exit. A rail structure including a projection shaft is rotatably mounted to the framework. A nut is threadably engaged with the projection shaft, and a clamp block assembly is secured about the nut. The clamp block assembly includes a first clamp including at least one threaded first hole, a second clamp including at least one second hole aligned with a respective the at least one first hole, and at least one first fastener extending into the aligned the first and second holes. An elongate mounting rail is fastened to the first clamp with at least one second threaded fastener extending into one of the threaded first holes. A plurality of forming elements are secured to the rail structure to define at least one forming station that is positioned to receive the longitudinal margin and operative to contribute to forming the longitudinal margin into the desired profile as the strip is advanced through the forming region by the drive mechanism.

An improvement to a metal forming machine adapted to bend a longitudinal margin of a strip of metal into a desired profile is also contemplated. Such a machine includes: a framework having an interior including a forming region through which the strip may be advanced from an upstream entrance to a downstream exit; a drive mechanism disposed in the interior of the framework and operative to engage the strip and advance the strip in a downstream direction from the entrance to the exit; an elongated rail structure mounted relative to the framework and spaced laterally from the drive mechanism; and a tool set connected to the rail structure, the tool set positioned to receive the longitudinal margin and operative to bend the longitudinal margin as the strip is advanced through the forming region by the drive mechanism. The improvement to the forming machine comprises a mechanism for adjusting a separation distance between the rail structure and the drive mechanism. The adjusting mechanism includes a projection shaft rotatably mounted to the machine, a nut threadably engaged with the projection shaft, and a clamp block assembly secured about the nut. The clamp block assembly includes a first clamp including at least one threaded first hole, a second clamp including at least one second hole aligned with a respective the at least one first hole, and at least one first fastener extending into the aligned the first and second holes. An elongate mounting rail supports the tool set and is connected to the first clamp.

Also contemplated is a method of configuring the location of components in a machine, comprising providing a rail structure extending in a longitudinal direction including an upstream and downstream segment, each segment including an associated transversely extending projection shaft coupled thereto and operative to adjust the segment in a transverse direction upon rotation thereof. Further providing the upstream segment with a nut threadably engaged with its associated projection shaft, a clamp block assembly secured about the nut, and an elongate mounting rail fastened to the clamp block assembly. The mounting rail is capable of supporting the components. The method also includes moving the mounting rail in a transverse direction relative to the downstream segment while maintaining the relative position of the nut with respect to the projection shafts.

BRIEF DESCRIPTION OF THE DRAWINGS

FIG. 9*c* is perspective view of the drive assembly;

FIG. 14 is an enlarged perspective view showing the quick disconnect assembly for the forming machine's power source;

FIG. 17*e* is a partially exploded perspective view of an alternative foot construction for mounting a downstream support bar segment to the framework of the forming machine;

DETAILED DESCRIPTION

Figure 1:
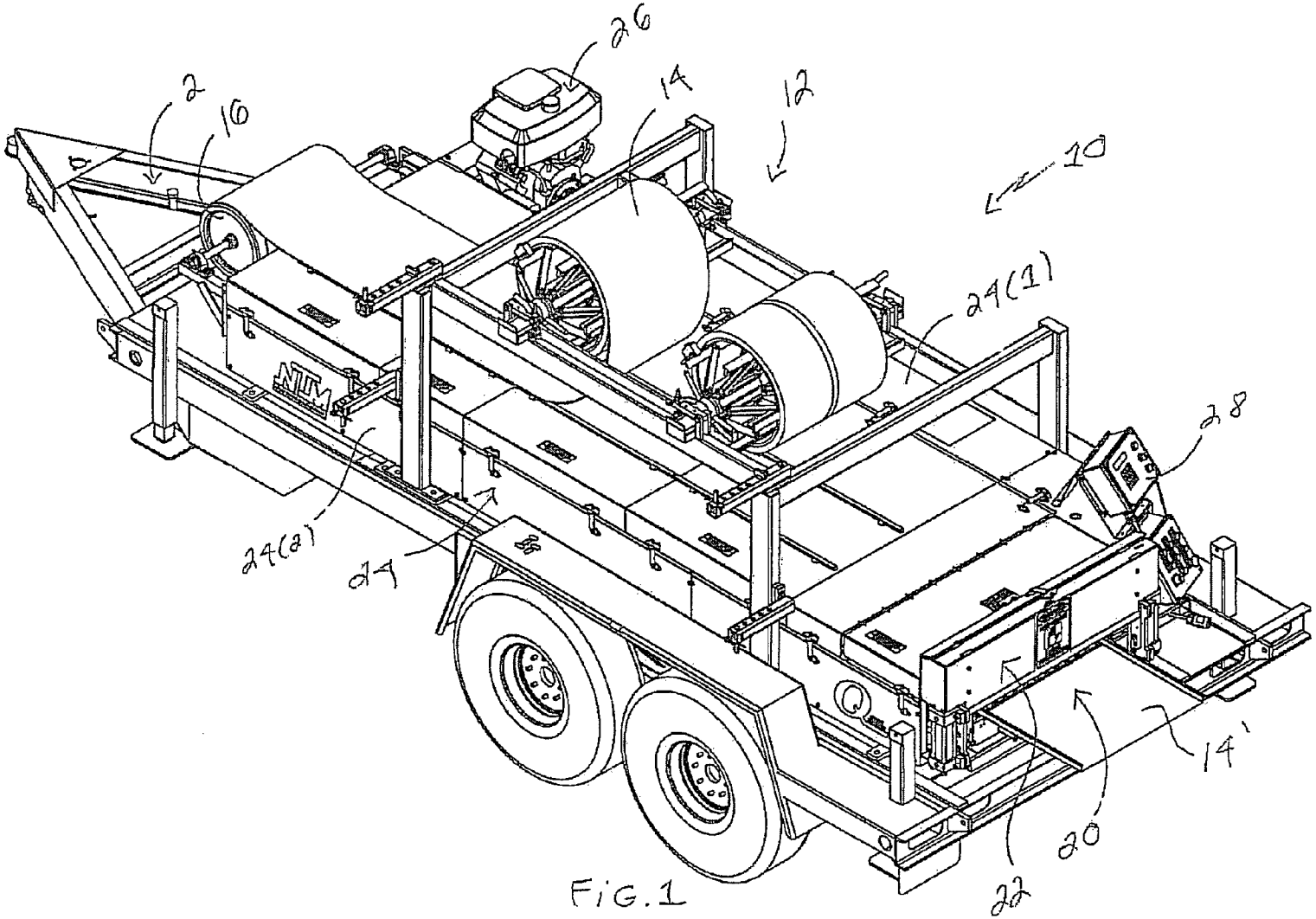
FIG. 1 is a rear perspective view of the material forming machine, and showing the forming machine in use to produce a profiled roof panel from a spool of sheet metal.
Figure 2:
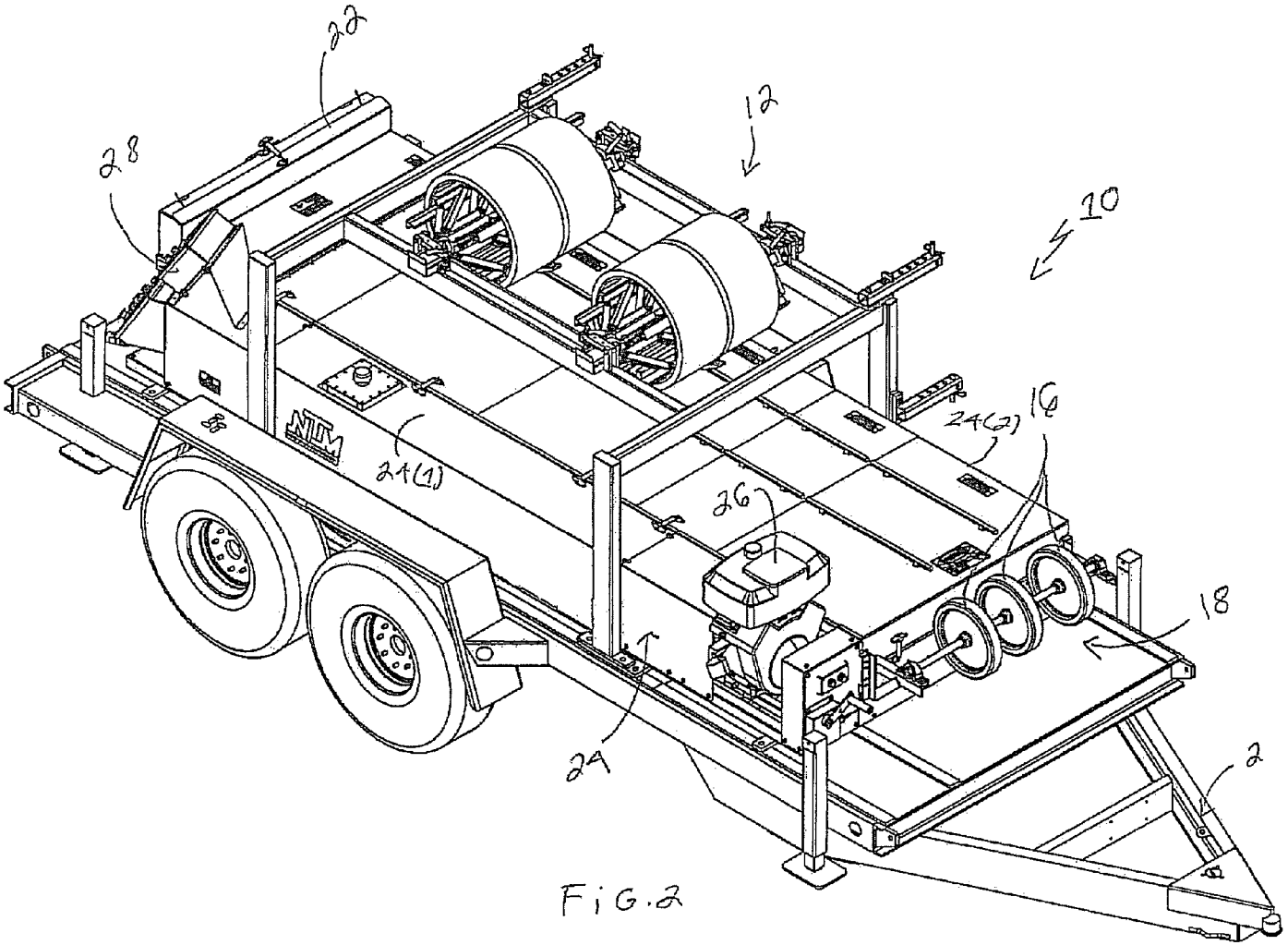
FIG. 2 is a front perspective view of a material forming machine according to an exemplary embodiment, which has been accessorized with an optional overhead reel rack and placed on a trailer.

The present invention is directed to material forming machines, specifically those adapted to bend one or both longitudinal margins of a flat strip of metal into a desired profile. While the invention may be employed with elongate strips of material cut at discrete lengths, it is contemplated that the teachings herein may be primarily used with a continuous feed structure wherein formed strips having any desired longitudinal profile are cut from continuous strip material that is fed into the forming machine. To this end, the strip material may be supported on a spool and rotatably mounted on an overhead reel rack, or by another suitable manner, to be fed in to the machine. The forming machine according to the exemplary embodiments is constructed to receive a variety of interchangeable metal forming stations, mounted as sets on rail or beam structures, so that different sets may be easily interchanged to allow fabrication of different panel profiles. It should be understood that the term "panel" when used in the context of a formed strip can include, for example, a roof panel, a standing seam panel, siding, guttering, structural or nonstructural framing members and the like, as would be understood by the ordinarily skilled artisan in the material forming field. Moreover, while the teachings herein are specifically adapted to form metal roof panels, it should be understood that it is within the context of the invention to form profiles of other shapes and from other types of formable materials.

By way of explanation, then, an exemplary embodiment of a material forming machine 10 is introduced in FIGS. 1, 2, 3*a* & 3*b*. Machine 10 is particularly suited to fabricate roof panels, but could be constructed as desired to fabricate formed material for other applications, such as soffit panels, guttering, siding, and the like. To this end, machine 10 may be mounted on a trailer 2 to provided transportation to and from construction sites. Supported above machine 10 is an optional dual overhead reel rack 12 which supports one or more spools of continuous strip material 14 which are fed over guide rollers, generally 16, and into the machine's entry 18. At the exit 20 of the machine, the strip material 14 is discharged as a selected formed profile 14' (FIG. 1) that may be cut to desired lengths by a suitable shear assembly 22. Enlarged end views of entry 18 and exit 20 are also shown in FIGS. 4*a* & *b*, respectively. Shear assembly 22 may, for example, be constructed substantially as described in U.S. Pat. No. 5,425,259 issued Jun. 20, 1995 to Coben et al. Shear assembly 22 is preferably hydraulically powered and constructed from hardened tool steel blades and dies. The disclosure and teachings of the '259 is incorporated herein by reference in its entirety.

Figure 5:
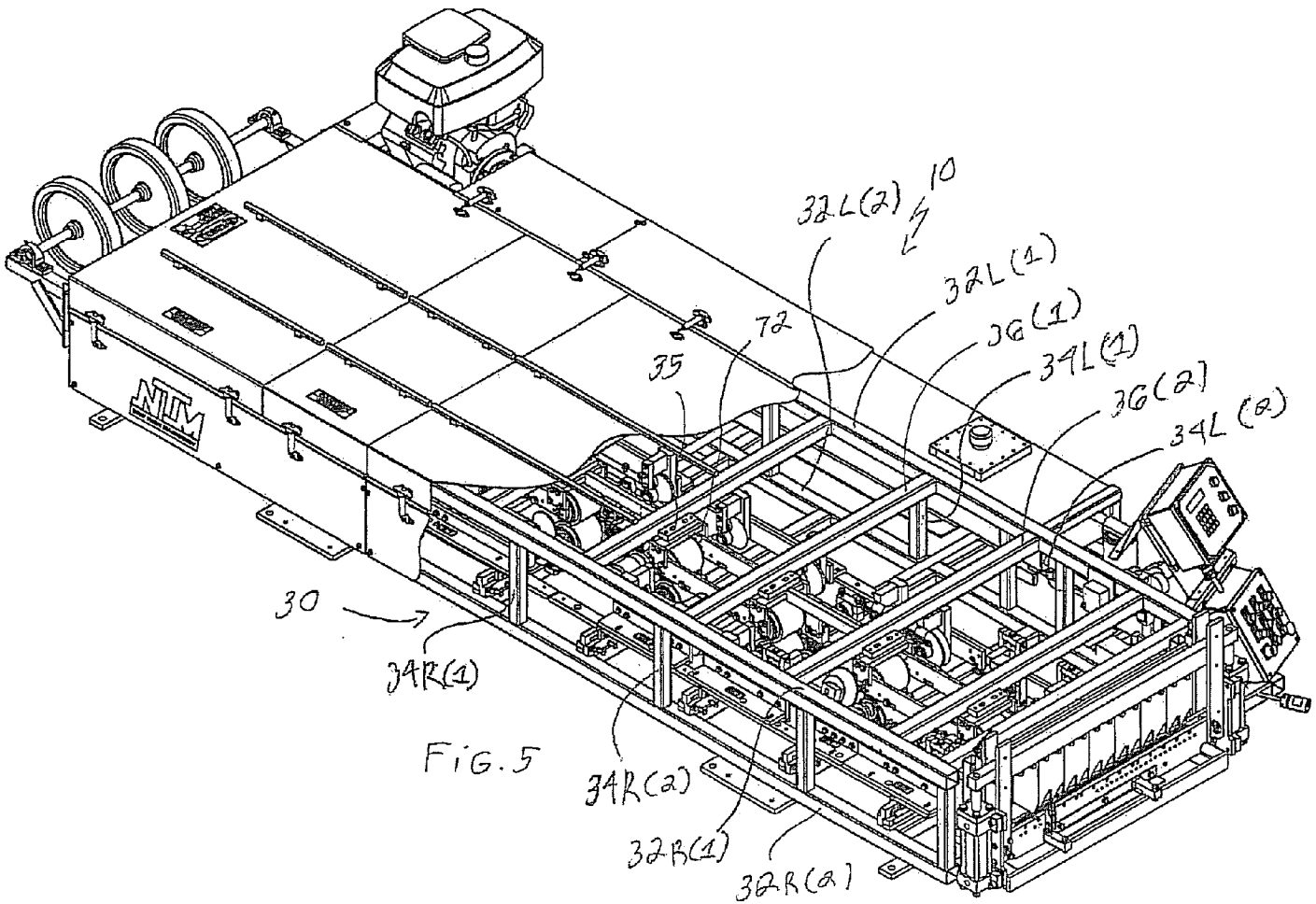
FIG. 5 is a rear perspective view of the material forming machine, and showing it with some of its cover panels removed and broken away.

Machine 10 is supplied with onboard power, such as through an electromechanical power source that includes a gasoline engine 26 as shown here, or an electric motor shown in later figures. An optional electronic controller 28, model AMS 450 available from AMS Controls, interfaces with the manual push button control box and allows an operator to manually input desired panel lengths and quantities and then automatically operate the material forming machine. While connected to the manual push button control box the electronic controller 28 manually controls various functions of the machine including jog forward & reverse, and shear up & down. This electronic controller could also be replaced with a PLC controller in order to automatically control the material forming machine. The manual push button control box allows manual control of jog forward, jog reverse, run forward, run stop, shear down, shear up, motor start and emergency stop. Machine 10 includes an exterior covering 24 which substantially surrounds a framework 30 (FIGS. 5 & 6) and includes a plurality of interlocking, removable top and side panels sections such as 24(1) and 24(2), respectively. Framework 30 comprises a plurality of longitudinally extending upper beams 32R(1), 32L(1) and longitudinally extending lower beams 32R(2) and 32L(2). These longitudinally extending beams interconnect to upper and lower (not shown) transverse beams, such as 36(1) & (2), and left and right upright beams, such as 34L(1) & (2) and 34R(1)& (2).

Figure 6:
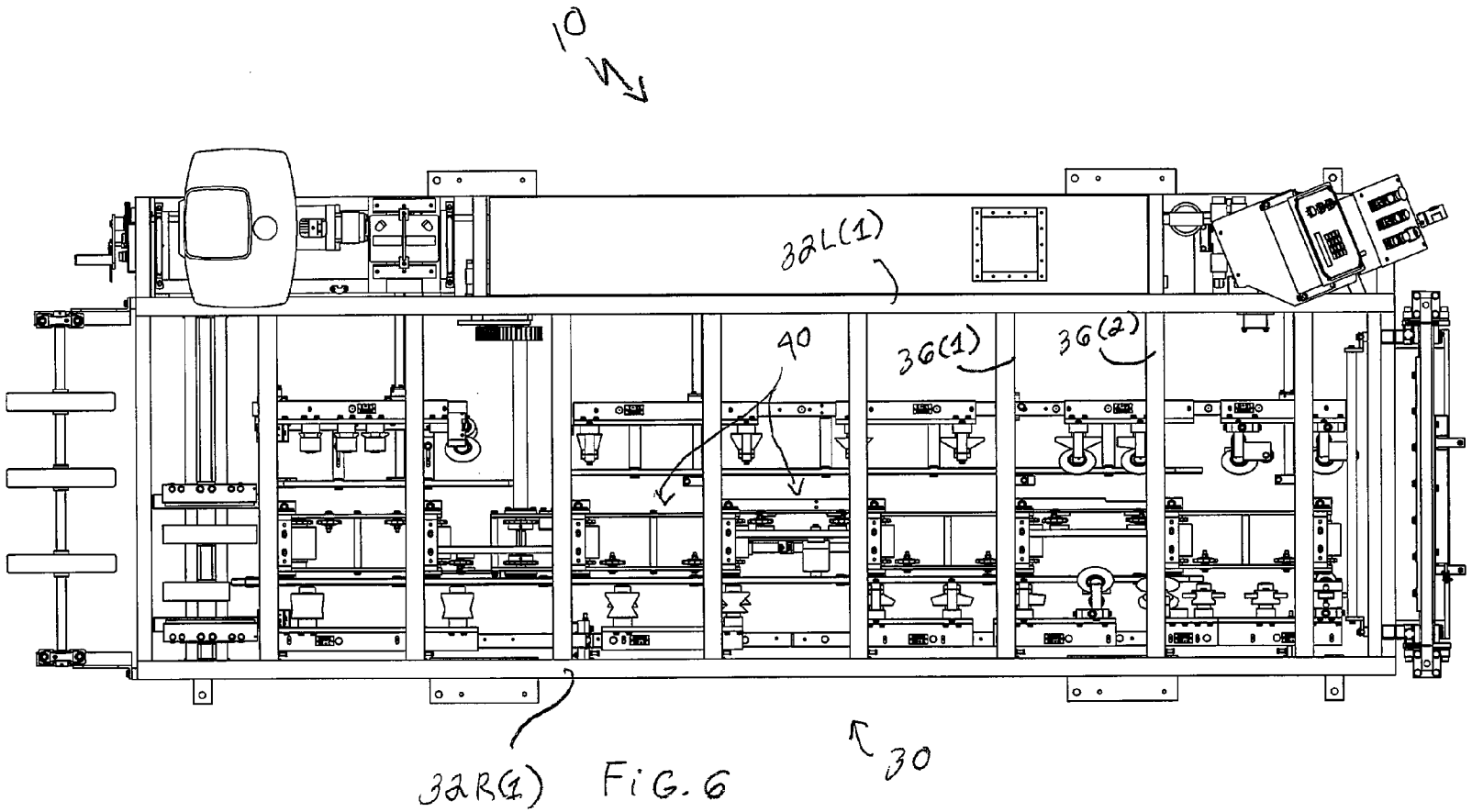
FIG. 6 is a top plan view of the material forming machine with its cover panels removed.
Figure 7:
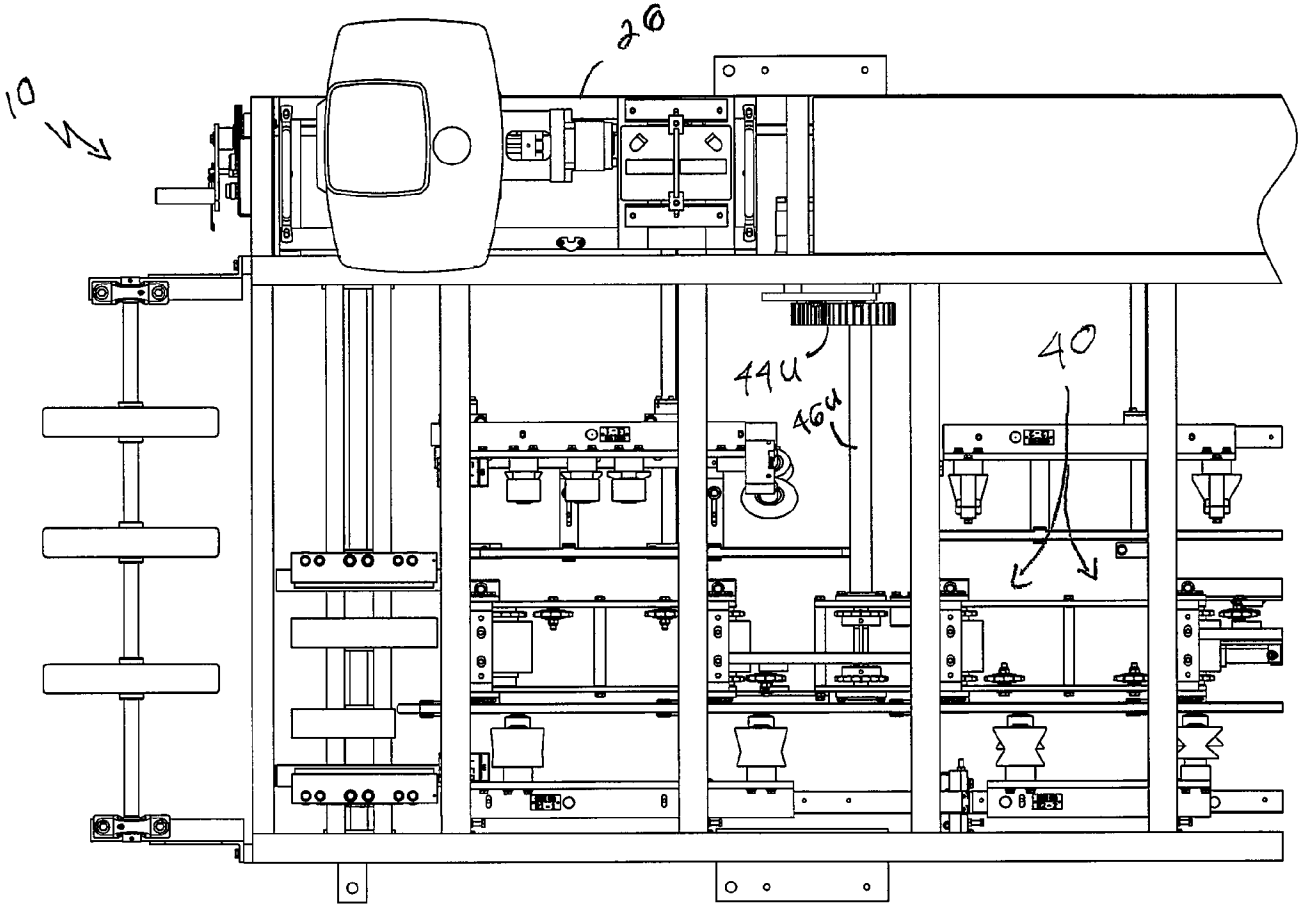
FIG. 7 is an enlarged top plan view showing a front end portion of the material forming machine.
Figure 8:
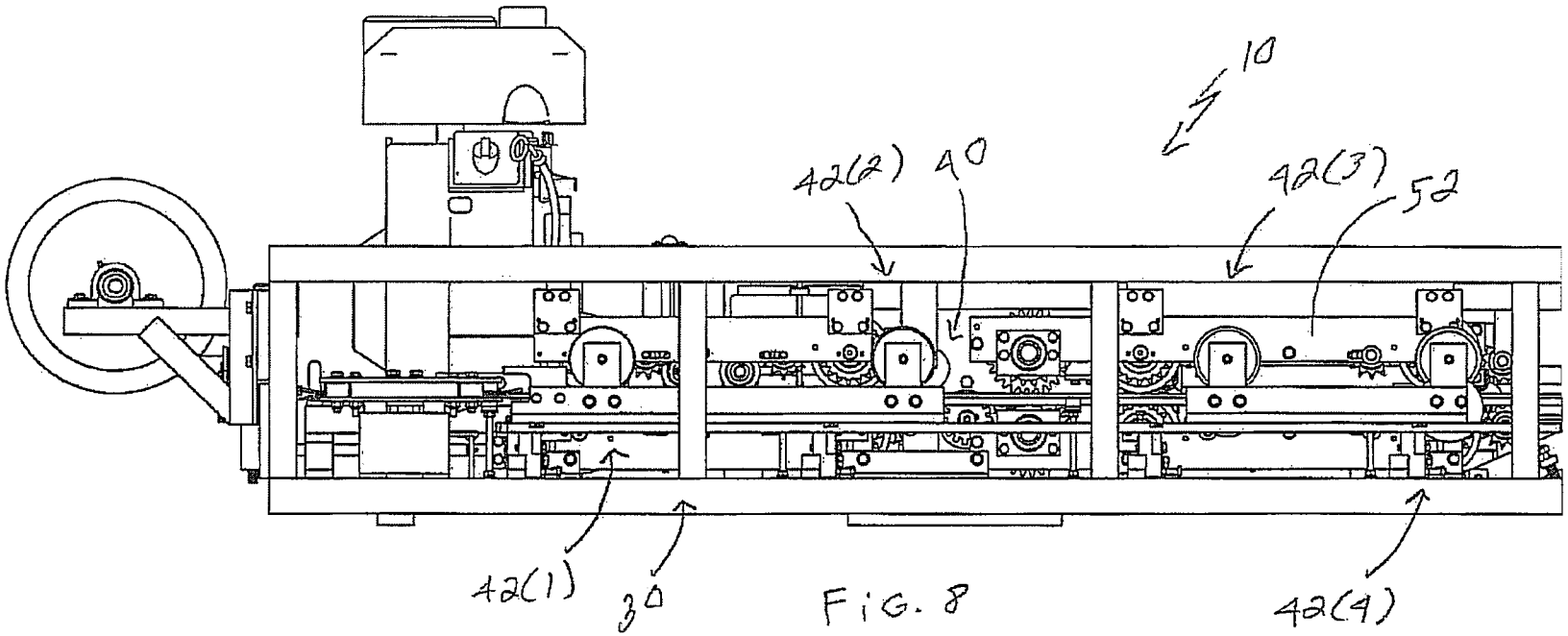
FIG. 8 is an enlarged right side view in elevation showing the front end portion.

As perhaps best shown in FIGS. 6-8, framework 30 supports a drive assembly, generally designated as 40, for forming machine 10. The drive assembly itself is perhaps best appreciated with reference to FIGS. 9*a* through 9*c*. As shown in various ones of these figures, drive assembly 40 includes a plurality of drive stations 42(1)-42(8) which are each located at longitudinally spaced apart downstream locations within framework 30. Drive stations 42(1)-42(8) are mechanically coupled to one another and powered by left and right chains (not shown) which travel about a plurality of upper and lower sprocket gears, generally 50. Gears 50 are rotatably journaled on left and right sides of the drive assembly's associated sub-frame 52, as is well known in the art. With reference to FIG. 7, power to drive assembly 40 is provided by an electromechanical power source which is mechanically coupled to an upper drive shaft 46U. The electromechanical power source is described generally below. Drive shaft 46U is journaled for rotation to thereby impart rotational movement to the chain driven sprockets 50, is well known in the art.

Figure 10:
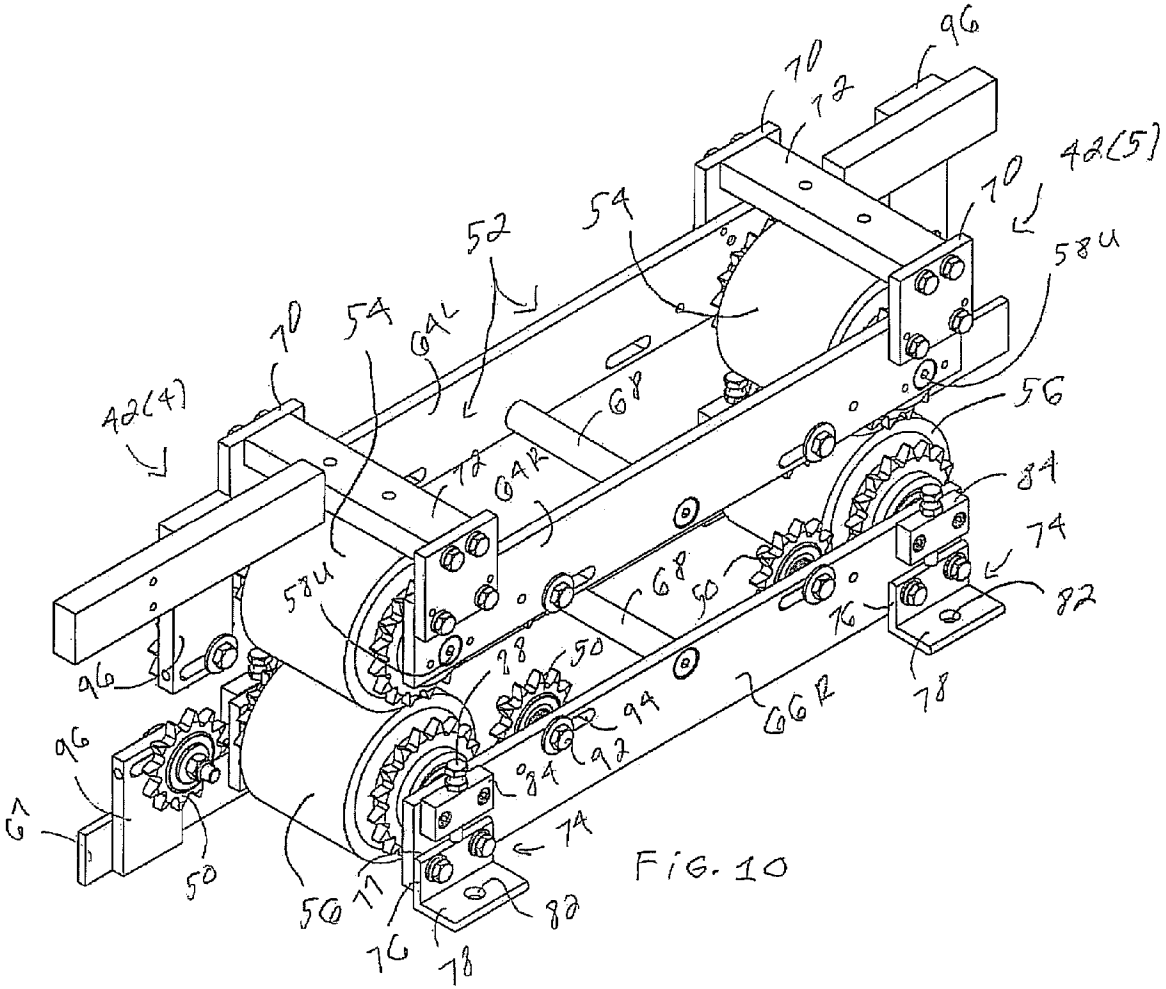
FIG. 10 is an enlarged perspective view illustrating a representative terminal one of the forming machine's drive stations.
Figure 11B:
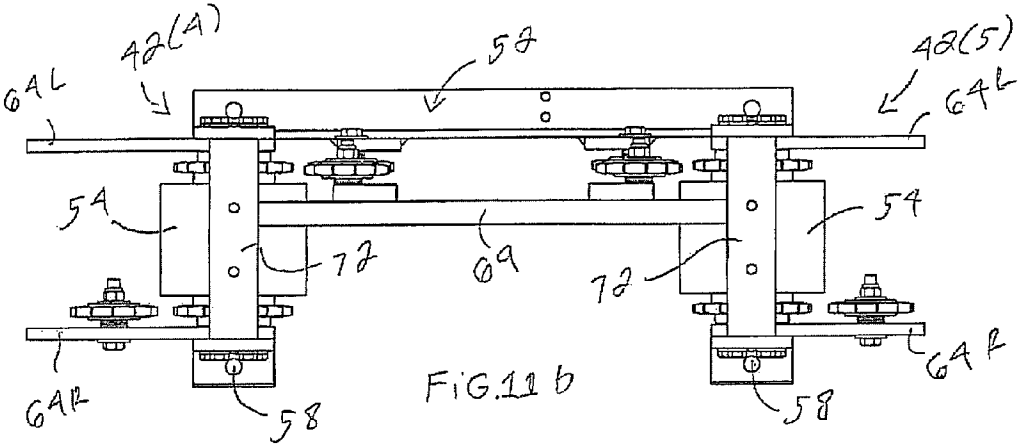
FIG. 11*b* is an enlarged top plan view illustrating the intermediate drive station of FIG. 11*a;*
Figure 11A:
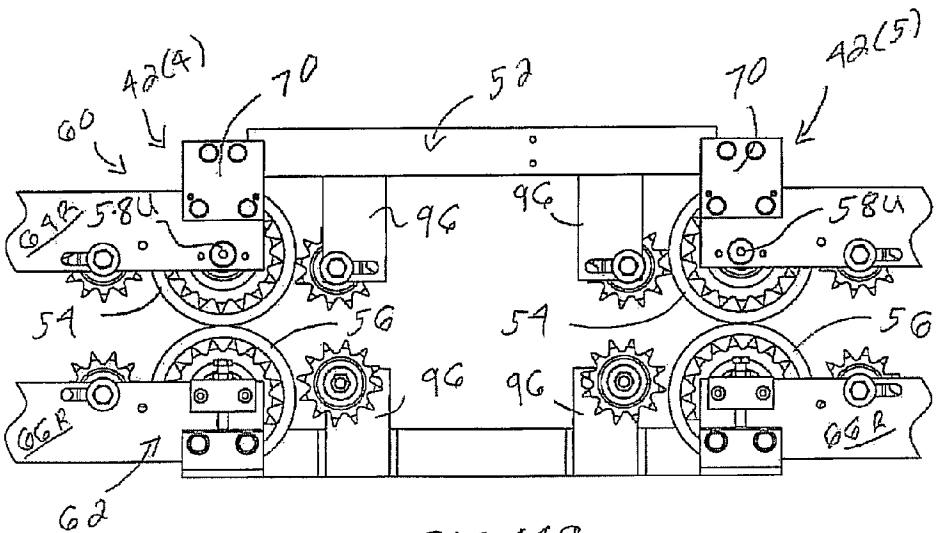
FIG. 11*a* is a right side of view in elevation illustrating a representative intermediate one of the forming machine's drive stations.
Figure 18:
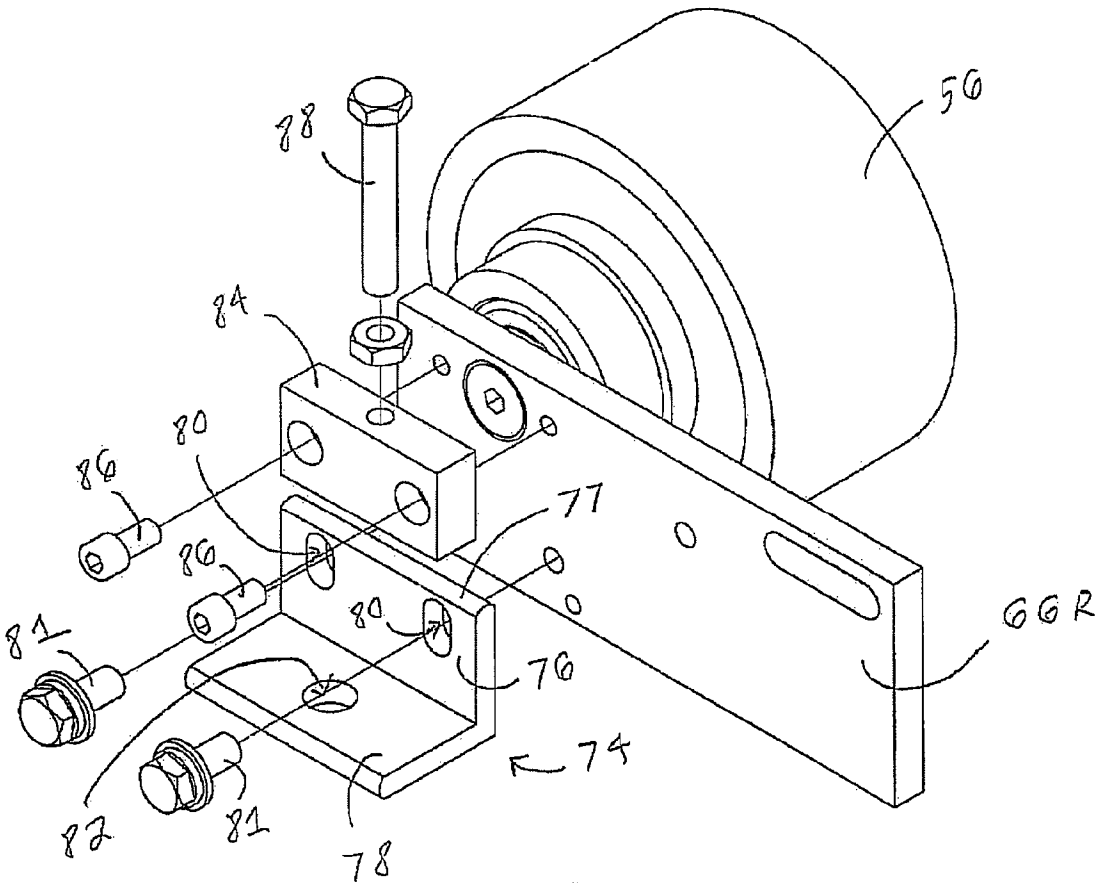
FIG. 18*a* is a partially exploded perspective view showing the attachment of a tooling set's station mount assembly to a support bar segment.
FIG. 18*b* is a perspective view showing the attachment of a tooling set's station mount assembly to a support bar segment.
FIG. 18*c* is a partially exploded perspective view showing the attachment of a tooling set's station mount assembly to a support bar segment.
FIG. 18*d* is a perspective view showing the attachment of a tooling set's station mount assembly to a support bar segment.

A preferred construction for the drive stations, such as representative drive stations 42(4) & 42(5), is shown in FIGS. 10, 11*a* & 11*b*. Each drive station includes a pair of co-acting upper and lower rollers, 54 & 56 respectively, which are journaled for rotation about axles 58. For example, upper axles 58U define axis for upper rollers 54, while the lower axles (hidden) provide axis for lower rollers 56. In these figures it may be seen that each upper roller 54 and each lower roller 56 is a driven roller. The rollers of each upper and lower pair co-act with one another to grip a central portion of the sheet material as it is advanced through the machine in the downstream direction. Each of rollers 54, 56 preferably includes a circumferential layer of polyurethane to assist with gripping the sheet material.

Figure 9A:
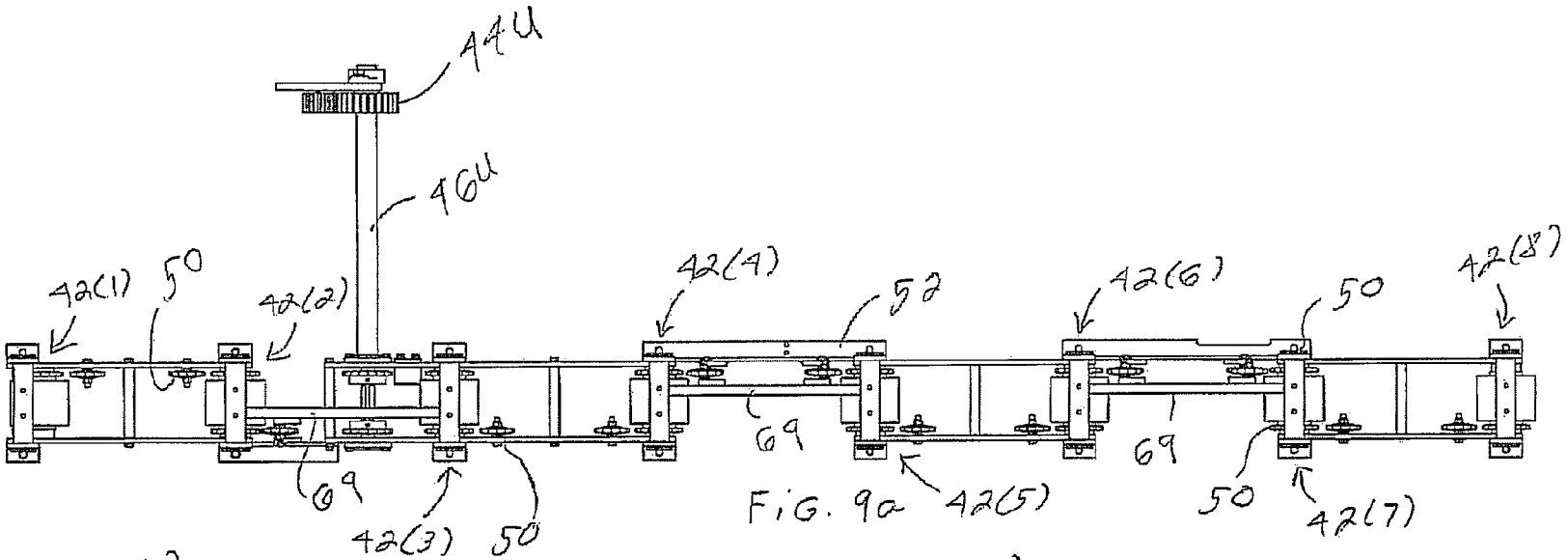
FIG. 9*a* is a top plan view showing the forming machine's drive assembly.
Figure 9B:
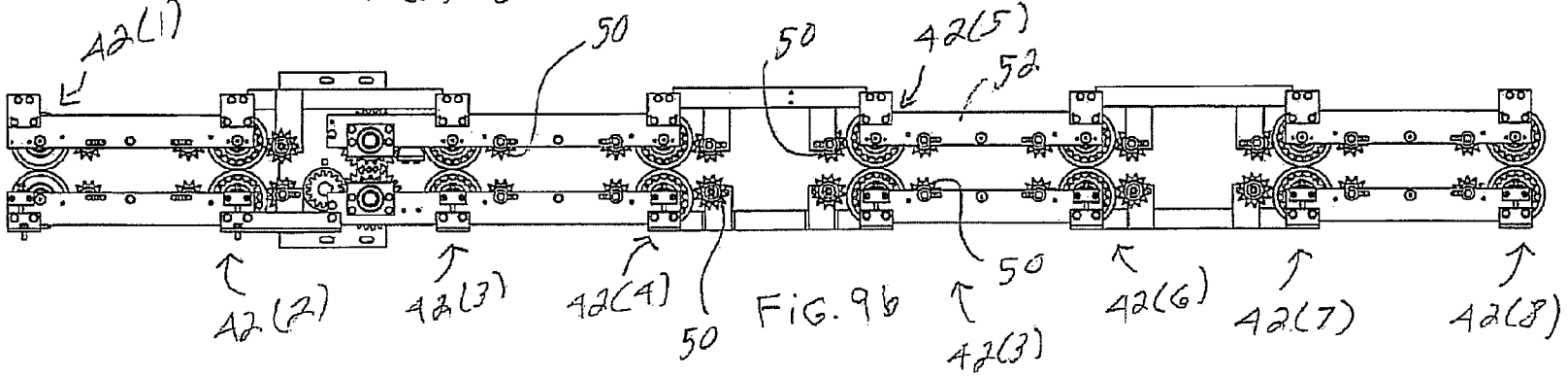
FIG. 9*b* is a right side view in elevation of the drive assembly shown in FIG. 9*a;*

Both driven roller 54 and driven roller 56 are disposed in housings 60 and 62, respectively. Upper housing 60 includes left and right keel rails 64L and 64R, respectively. Similarly, lower housing 62 includes left and right keel rails 66L and 66R, respectively. As perhaps best shown in FIG. 10, these keel rails 64 and 66 extend between longitudinally adjacent ones of the upper and lower rollers within each roller set/pair. Drive roller shafts 68 extend between the left and right keel rails for structural integrity. A pusher bar weldment 69 also extends between every other longitudinally adjacent pair of the pusher bars 72 for added structural integrity. As shown in FIG. 9*a*, these pusher bar weldments 69 are alternately mounted between left and right center offset positions. Fixedly mounted to the end portions of each upper keel rail 64 is a square bracket 70. A top pusher bar 72 is mounted to, and extends transversely between, left and right opposed ones of brackets 70. Each pusher bar 72 is formed to include a plurality of threaded mounting holes so that the upper driven rollers 54 may be adjustably mounted relative to the frame 30. More particularly, and with reference to FIGS. 5 & 10, each pusher bar 72 is adjustably mounted relative to an associated framework bar segment 35 that is welded into the forward face of its associated transverse beam 36.

Figure 12E:
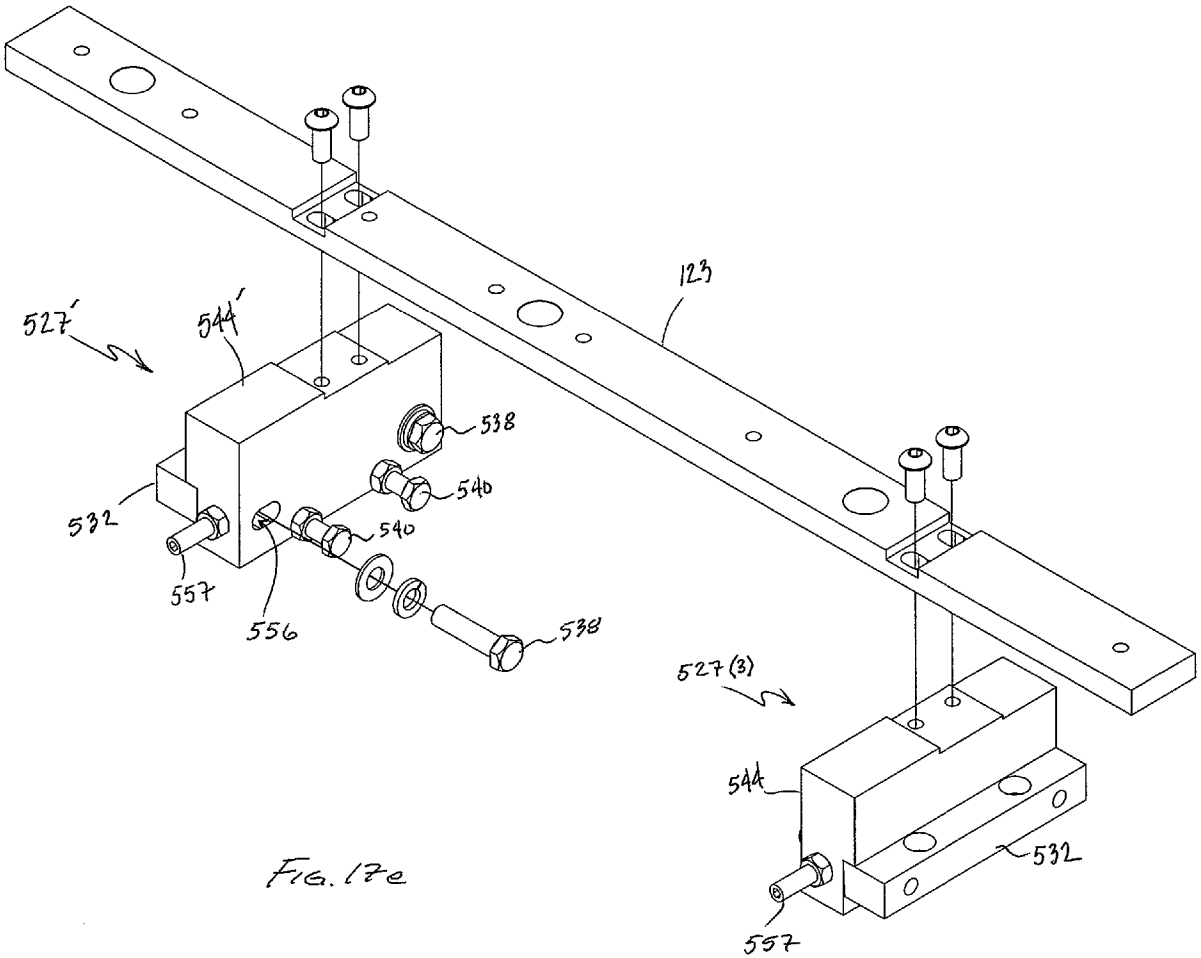
FIG. 12 is an exploded perspective view of a representative footplate construction for the machine's forming rollers.

Each lower housing 62 is fixedly mounted into the machine's framework 30. A spreader mount 67 extends between longitudinally adjacent, lower left keels 66L. As perhaps best shown in FIG. 12, the end portion of each lower keel rail, such as keel rail 66R, includes an L-shaped footplate 74 having an upright portion 76 and a horizontal portion 78. Upright portion 76 includes a pair of slotted holes 80 which are alignable with mounting holes in the keel rail so that the upper portion can be mounted relative to the keel rail via cap screws 81. The lower, horizontal portion 78 includes a screw hole 82 to fixedly mount it to the framework via a screw (not shown). A drive jack block 84 is fixedly mounted to the keel rail 66R via cap screws 86. A tap bolt 88 extends downwardly through drive jack block 84 to contact the ledge 77 of upright portion 76 (see FIG. 10, for example).

It can be appreciated that the above-described construction for the lower housings 62 permits the lower driven rollers to be incrementally positioned at appropriate vertical heights during setup or calibration. More particularly one or more string lines can be attached between fixed points of the frame so that the drive rollers can be adjustably mounted relative thereto. One such string line, for example, is typically strung centrally within the machine so that it extends within an imaginary plane through which the sheet material will travel during use. One approach for suitably positioning the various drive rollers could be as follows. Initially, the height of each lower driven roller 56 could be adjusted relative to the frame 30 (or an associated string line attached to the frame) by virtue of the slotted channels 80 within each upright portion 76 and their associated cap screws 81. Then, each lower driven roller could be adjusted to a desired height via tap bolt 88 so that the outer polyurethane surface of each driven roller touches the centrally located string line, eliminating the need for shims. Thereafter, upper, driven roller 54 can be lowered into place until its outer polyurethane surface contacts its associated lower roller 56. Typically an additional ¾ turn of pressure is applied to the upper driven rollers in order to provide a preload between the upper and lower driven rollers.

As also shown in various ones of the figures, each of the smaller sprockets 50 is movably adjusted toward or away from its associated enlarged roller sprocket 51. This allows for suitable tensioning of the chain drive system as its chains (not shown) impart rotational movement to their associated upper or lower rollers. To accomplish this tensioning, each smaller sprocket 50 can be mounted on an associated keel 64 or 66 via a cap bolt 92 which extends through a slotted channel 94 formed through the keel. Sprockets may also be similarly mounted at suitable locations to the lower spreader mounts 67 and the upper pusher bar weldments 69 via associated lower and upper sprocket mounting bracket weldments 96.

With reference again to FIGS. 7 and 9*c*, power to the drive assembly is provided by the electromechanical power supply which imparts rotational movement to upper and lower main drive shafts 46U and 46L, respectively. More particularly, a spur gear 43 that is coupled to the power supply cooperates with the relatively enlarged lower spur gear 44L associated with lower main drive shaft 46L. Spur gear 44L itself cooperates with upper spur gear 44U associated with upper main drive shaft 46U. Each of spur gears 43,44L and 44U is rotatably mounted on a main bearing plate 41 which attaches to framework 30. Thus, rotational movement of smaller spur gear 43 imparts rotational movement to each of the main drive shafts. Since these drive shafts are mechanically coupled to the various upper and lower drive rollers via chains and sprockets, rotational movement of the various rollers within the drive assembly is achieved, all as is understood in the art.

Figure 3A:
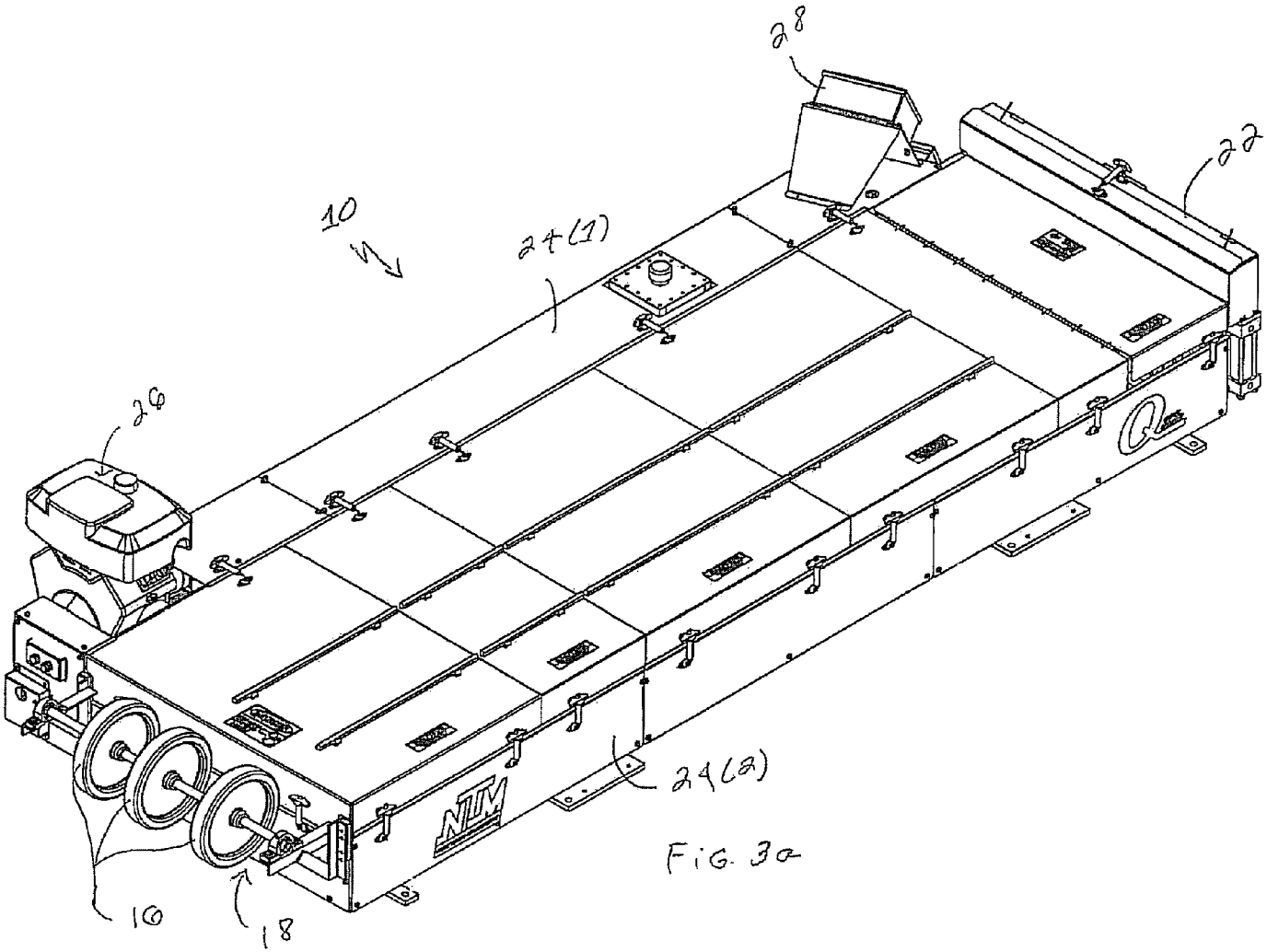
FIG. 3*a* is a front perspective view of the material forming machine, according to the exemplary embodiment, without the optional overhead reel rack.
Figure 3B:
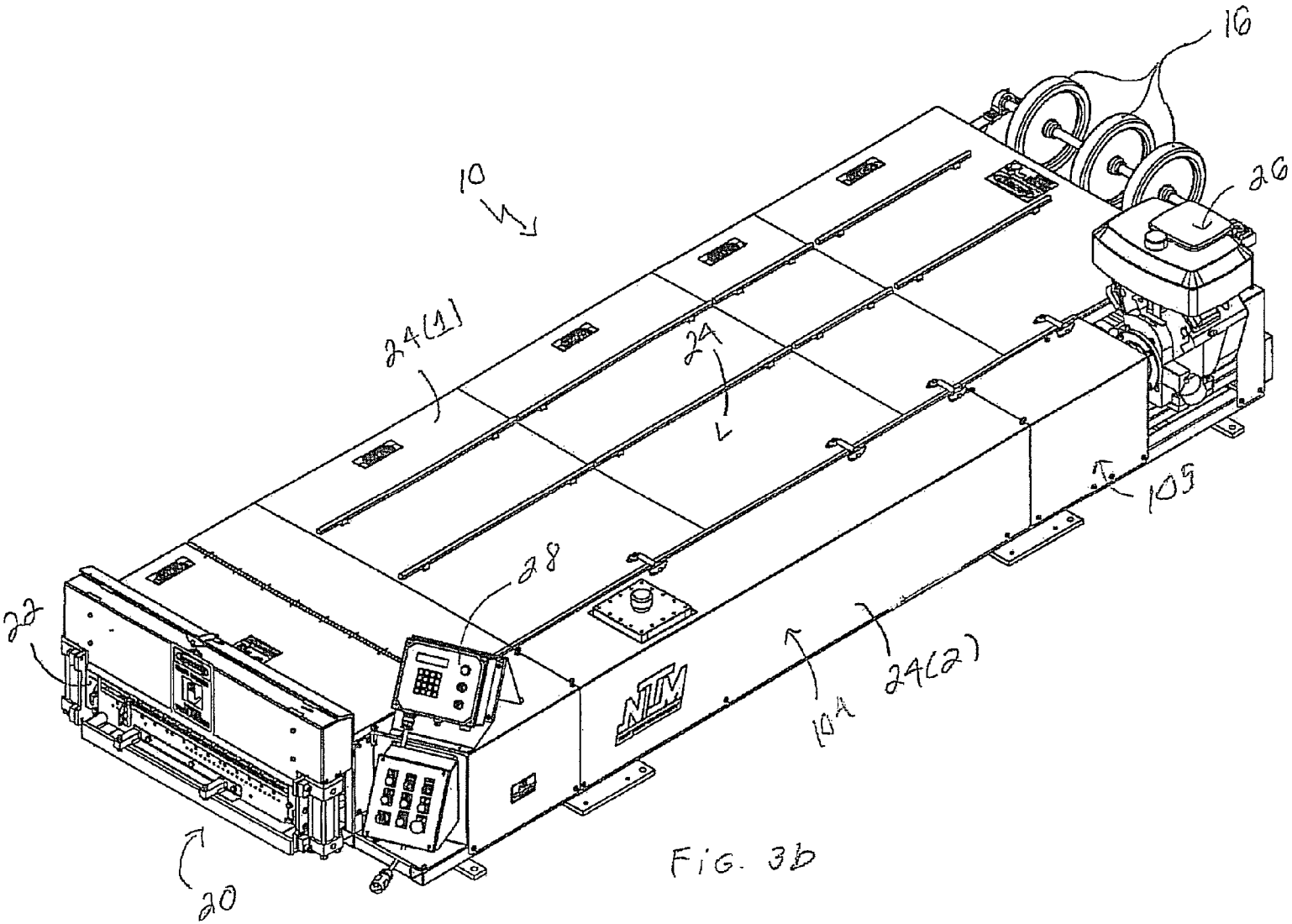
FIG. 3*b* is a rear perspective view of the material forming machine according to the exemplary embodiment.
Figure 4A:
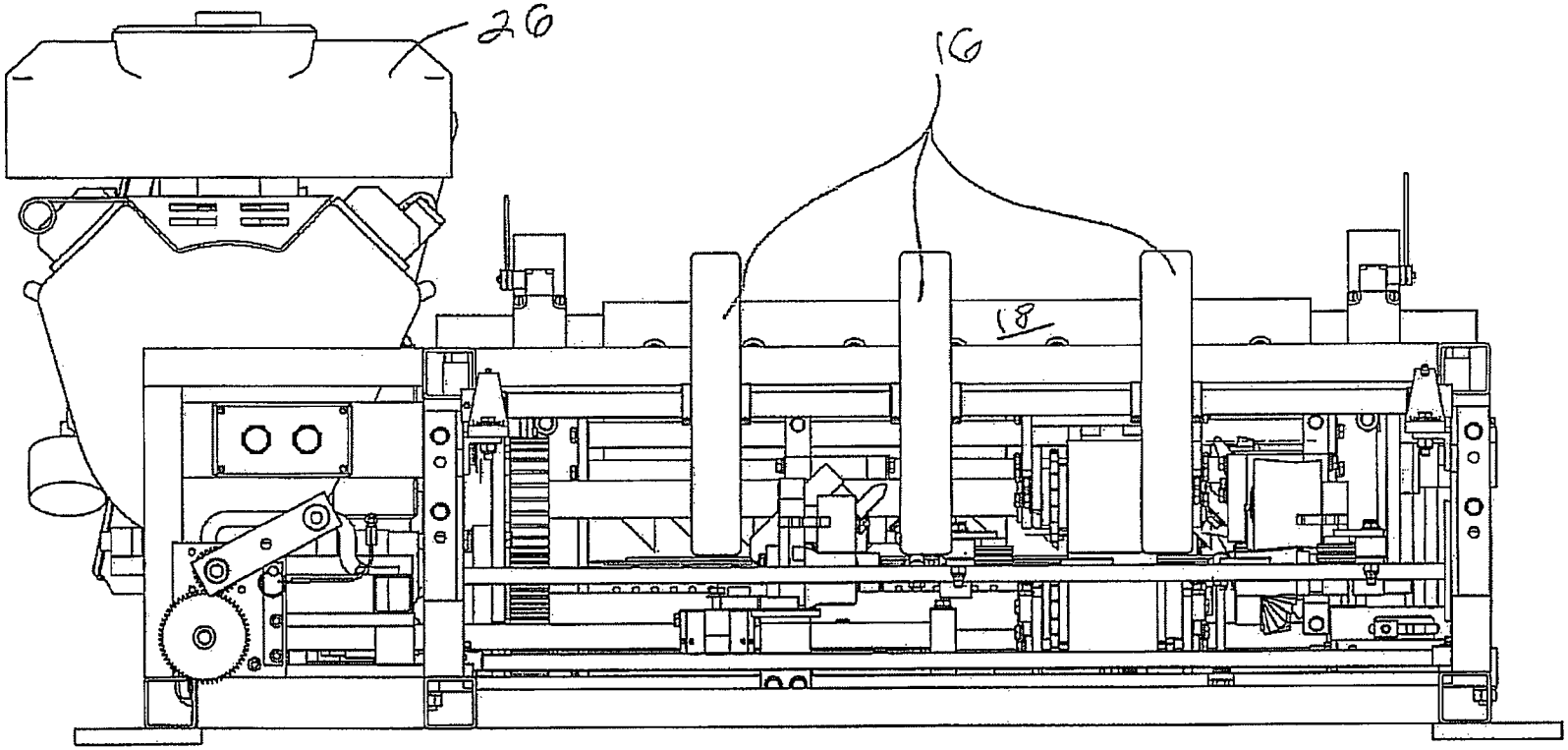
FIG. 4*a* is an enlarged front view in elevation showing the upstream, or entry, end to the material forming machine.
Figure 4B:
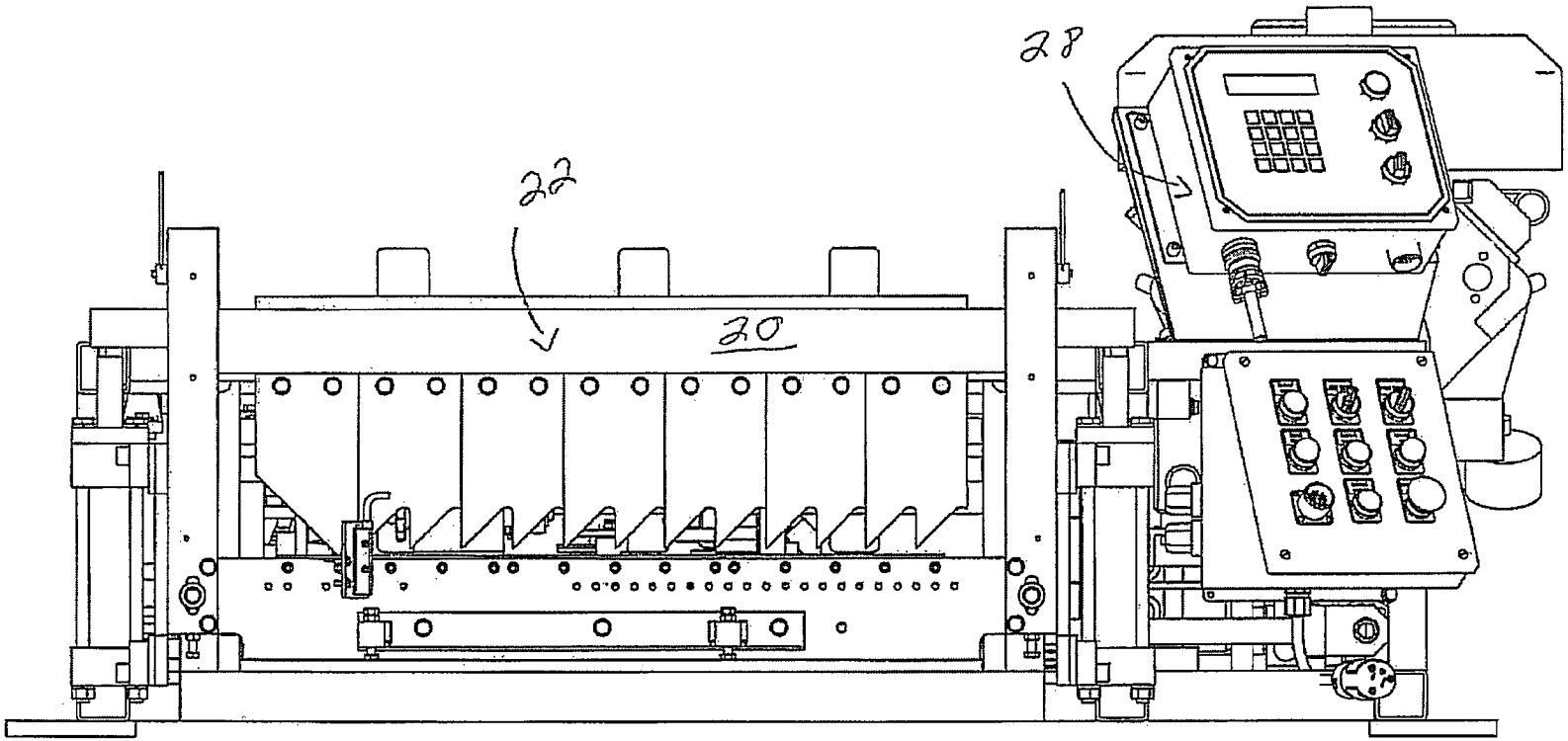
FIG. 4*b* is an enlarged rear (downstream end) view in elevation showing the downstream, or exit, end of the material forming machine.
Figure 13:
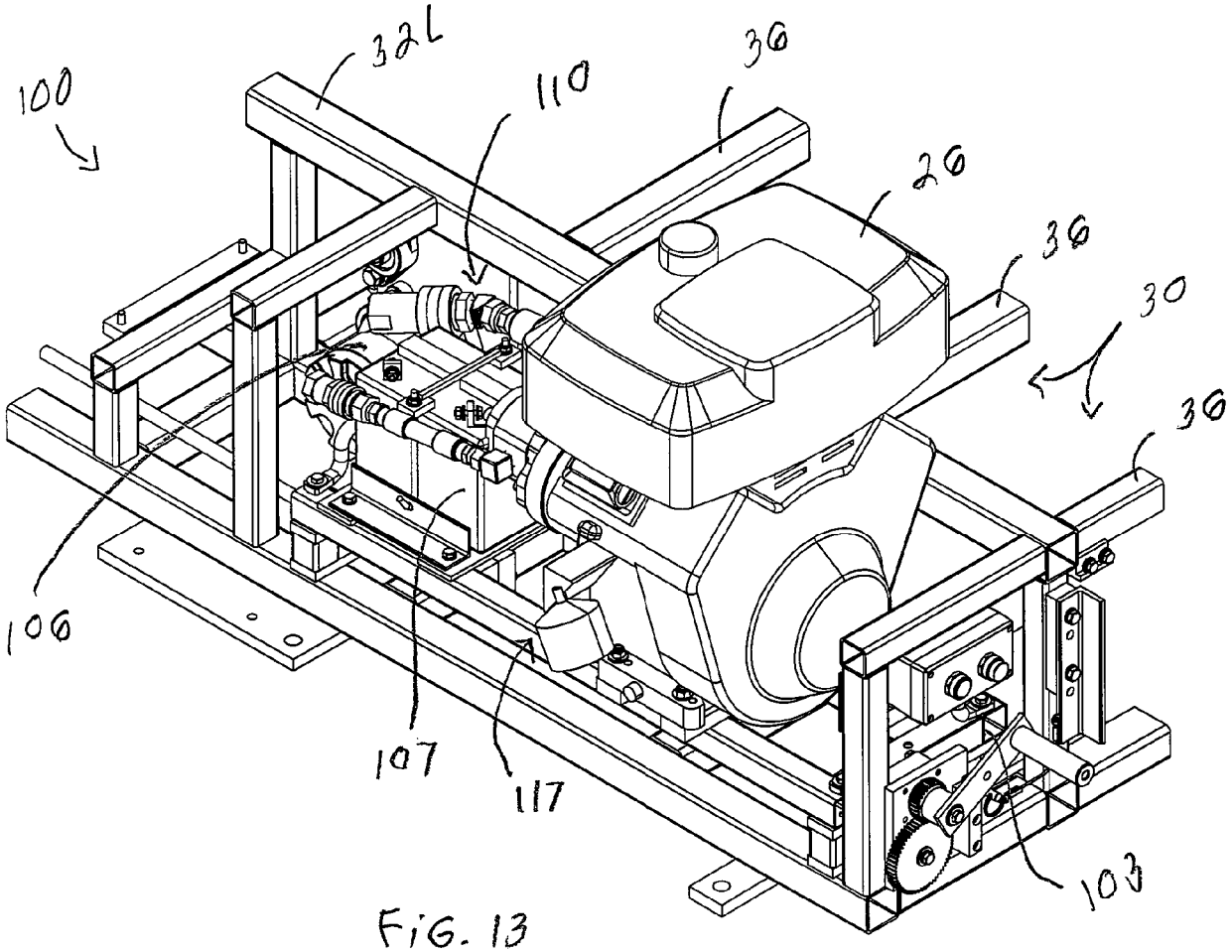
FIG. 13 is an enlarged perspective view of a representative power source for the forming machine.
Figure 19:
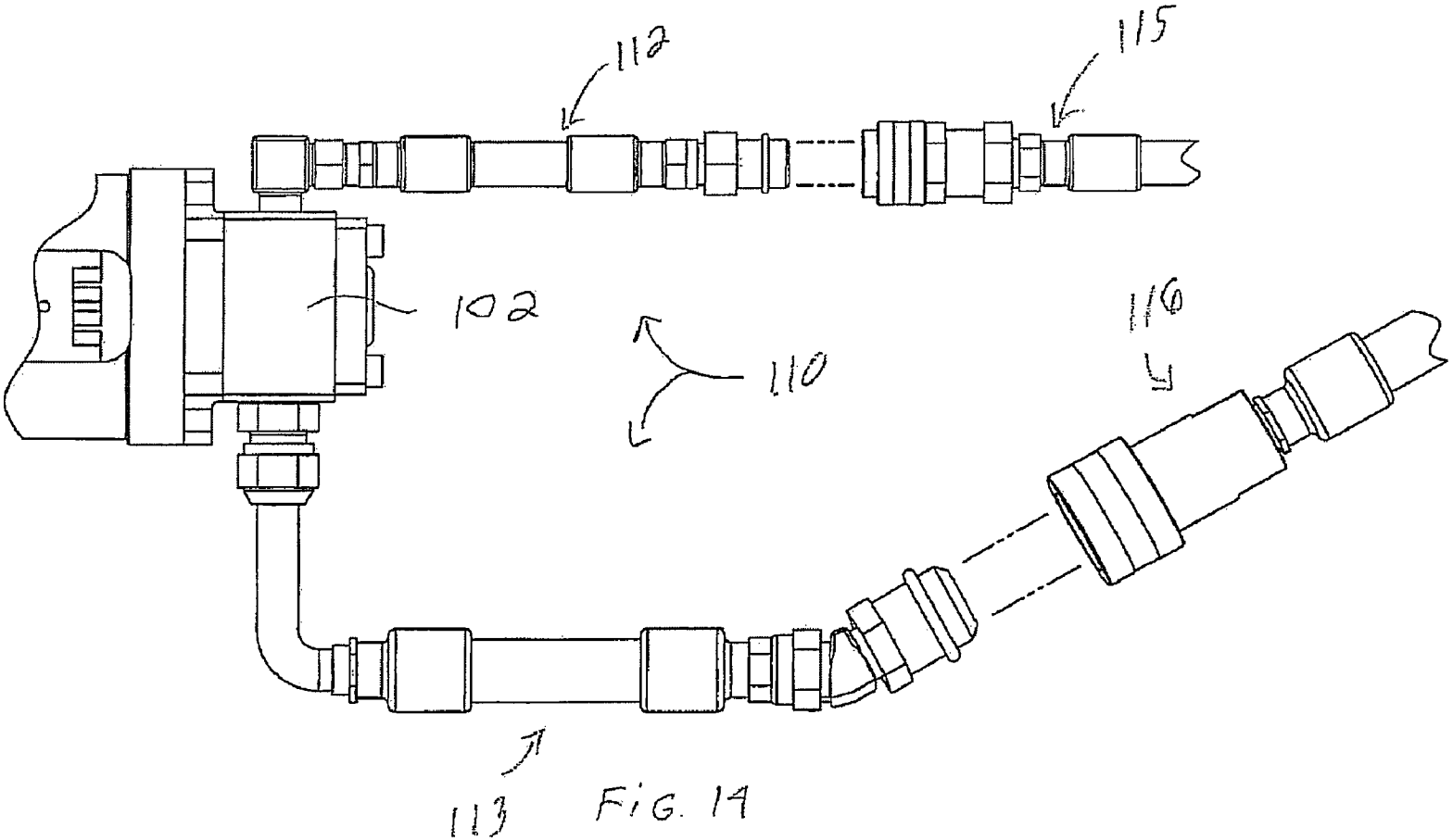
FIG. 19*a* is perspective view showing the underside of a support bar segment and two of its associated feet.
FIG. 19*b* is perspective view showing the underside of a support bar segment and two of its associated feet according to the alternative construction shown in FIGS. 17*c* and 17*d;*
Figure 15:
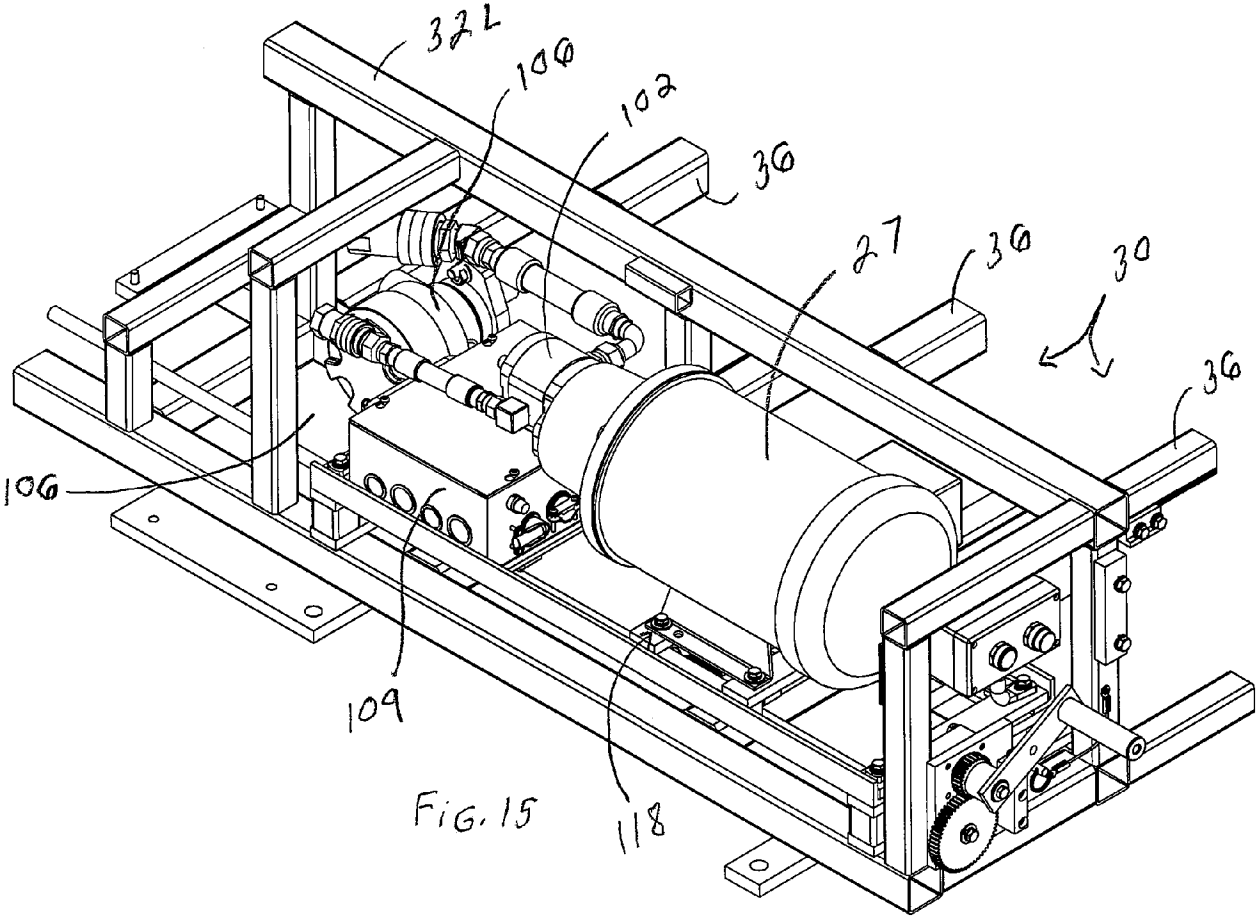
FIG. 15 is an enlarged perspective view of another representative power source for the forming machine.

Reference is now made to FIGS. 3*b* and 13 to briefly describe one exemplary embodiment of the forming machine's electromechanical power source, generally denoted as 100 in FIG. 13. Power source 100, as mentioned above, can include a gasoline engine 26 as shown in various ones of the figures, or an electric motor 27 as shown in FIG. 15. On and off switches 103 are provided on an upstream end of the machine to actuate the electromechanical power supply 100. Control for the various other machine functions is handled by control panel 28 (FIGS. 1-3*b*), as known in the art. A battery 107 provides an electric start for gasoline engine 26, while an electrical control box 109 houses motor contacts for turning on and operating electric motor 27. Mounted to the output of either gasoline engine 26 or electric motor 27 is an oil pump 102 which pumps the oil from a hydraulic tank through the hydraulic system to actuate the various moving components of the machinery. To this end, the hydraulic system may include flow control valves, directional valves, etc. as would be well understood by the ordinarily skilled artisan in this field. The hydraulic tank (FIG. 5) is housed within the machine between the engine 26, for example, and the control panel 28 (FIG. 3*b*) and accessible via removing portions 104, 105 of the machine's covering. An hydraulic motor 106 is provided which is mechanically coupled to spur gear 43 (FIG. 9*c*). During operation, then, the hydraulic lines direct hydraulic fluid as needed through hydraulic motor 106 to cause rotational movement of the interlocked spur gears, and through the mechanical coupling described above, impart rotary movement to the various rollers of the drive assembly. Also as needed, the electromechanical power supply 100 directs fluid through the hydraulic lines to the cylinders which actuate the shear assembly 22. When no demand is on the system, hydraulic lines circulate the fluid back through the hydraulic tank.

As shown in FIG. 14, a quick disconnect assembly 110 includes left and right hoses 112 and 113, respectively, to permit convenient and quick interchange between a gasoline engine and an electric motor so that they can be easily coupled to or decoupled from left and right hydraulic line end portions 115 and 116, respectively. To also facilitate a quick interchange, respective support frameworks 117 and 118 can be provided for the gasoline engine 26 or the electric motor 27 to permit them to be removably mountable relative to the machine's main framework 30. It should be noted that various hydraulic lines, wiring and other necessary components for the electromechanical power source 100 need not be shown in the various figures for the ordinarily skilled artisan to fully understand their use and function.

Reference is now made to FIGS. 16*a*-22 to describe the mounting of the tooling within forming machine 10. The tooling which is used to progressively bend the sheet-like material into a desired profile includes a plurality of tooling sets which are mounted on the left and right sides of the machine in opposed fashion, as known in the art. For purposes of this description a "tooling set" or "toolset" refers to a portion of the machines overall tooling. Thus, the forming machine can be considered as having tooling on the left side of the machine (the left tooling) and tooling on the right side of the machine (the right tooling). Preferably, each of the right and left tooling is comprised of a plurality of tooling sets (each also referred to as a tooling assembly or a tooling sub-assembly). Each tooling set can be considered as including forming elements/rollers mounted to a tooling rail or a tooling rail segment. Various tooling sets are shown in previous figures, for example, FIGS. 5-8. More particularly, a plurality of left tooling sets are disposed on the left side of the drive assembly, and a plurality of right tooling sets are mounted on the right side of the drive assembly. The tooling sets include suitably arranged forming rollers which need to be arranged in the machine in a particular sequence in order to progressively bend the sheet material into the desired profile, again as known in the art. However, as stated above in the background section, known forming machine constructions suffer from the fact that it can be very tedious and time-consuming to appropriately position, reposition and interchange these tooling sets within the machine during use, resulting in inefficient downtime. The present invention has a particular object of addressing this deficiency.

Figure 16A:
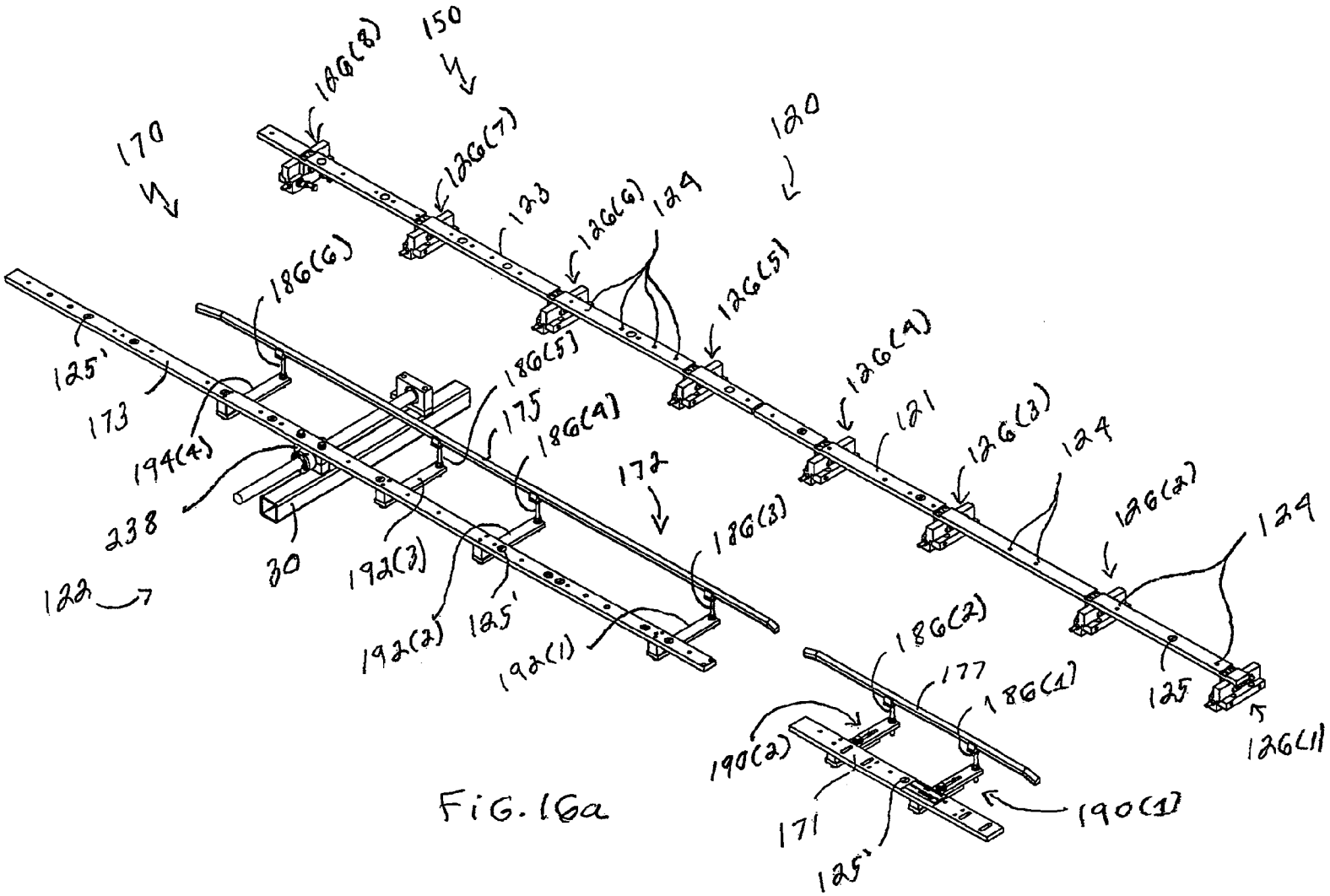
FIG. 16*a* is a perspective view of the left and right support assemblies for mounting the various tooling rail assemblies (each interchangeably referred to as a "tooling set" or "toolset") to be used with the forming machine.

Initial reference is made to FIG. 16*a* which illustrates the forming machine's right support bar construction 120 (also referred to as a rail assembly or support rail) which supports the plurality of right tooling sets, and the left support bar construction 122 which supportably mounts the left tooling sets. Right support bar assembly 120 comprises two bar segments 121 and 123 of approximately equal length. Bar segments 121 and 123 have a plurality of mounting holes, generally 124 formed through them for removably mounting the tooling sets thereon. As such, they are sometimes also referred to as mounting rails. A plurality of longitudinally spaced apart feet, generally 126(1)-126(8), interface the tooling support bars 121 and 123 to the forming machine's framework 30. Together, the right tooling bar 120 (including bar segments 121 and 123) along with feet 126(1)-126(8) comprise a tooling support assembly 150.

Figure 17A:
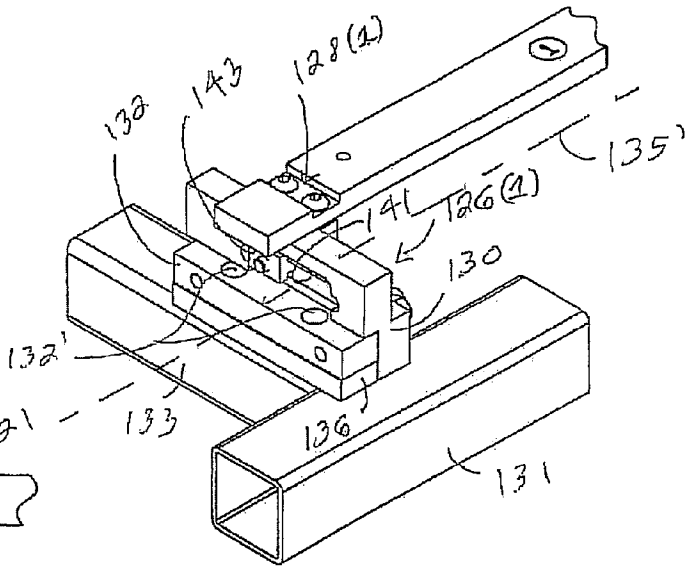
FIG. 17*a* is a perspective view illustrating a representative foot construction for mounting a support bar segment to the framework of the forming machine.

As perhaps best appreciated with reference to FIGS. 16*a* and 17*a*, each of bars 121 and 123 includes a plurality of transverse channels, such as channel 128(1) associated with upstream bar 121. Each channel 128 includes a pair of through holes which receive mounting screws for mounting the bar to its associated ones of feet 126, as best illustrated in FIG. 17*a*.

A preferred procedure for mounting the support bars which support the tooling sets on the right side of the machine will now be described with reference to FIGS. 17*a*-19*a*. This procedure is helpful in ensuring that, when the various tooling sets are placed on their associated support bars, they are level and properly located. As discussed in the background section, past approaches for properly positioning the tooling sets have suffered from being very tedious, requiring multiple tape measuring steps and incremental adjustments, which are necessitated due to the fact that various components within the machine are not machined to suitable tolerances. It, thus, becomes necessary to compensate for the variances during calibration. Past approaches are complicated and time consuming in the way this is achieved and are susceptible to relatively frequent incremental adjustments to return various components to their properly aligned positions during changeovers, or due to gradual displacement during use. The present invention, however, overcomes this by compensating for these tolerances upfront so that the machine can be initially calibrated in a relatively quick manner so that an operator can be confident that few or no adjustments will later be needed to ensure proper operation.

Figure 17B:
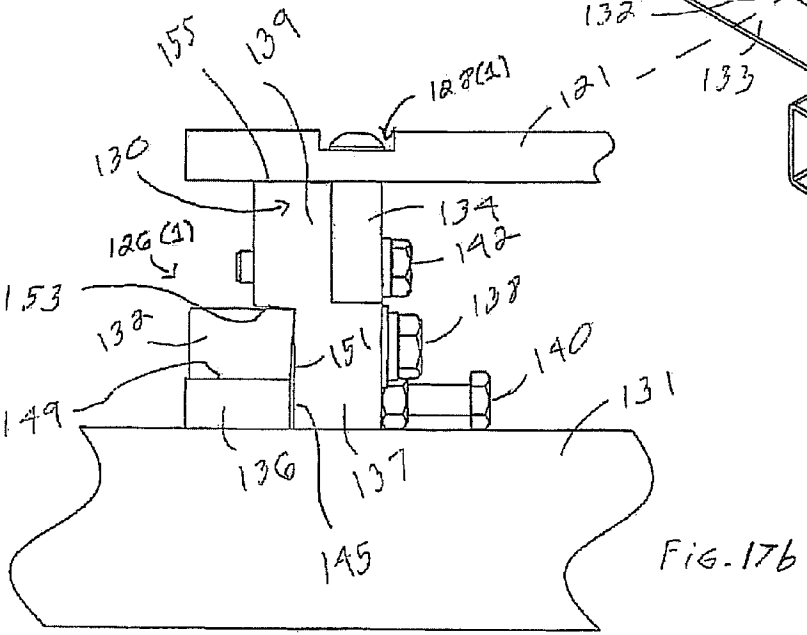
FIG. 17*b* is a right side view in elevation of the foot construction shown in FIG. 17*a;*
Figure 19A:
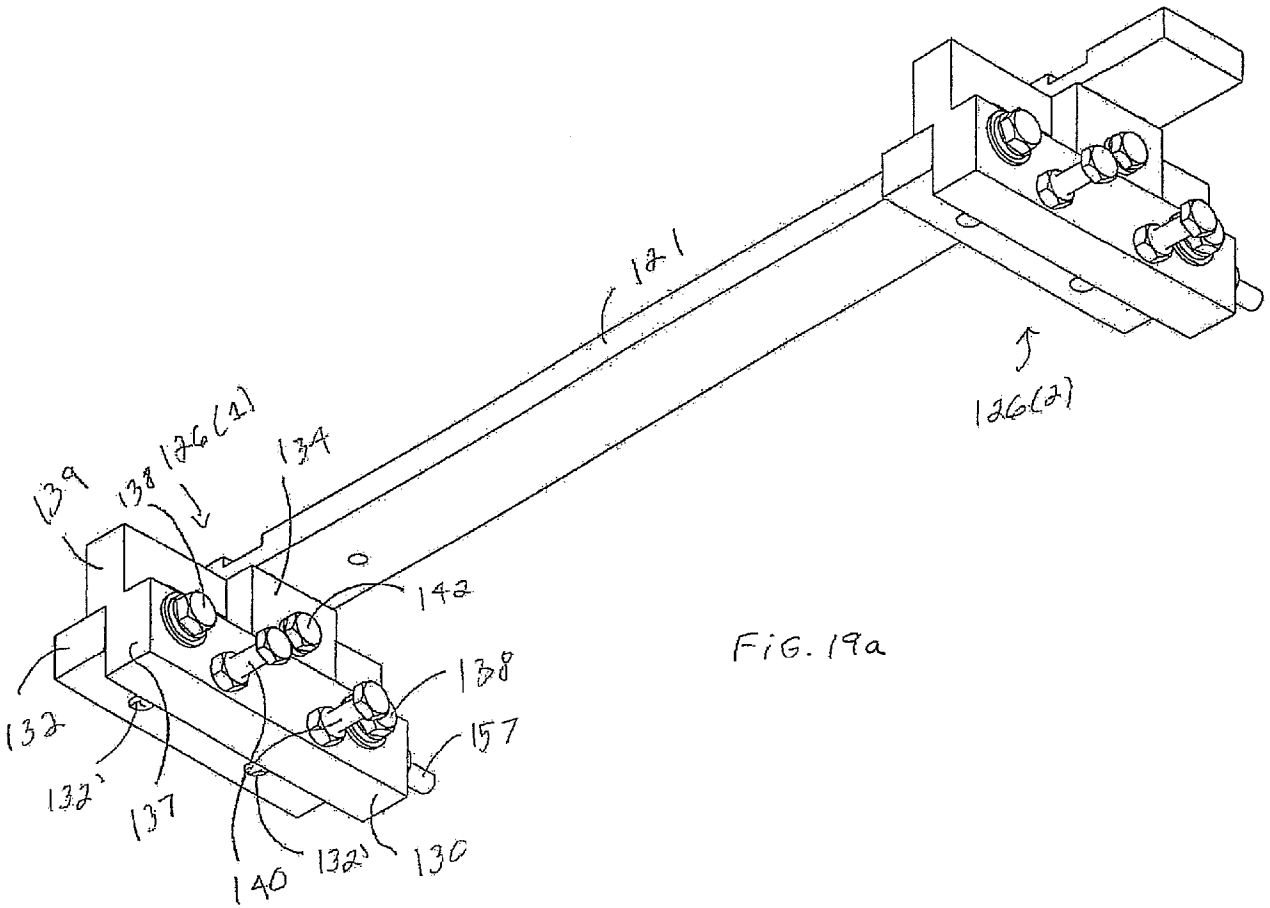
Figure 19B:
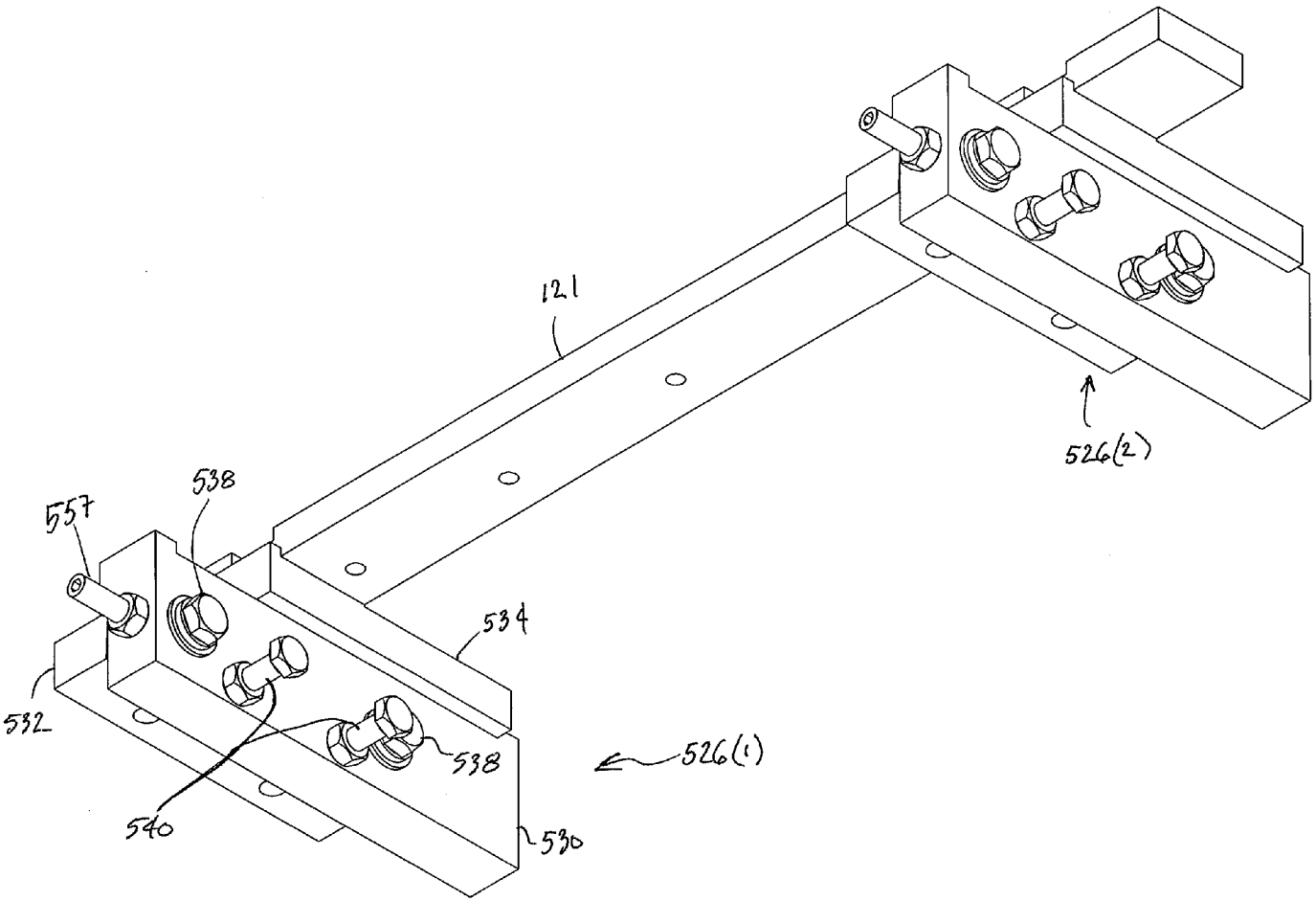

Thus, the goal of the procedure is to ensure that each of the support bar segments 121 and 123 is appropriately mounted relative to the machine's framework during an initial calibration sequence to avoid the need for future adjustment. As noted above, there are a plurality of feet 126 which interface the support bar segments (or bars) 121 and 123 to the framework. A representative foot assembly (or mounting block assembly) 126(1) is shown in FIGS. 17*a* and 17*b*, and an adjacent downstream foot 126(2) is also shown in FIG. 19*a*. Foot assembly 126(1) includes a plurality of components, namely, a slide block 130, a slide block mount 132, and a slide block pin holder (or tie block) 134 which interfaces guide bar segment 121 to slide block 130. A rectangular stock bar (or mounting pad) 136 is welded to longitudinally extending lower frame tube 131 and transversely extending lower frame tube 133. A string line 135, as representatively shown in phantom, can be strung to extend along the right side of the machine between upstream and downstream vertical frame tubes. Preferably, a key stock is welded to an upstream end of one of the frame's vertical tubes, as well as a downstream one so that the string line extends the entire length of the machine. These vertical tubes may be seen in several earlier figures. This string line, then, defines an initial reference plane from which many of the machine adjustments can be made.

Before making extensive adjustments, however, the various feet, such as foot 126(1), may be at least partially assembled. More particularly, slide block mount 132 is fastened to stock bar 136 via bolts (not shown) which extend through counter sunk bores 132' (FIG. 17*a*) to engage the upper surface of stock bar 136. The bolts extend through cylindrical shims (not shown) which may be sandwiched between mount 132 and bar 136. Adjustment of the inboard and outboard bolts, thus, allows the upper surface of the slide block mount 132 to be leveled horizontally, and inboard and outboard string lines, such as a string line 135' may be used for this purpose. Slide block 130 may then be situated and mounted to both lower stock bar 136 and slide block mount 132. Cap screws 138 fasten the slide block 130 to slide block mount 132, while tap bolts 140 adjustably mount the lower leg 137 of slide block 130 to stock bar 136. Slide block pin holder 134 is mounted to the upper leg 139 of slide block 130 via cap screw 142. Block 134 is slidably mounted to the slide block's upper leg 139. To this end, upper leg 139 is formed to include a slideway 141, and block 134 is movably disposed relative to the slideway via a tee nut 143.

Initially, the slide block 130 may be adjusted so that either its outward face or inward face is positioned at a desired transverse spacing relative to the string line 135'. This can be accomplished by adjusting the slide block's set screw 157. This set screw 157 is received in a tapped hole formed through the inner face of the slide mount 130. The tapped hole is aligned with the centerline of inboard cap screw 138 so that the end of the cap screw 157 makes contact with the shank of cap screw 138. As set screw 157 is rotated clockwise it will cause the slide block 130 to move inwardly, and when it is rotated counterclockwise, it will allow the slide block 130 to be moved outwardly. The through holes form in slide block 130 for receiving screws 138 are sized to allow slide block 130 to move relative to slide block mount 132. Alternatively, slide block mount 130 may include slots. Other than welded stock bar 136, the components of the foot are machined to desired tolerances. Since the welded stock bar 136 is not machined to tolerances and can have a slightly canted surface, such as represented vertical surface 145. It is, thus, important to situate the slide block mount 132 in a horizontally level position thereon via the shims and adjustment screws. Otherwise, a slight misplacement of one foot could translate into much larger deviations for other feet by virtue of the guide bar segments interconnecting them.

Once the slide block mount 132 has been horizontally leveled, the slide block can be suitably positioned relative to it. Slide block mount 132, itself, is machined to tolerance and is intentionally machined to have a slight relief taper on its downstream facing surface 151, and the same holds true with a lower surface 153 associated with the slide block's upper leg 139. Otherwise, the various faces of the slide block 130 are machined square. As such, once the slide block 130 is mounted to slide block mount 132, the tap bolts 140 can be adjusted to selectively engage stock bar 136 so that slide block 130 incrementally pivots. This allows the slide block's upper surface 155 to be adjusted to the appropriate level position. More particularly, the adjustment bolts 140 and their associated jam nuts extend through the lower leg 137 of slide block 130 to confront stock bar 136 such that their adjustment can compensate for any machining or welding discrepancies amongst stock bar 136 and frame tubes 131, 133. Slide Block 130 pivots about a pivot axis. In this case the pivot axis is defined by the intersection of surfaces 151 and 153 of lower leg 137, which form a corner (or vertex) having an obtuse angle. The corner of lower leg 137 rests on an edge of mount 132 as perhaps best shown in FIG. 17*b*. While the interface between slide block 130 and mount 132 is shown here in the form of a corner, other pivoting arrangements may be employed. For instance the interface could be mating curved surfaces wherein the pivot axis would be along an imaginary center point of the curves. A very small gap is intended to be present between the upper surface 155 of the slide block's leg 139 and the lower surface of support bar segment 121. This allows segment 121 to rest on the upper surface of the slide block pin holder 134, and not slide block 130. This eliminates any unwanted deflections of support bar segment 121 from occurring as the screw within channel 128(1) is tightened. Such deflections would otherwise be caused by segment 121 contacting leg 139 were a gap not present.

At this point, the slide block pin holder 134 can be moved to either the inboard or outboard position depending on the profile desired. In fact, the slideway 141 associated with slide block 130 is machined so that movement of the tee nut 143 to one of the inboard or outboard extremities will appropriately position the tooling sets at the appropriate inboard or outboard location once mounted. That is, all an operator has to do is ensure that slide block pin holder 134 is placed in either the extreme inboard or extreme outboard location within slideway 141 to ensure proper tooling set position, thus eliminating any guesswork. Once each of the support bar's feet is suitably calibrated, as described, one can be confident that they are each properly placed and leveled within the machine relative to one another so that there are no undesirable offsets between them with respect to either an inboard/outboard location, horizontal leveling or vertical leveling. The various support bar segments 121 and 123 are then attached via mounting screws, such as 128(1), at which point they are ready to receive the toolsets. Once the toolsets are mounted for a desired profile, the operator need not make any further adjustment to the right side of the machine to ensure that the toolsets are properly positioned. Thereafter, the only subsequent adjustments to the right side tooling sets that the operator may need to make entail moving the rails in either the extreme inboard or outboard position relative via the slideways depending on the tooling set requirements.

Figure 16B:
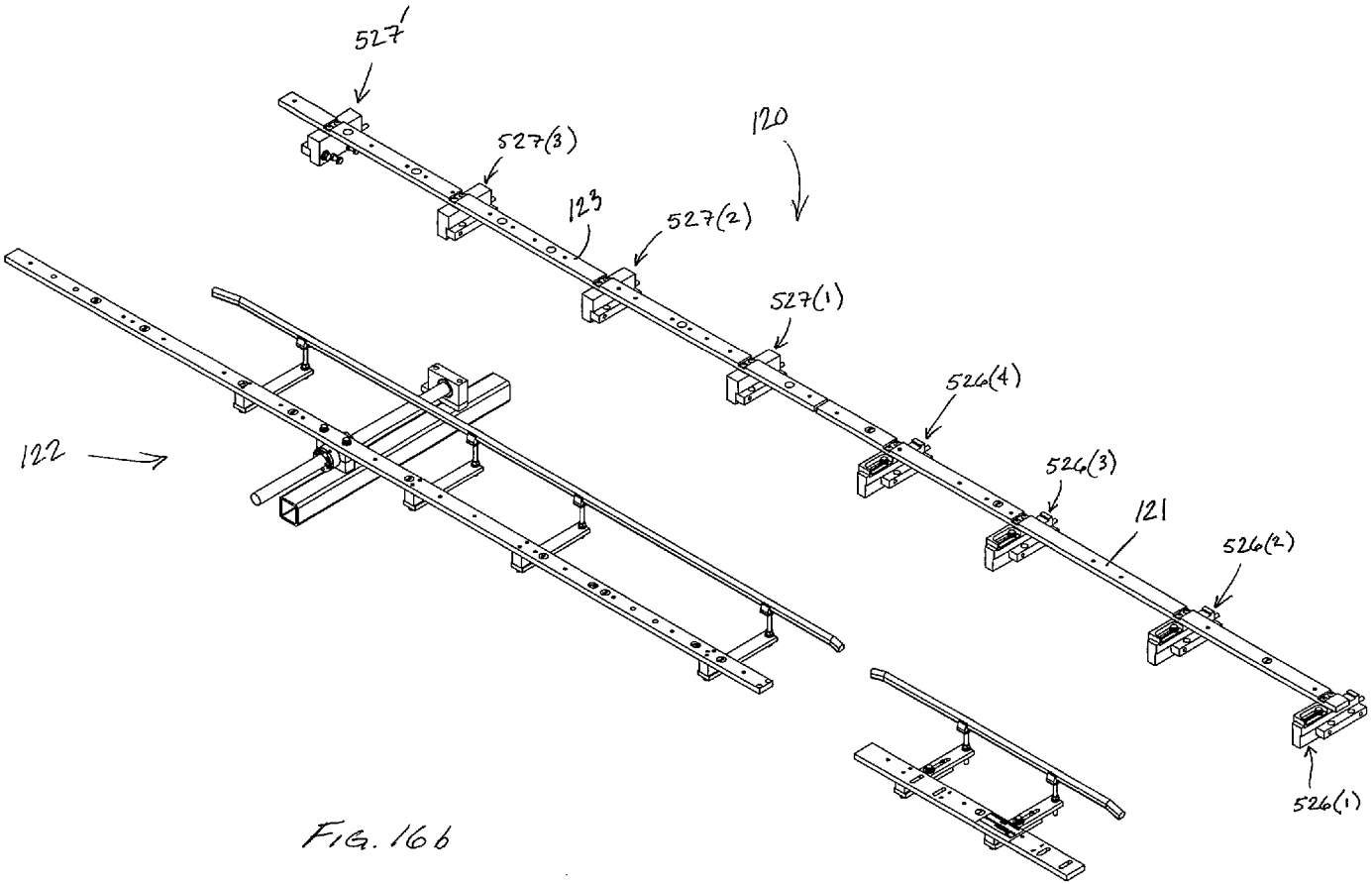
FIG. 16*b* is a perspective view of left and right support assemblies including alternative foot constructions.
Figure 17C:
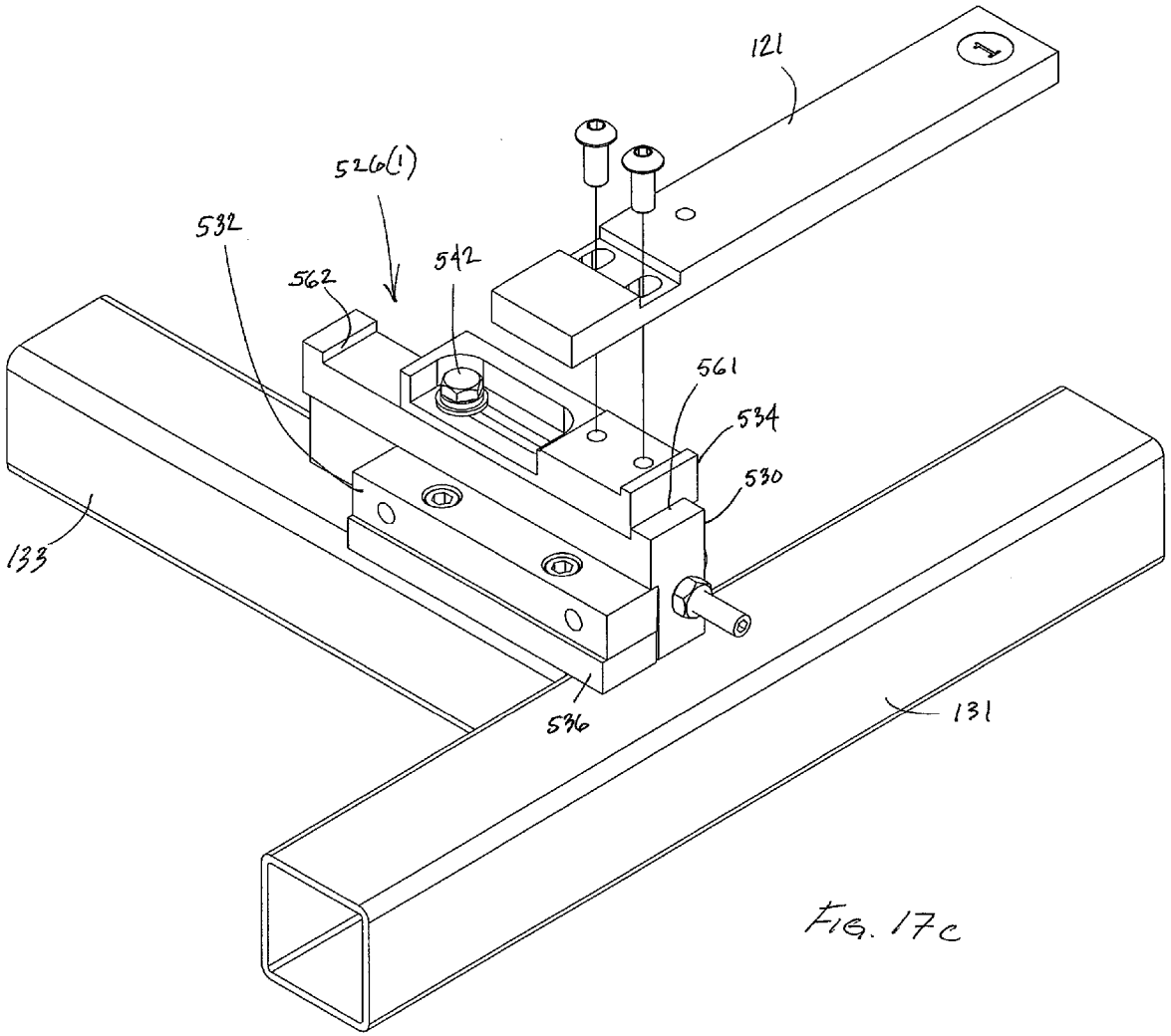
FIG. 17*c* is a partially exploded perspective view illustrating an alternative foot construction for mounting an upstream support bar segment to the framework of the forming machine.
Figure 17D:
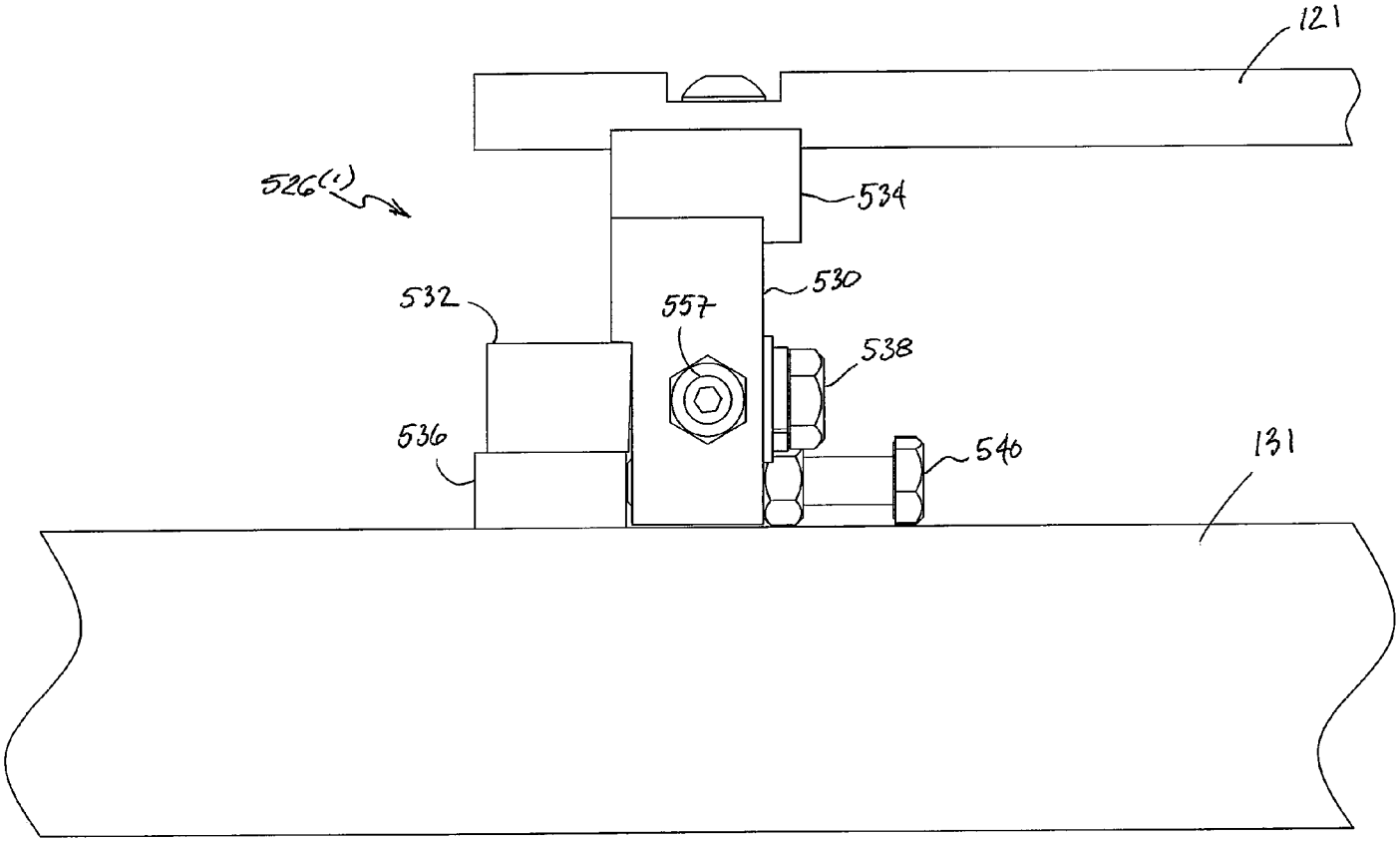
FIG. 17*d* is a right side view in elevation of the alternate foot construction shown in FIG. 17*c;*

FIG. 16*b* illustrates the forming machine's right support bar construction 120 showing an alternative construction for the foot assemblies 526(1)-526(4) and 527(1)-527(3). With reference to FIGS. 17*c* and 17*d* it can be appreciated that the foot or mounting block assemblies 526 are similar to mounting block assemblies 126. However, tie block 534 includes the slideway instead of slide block 530. Slide block 534 also includes opposed limit stops 561 and 562 to facilitate convenient accurate adjustment between profile configurations.

FIG. 17*e* illustrates the construction of downstream foot assemblies 527(3) and 527'. Downstream foot assemblies 527 are similar to foot assemblies 526 except that they do not include a tie block. Instead mounting rail 123 fastens directly to slide block 544. The downstream foot assemblies provide for the same pivot adjustment and lateral fine tuning along slide block 532 as do foot assemblies 526. It can be appreciated from the figure that foot assembly 527' is a mirror image of 527(1)-527(3). It can also be seen with respect to foot assembly 527' that the slide blocks may include slots 556 to facilitate the lateral fine tuning that is accomplished by turning set screw 557. FIGS. 18*c*, 18*d*, 19*b*, 20*c*, and 20*d* are similar to FIGS. 18*a*, 18*b*, 19*a*, 20*a*, and 20*b* respectively, except that they show the alternative construction of the foot assemblies as described above.

Figure 20A:
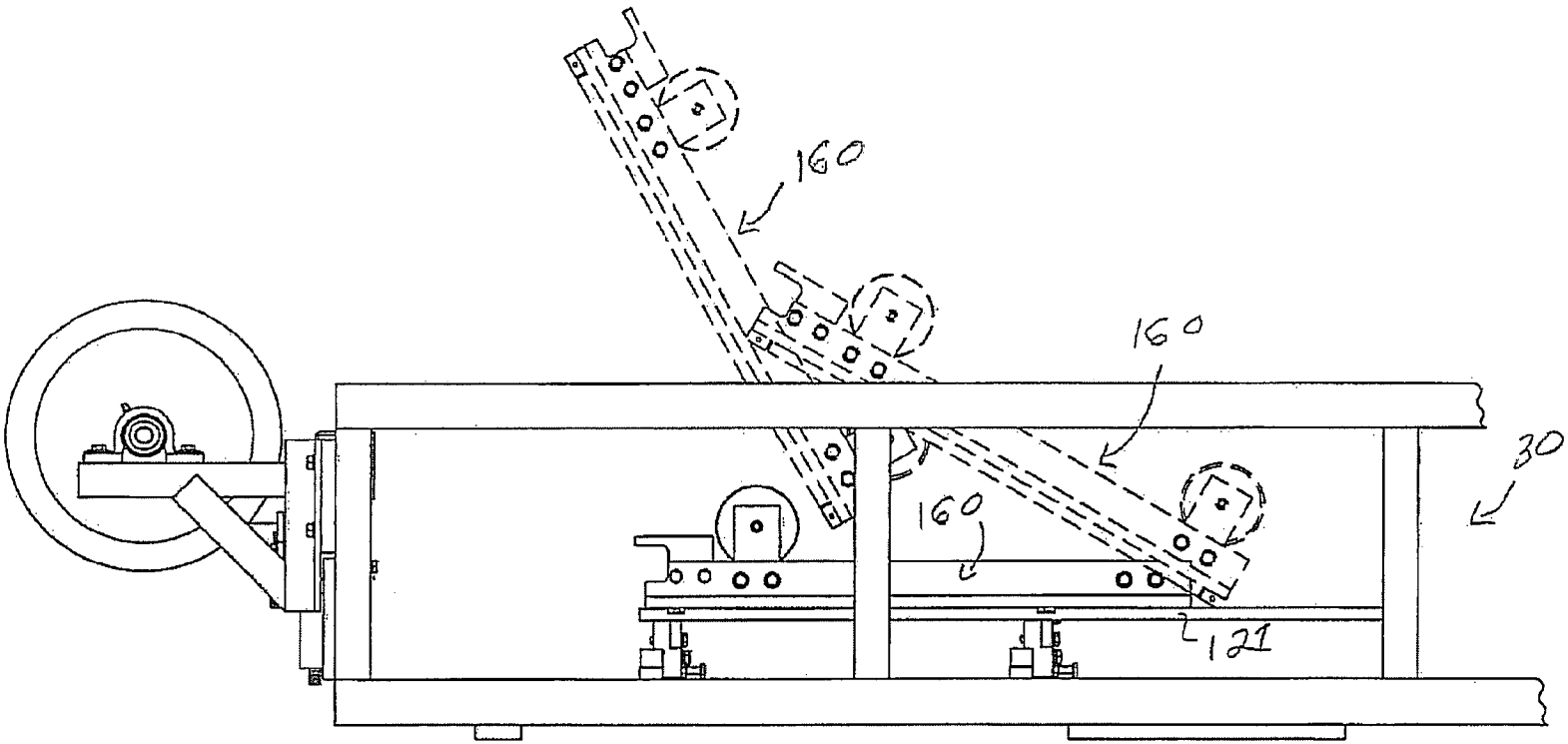
FIG. 20*a* is a right side diagrammatic view of the upstream end of the forming machine, and illustrating the convenient removability of a tooling set through the machine's framework.
Figure 20B:
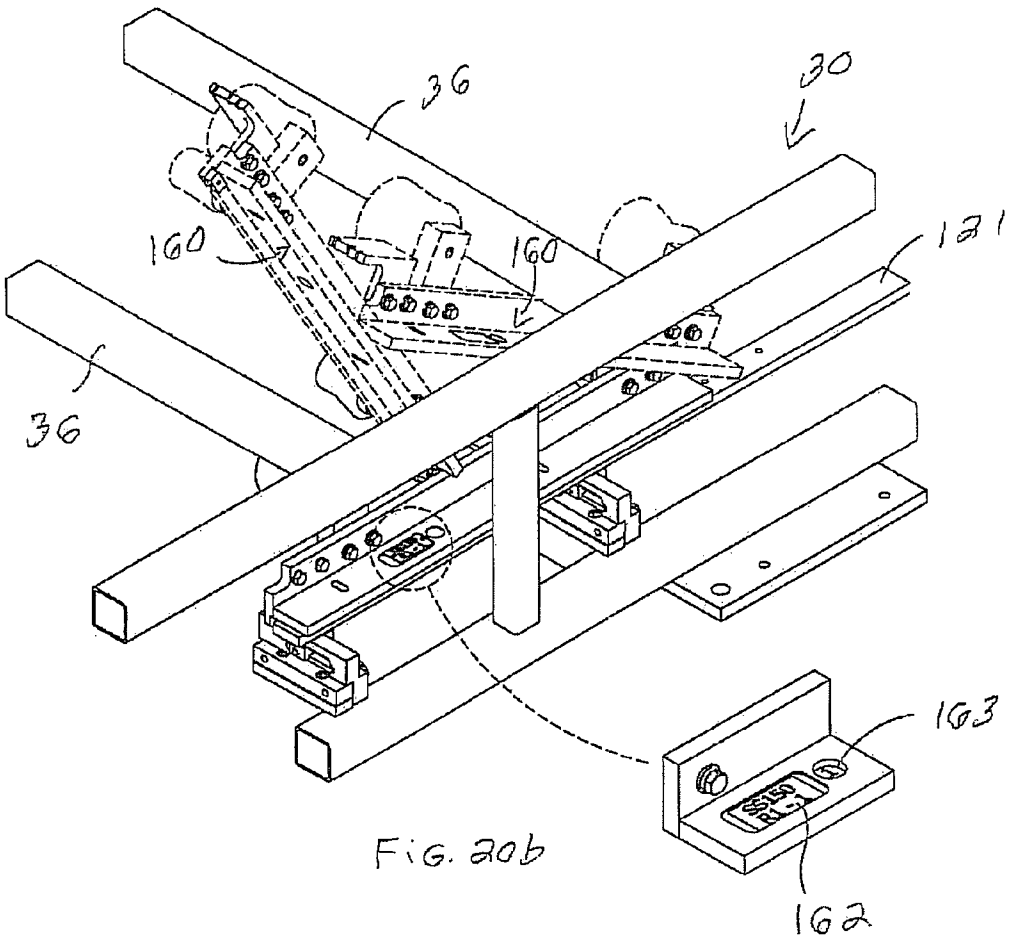
FIG. 20*b* is a perspective diagrammatic view of the upstream end of the forming machine, and illustrating the convenient removability of a tooling set through the machine's framework.
Figure 20C:
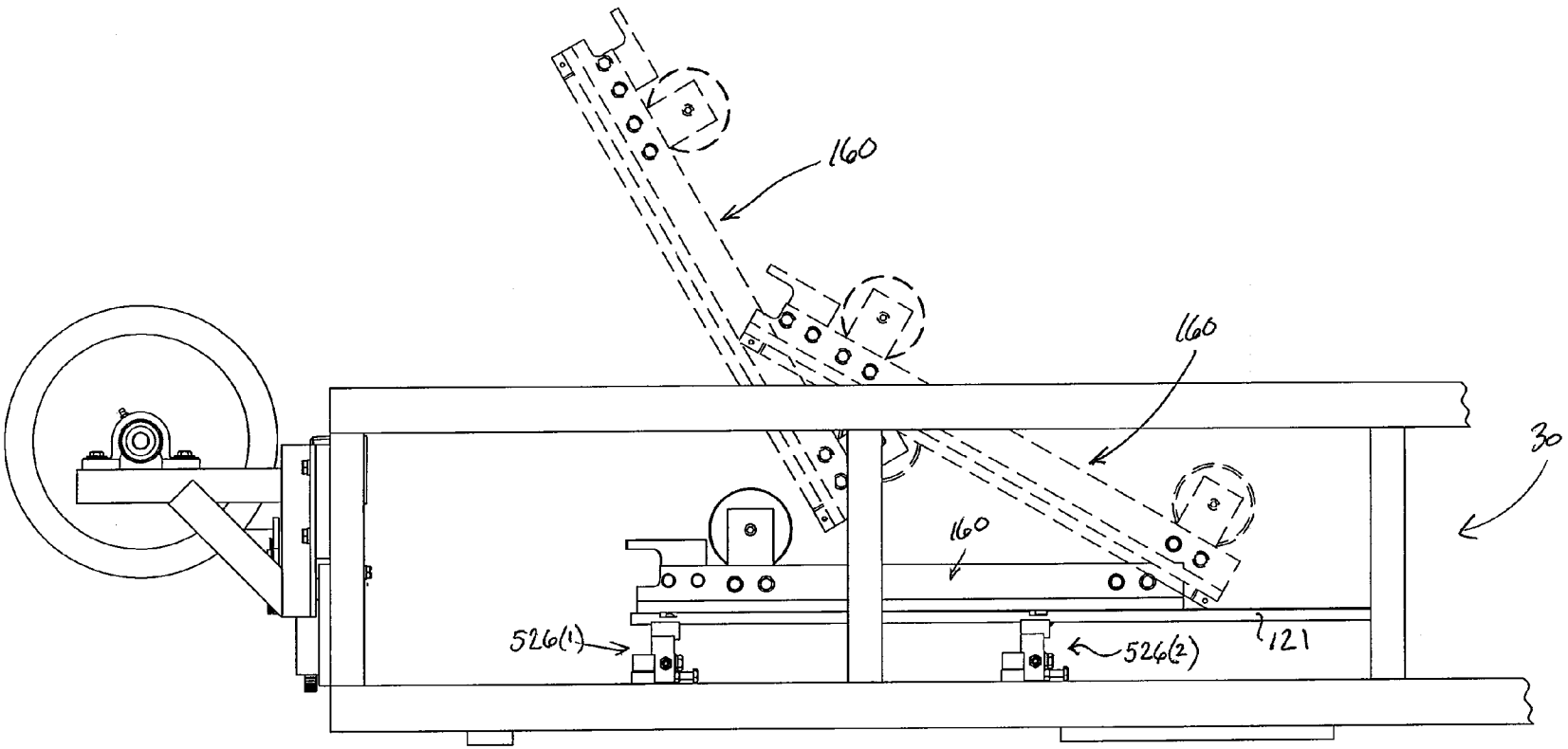
FIG. 20*c* is a right side diagrammatic view of the upstream end of the forming machine including feet according to the alternate construction shown in FIGS. 17*c* and 17*d*, and illustrating the convenient removability of a tooling set through the machine's framework.
Figure 20D:
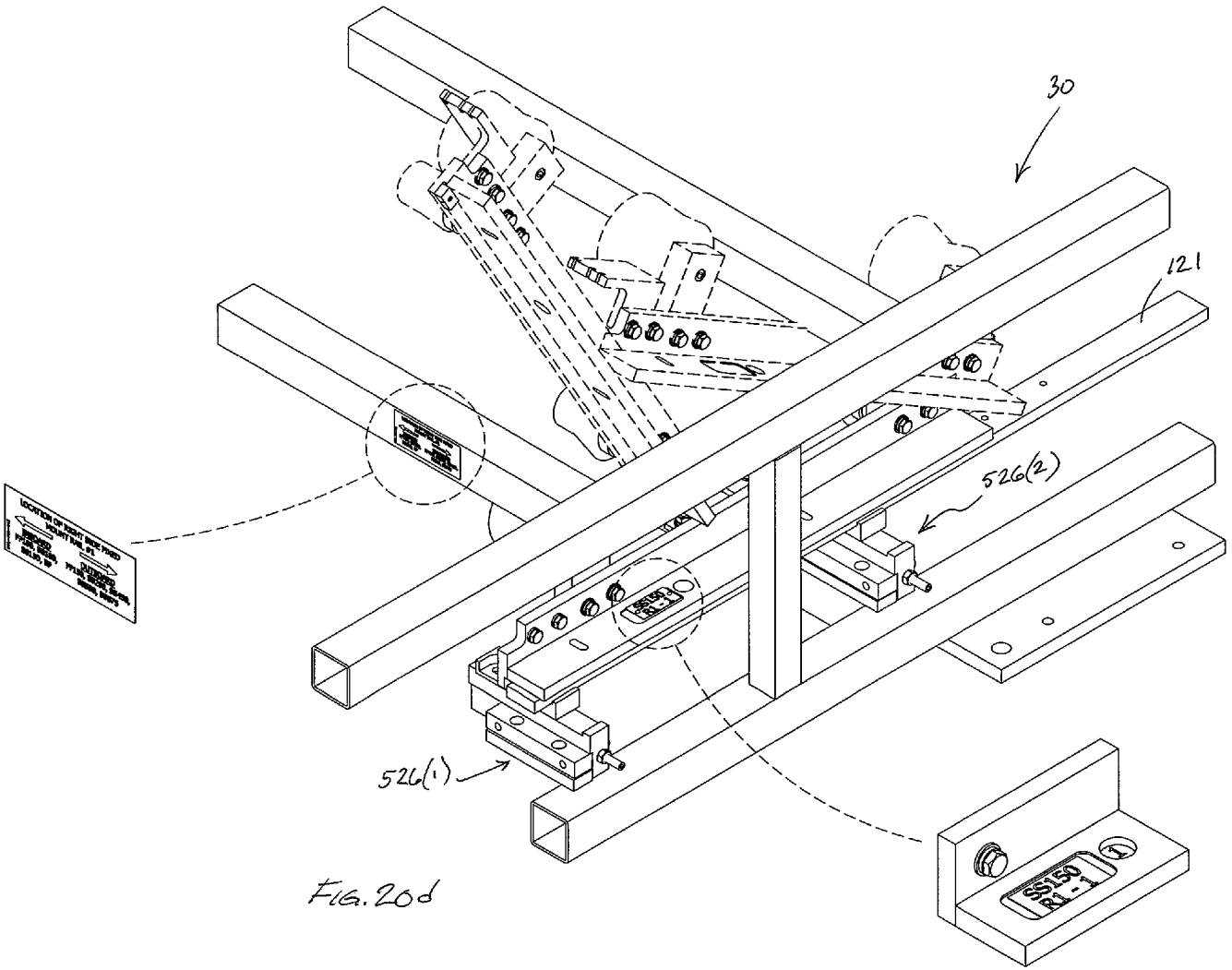
FIG. 20*d* is a perspective diagrammatic view of the upstream end of the forming machine including feet according to the alternate construction shown in FIGS. 17*c* and 17*d*, and illustrating the convenient removability of a tooling set through the machine's framework.

Once the right side tooling support assembly 150 has been appropriately positioned and aligned relative to the framework, the tooling can be mounted thereto. FIGS. 20*a* & 20*b*, for example, shows a toolset 160 mounted to support bar 121 (sometimes referred to as a "mounting rail") in such a way that the toolset can be easily inserted or removed from the machine without requiring further disassembly. That is, and as shown in phantom in these figures, the toolset 160 can be detached from support bar 121 and removed by directing it through longitudinally adjacent ones of the framework's transverse beams 36.

Figure 18B:
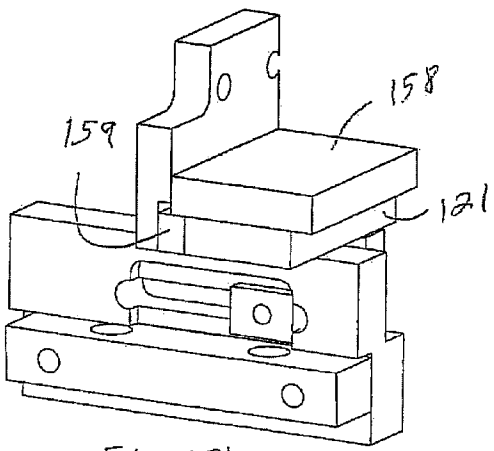
Figure 18A:
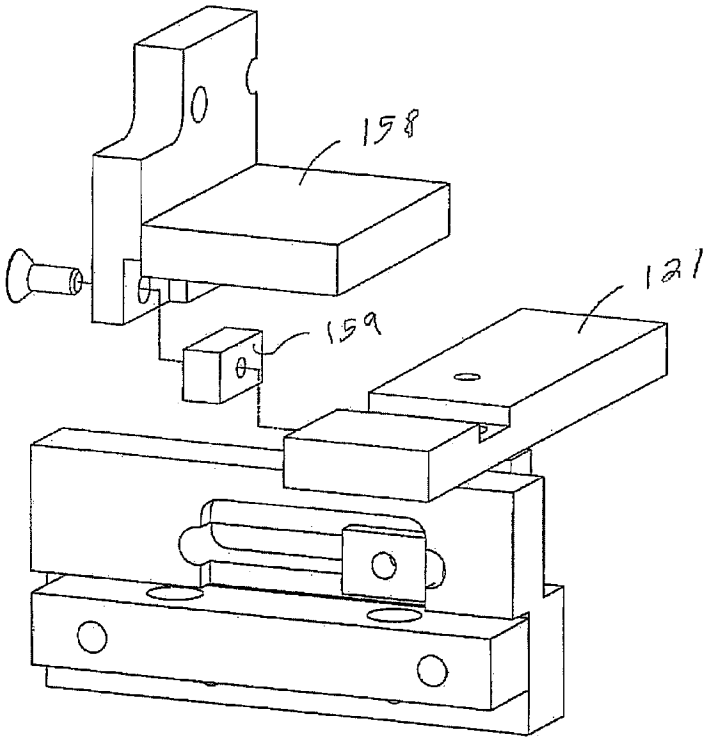
Figure 18C:
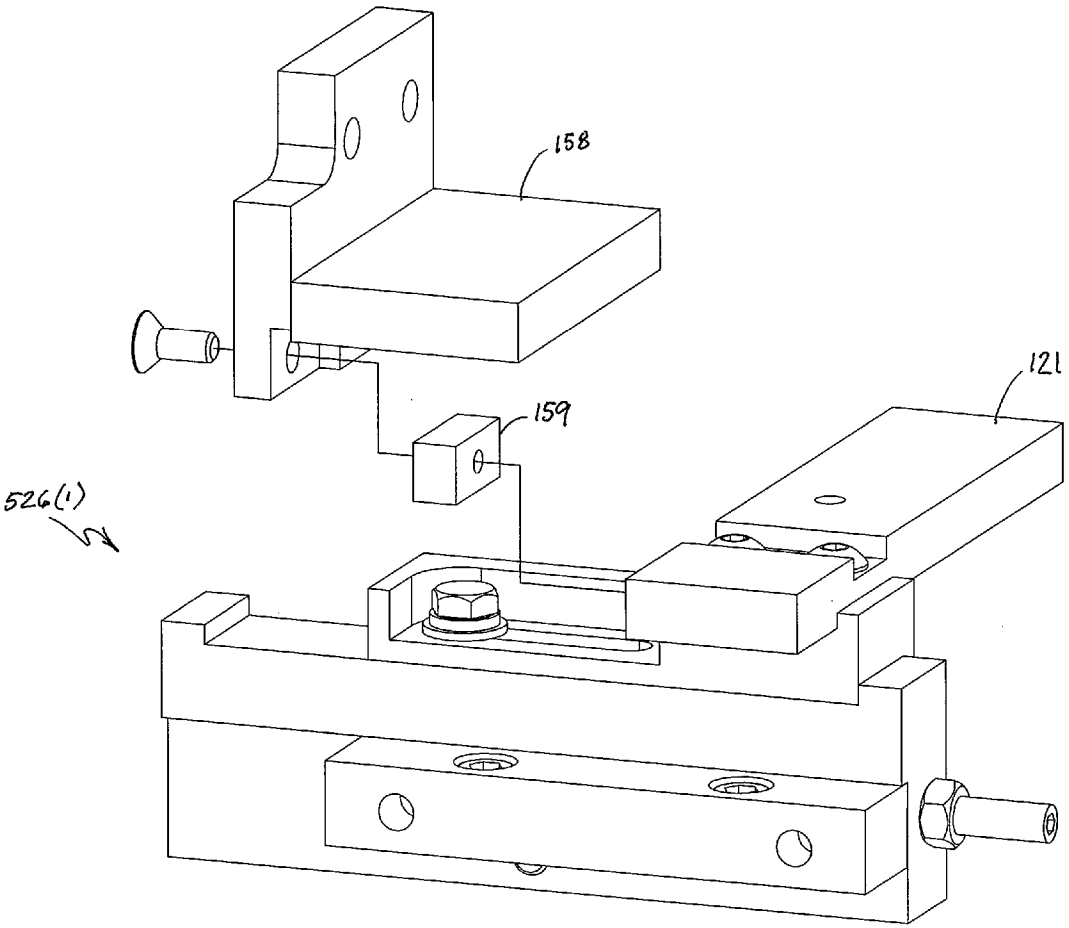
Figure 18D:
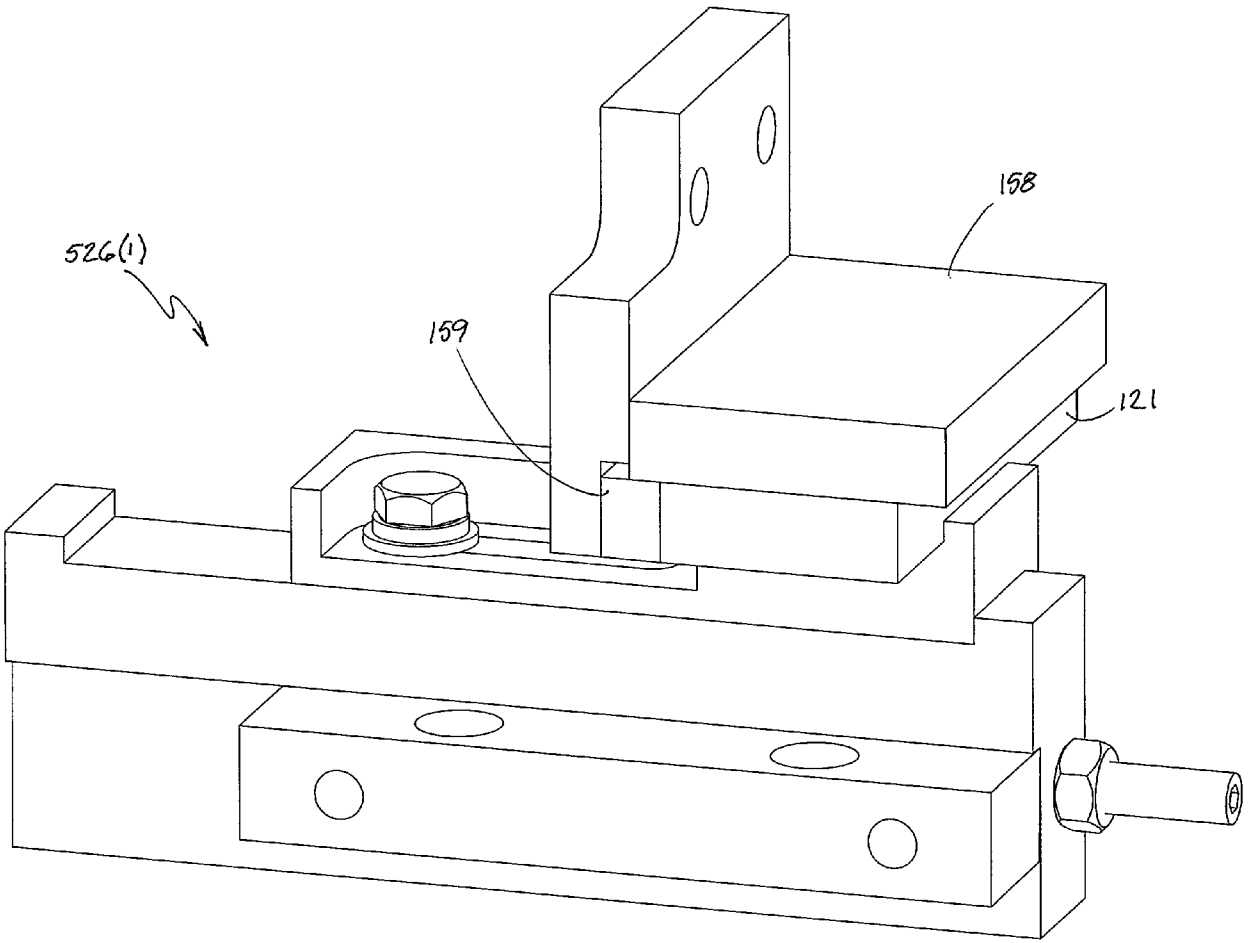

As shown in FIGS. 18*a* and 18*b*, the station mount assembly 158 (only a portion shown) for a given tool set is mounted to support bar segment 121 utilizing a spacer block 159 sandwiched there between. Though not represented, another spacer block is present for the other end of the station mount assembly 158. These spacer blocks butt up against the face of the support bar segments, such as segment 121, to facilitate aligning tooling in the machine. Each tooling set profile has different sizing (i.e. thickness) for its spacers, allowing each system to be installed easily onto the same mounting surface, thus making changeover repeatable. As such, once the support bar segment has been placed in the inboard or outboard location as described above using the T-nut, these spacer blocks locate the toolsets in the proper position.

FIGS. 16*a* & 20*b* also illustrate another aspect of the present invention which makes it very convenient for an operator to appropriately identify which toolset goes where without entailing guesswork. As best shown in FIG. 20*b*, for example, tooling set 160 includes a label 162 which includes suitable indicia thereon. More particularly, label 162 includes a representative identifier "SS150" which identifies it as a toolset for use in generating an SS150 roof panel profile, a designation used by New Tech Machinery Corp. In addition, label 162 includes the designation "R1-1" which informs both that it is the first toolset to be mounted on the right side of the forming machine (as one proceeds in the downstream direction), and that it should be placed on support bar 121 such that its aperture 163 aligns with the indicia 125 designated as "1" on support bar 121 (see FIGS. 16*a* & 20*b*). Each tooling set for both the right and left sides of the machine would be similarly marked to make it very convenient for an operator to know where it is placed in the sequence and precisely where it needs to be mounted on its associated mounting bar. As can be seen in FIG. 16*a*, mounting bars 121 and 123 include a plurality of numerical indicia 125 (nine shown) so that an operator can readily take a given toolset that is suitably marked and align it precisely in place on the support rail. While the appropriate sequencing of tooling sets and their longitudinal positions relative to one another are known for a given profile, it is heretofore been very tedious and time-consuming to appropriately position them within the framework during a changeover. The present invention, however, with its tooling support assembly construction, in conjunction with the alignment system for the tooling sets, removes much of the guesswork and makes changeover much quicker, resulting in enhanced efficiency during operation of the forming machine.

Figure 21:
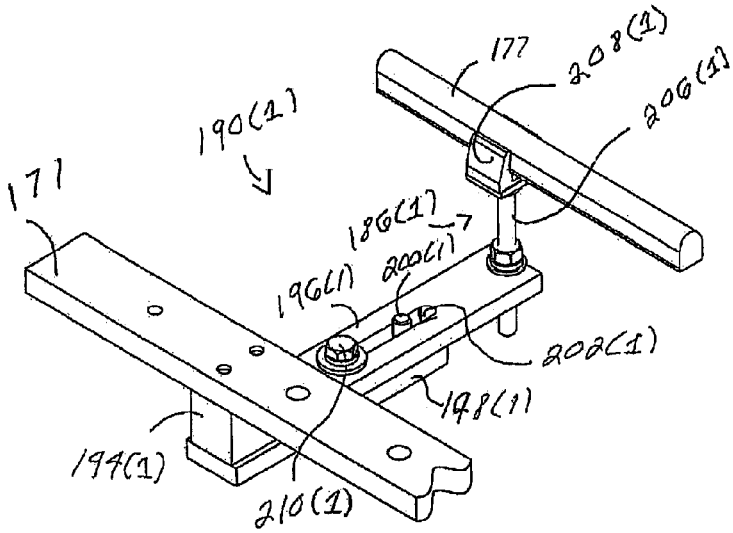
FIG. 21 is a perspective view showing offset displacement of a representative stanchion to the forming machine's left guide rail.
Figure 22:
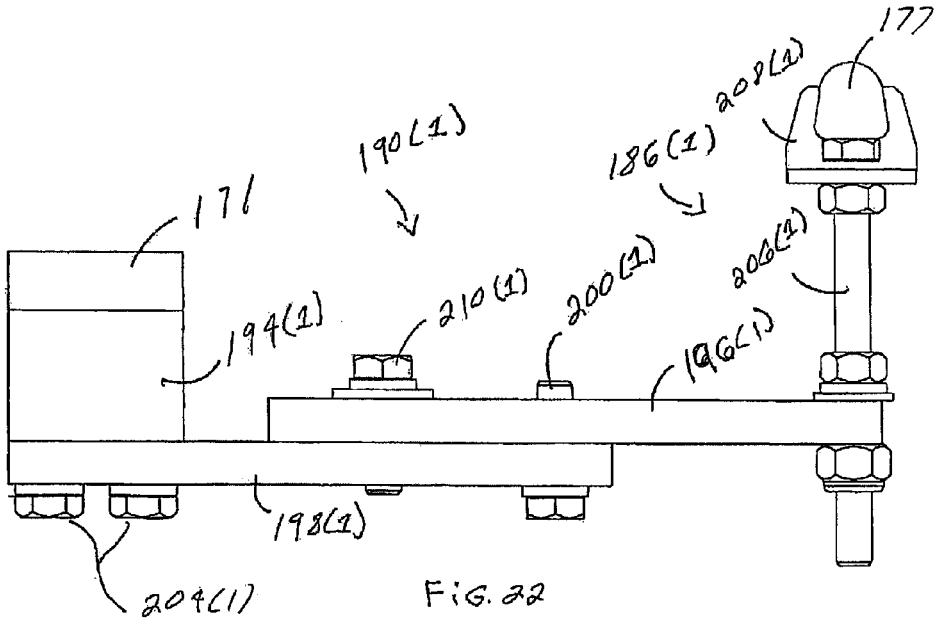
FIG. 22 is an upstream end view of the showing the displacement of the stanchion of FIG. 21 relative to the guide rail.

The construction of left support bar 122 for use in a left tooling support assembly 170 is now described with reference to FIGS. 16*a*, 21 & 22. Left support bar 122 is also comprised of a plurality of support bar segments including an upstream segment 171 and a downstream segment 173. Left support bar 122 and its segments 171 and 173 support tooling for the left side of the forming machine which again, depending on the profile, would include a series of longitudinally spaced apart tooling sets of selected construction for progressively bending a left side of the sheet material as it is advanced through the machine in the downstream direction.

Left support bar 122 supports a left guide rail 172 which is comprised of guide rail segments 177 and 175. Upstream guide rail segment 177 is supported in an inboard location relative to upstream, left support bar segment 171. Downstream guide rail segment 175 is supported in an inboard relationship to downstream support bar segment 173. As well-known in the art, forming machines of the type described herein typically include left and right guide rails upon which the sheet material travels as it is advanced through the machine. Thus, with brief reference to FIG. 30, it may be appreciated that the forming machine's right guide rail 180 is fixedly mounted within the machine inwardly of right support bar 120 and is formed from elongate metal. Right guide rail 180 is supported at its desired height within the machine by a plurality of stanchions which are fixedly secured to the machine's framework 30 at spaced apart locations therealong by stanchions secured at desired locations to the framework's transverse beams.

Left guide rail 172 is also supported by a plurality of stanchions 186(1) through 186(6) as shown in FIG. 16*a*. Unlike the right guide rail, left guide rail 172 and its segments 177 and 175 are transversely movable within the machine between inboard and outboard locations, as will be described in greater detail below in later figures. As shown in FIG. 16*a*, each guide rail segment 173 177 and 175 is inwardly displaced from its associated left support arm segment by spacers 190(1)-190(2) and 192(1)-192(4). FIGS. 21 & 22 show the construction for representative spacer 190(1) and its associated stanchion 186(1). The construction for spacer 190(2) and its associated stanchion 186(2) is the same, so only one need be described. Spacer 190(1) is supported below the elevation of left support arm segment 171 by a spacer block 194(1). Spacer 190(1) includes a slotted upper plate 196(1)

and a lower plate 198(1) having an upwardly projecting bolt 200(1) which travels within the upper plate's slot 202(1). Spacer block 194(1) is sandwiched between left support arm segment 171 and lower spacer plate 198(1), and can be secured there between by fasteners 204(1) or through other suitable means, such as welding.

Stanchion 186(1) includes a post 206(1) which extends through upper plate 196(1) and is fastened thereto by nuts and washers as shown. Disposed on the upper end portion of post 206(1) is a clevis 208(1) within which left guide rail segment 177 is seated. As can be appreciated from FIGS. 21 & 22, the inboard position of left guide rail segment 177 can be selectively varied by adjusting screw 210(1) and sliding upper plate 196(1) relative to lower plate 198(1). The same holds true for spacer 190(2) in FIG. 16*a*. It should be noted in FIG. 16*a* that the downstream left guide rail segment 175 is in a fixed position relative to its support bar segment 173. Thus, it is desirous to allow upstream guide rail segment 177 to move relative to its support bar segment 171 to allow for sufficient clearance there between during a changeover. That is, for certain profiles, the upstream-most (or first) tooling set for the left side of the machine has relatively enlarged forming rollers which are in close proximity to first guide rail segment 177 when in use. In order to insert or remove this tooling set it becomes necessary to provide sufficient clearance between the guide rail segment and the forming rollers. In existing machines, this requires a certain amount of disassembly to accomplish. However, by allowing first guide rail segment 177 to move more inwardly, and thus maximize the spacing between it and left support bar segment 171, the first tooling set can be changed over relatively easily. It should also be noted in FIG. 16*a* that the left support bar 122, as with right support bar 120, is also labeled to include indicia 125' to help place and suitably locate the tooling sets as they are mounted thereon.

Having described the construction for the support arm assemblies which mount the left and right tooling sets, the ability to move these assemblies relative to one another will now be described. It is desirous in the present invention to have this capability so that the machine can be more readily adjusted for different profiles. As described above in the background section, existing machines suffer from being very tedious and time-consuming in this regard. With initial reference then to FIGS. 16*a* & 23, a crank mechanism 220 is mounted to left support bar assembly 122 to allow it to move in inbound and outbound directions. Crank mechanism 220 may also comprise part of the left tooling assembly 170. Crank mechanism 220 broadly includes a crank handle subassembly 222, an elongate shaft construction 224, and a plurality of inwardly directed projections 226(1)-226(5). Elongate rod construction 224 can be considered as having a plurality of primary rod segments 224(1)-224(5) and interleaved secondary rod segments 225(1)-225(5). With the exception of upstream rod segment 224(1), each rod segment extends between longitudinally adjacent ones of the projections 226.

Figure 24:
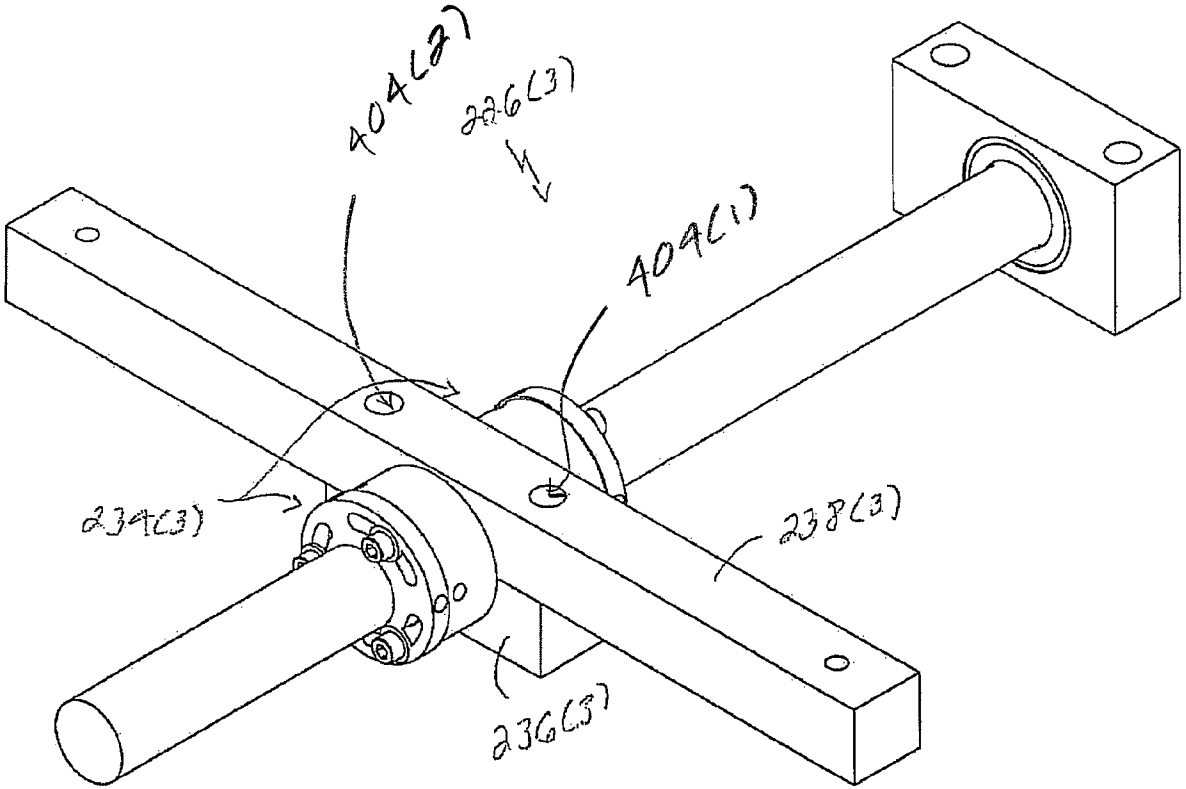
FIG. 24 is an enlarged perspective view showing the ACME nut portion of one of the projections associated with the forming machine's width adjustment assembly.

Each of projections 226(1)-226(5) includes a proximal end portion which is coupled to and extends from shaft assembly 224 to terminate at an associated block 227(1)-227(5), respectively, which is fixedly mounted to the forming machine's framework 30. Each terminal block 227 supports an associated ACME shaft 232(1)-232(5), respectively. At an intermediate location between each terminal block 227 and shaft assembly 224 is an associated ACME nut assembly 234(1)-234(5). Each ACME nut assembly sandwiches there between a bottom support clamp and a top support clamp. This is more clearly shown with reference to FIG. 24 which shows an enlarged portion of projection 226(3). Here, it may be seen that ACME nut 234(3) sandwiches bottom support clamp 236(3) and top support clamp 238(3). The particular support clamp 238(3) is preferably longer than the other remaining top support clamps in the machine. This is done to achieve more stiffness to the support bar 122 at this particular location. Each upper ACME support clamp 238 is mounted to a portion of the left support bar 122 as perhaps best shown in FIG. 16*a*. Recall that support bar 122 itself supports the various tooling sets for the left side of the machine.

With brief reference again to FIG. 23, during operation, rotation of the crank handle 226 in either the clockwise or counterclockwise direction causes all of the left support bar assembly 122 that is supported by projections 226(1)-226(5) to correspondingly move in an inboard or outboard direction. In particular, rotation of crank handle 226 in a clockwise direction causes all of left support bar assembly to move outwardly, whereas rotation of handle 226 in the counterclockwise direction causes the left support bar assembly 122 to move inwardly.

Figure 25:
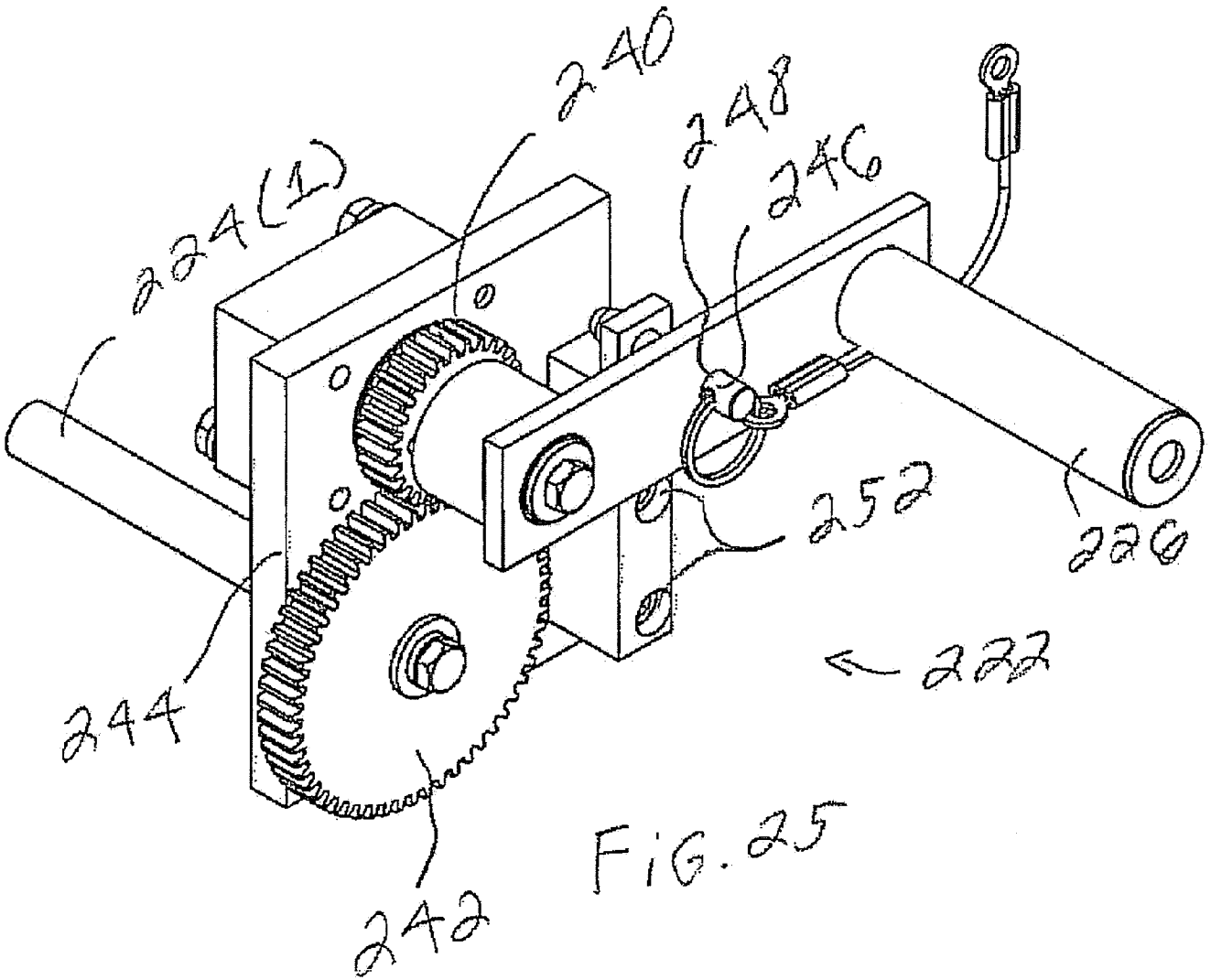
FIG. 25 is a perspective view of the crank mechanism for the width adjustment assembly.

Crank handle assembly 222 is shown in more detail in FIG. 25. Crank handle assembly 222 includes the crank handle 226 which, upon rotation, causes a corresponding rotation of shaft segment 224(1) by virtue of the cooperative spur gears 240 and 242. The handle and gears are supported on a mounting plate 244 which, as shown in FIGS. 13 and 15 for example, can be mounted at an upstream corner portion of the forming machine's framework 30. Handle 226 is spring loaded so that, when it has been rotated into a desired position, it can be disengaged from spur gear 242 and secured via a securement pin 246 which extends through an aperture 248 in handle and into one of a plurality of alignment holes 252 that are formed within a mounting block 254 that is disposed on mounting plate 244. As such, handle 226 can be secured after adjustment to prevent dislodgement.

Figure 23:
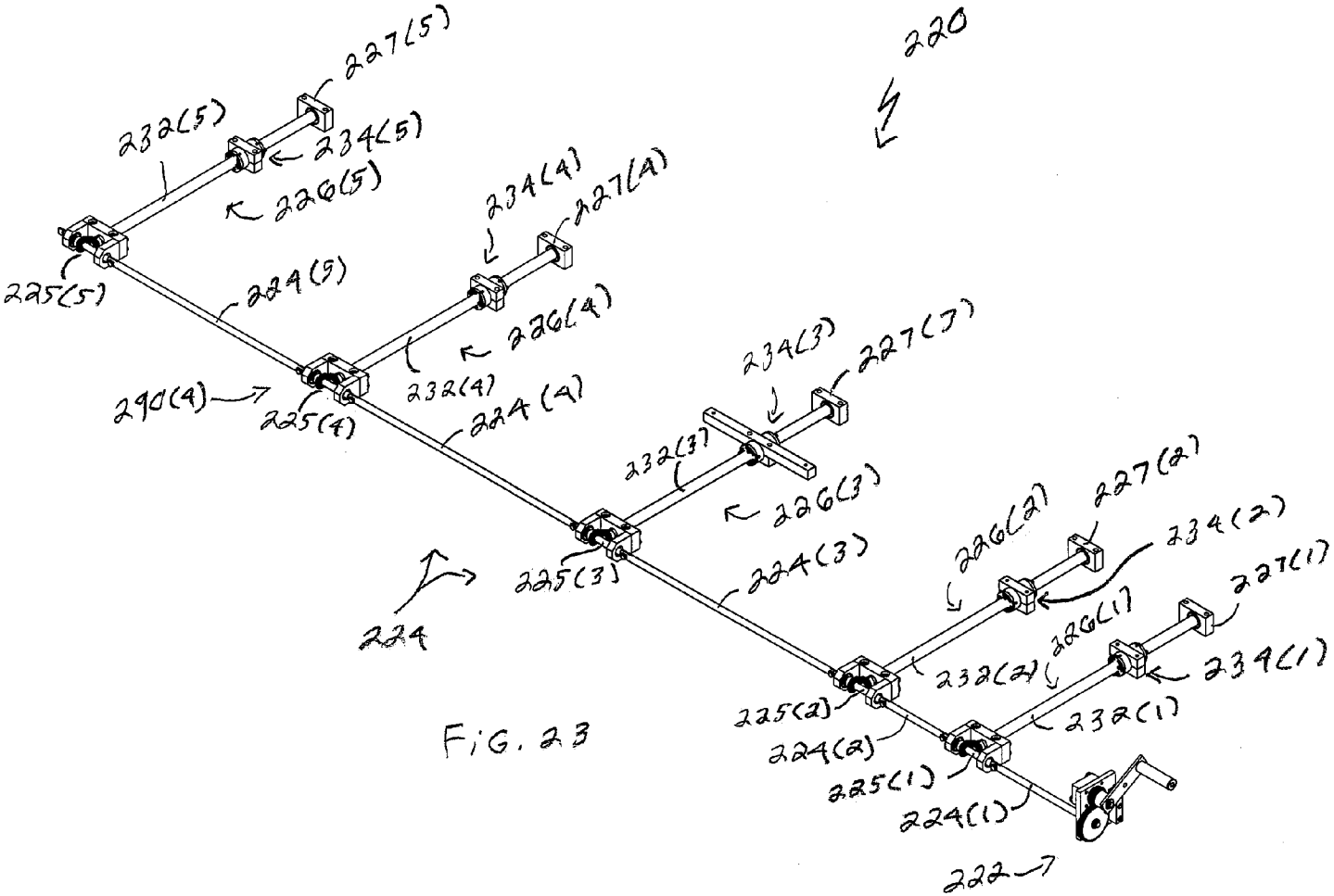
FIG. 23 is a perspective view of the forming machine's width adjustment assembly, or crank assembly.
Figure 26A:
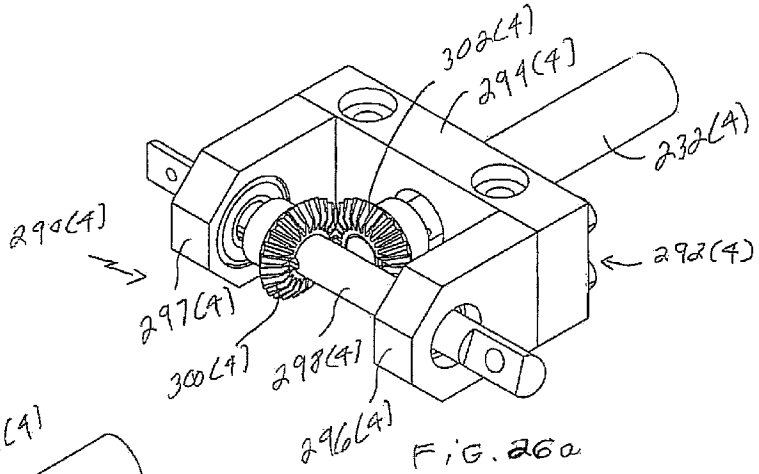
FIG. 26*a* is a perspective view of a representative mitre gear station.
Figure 26B:
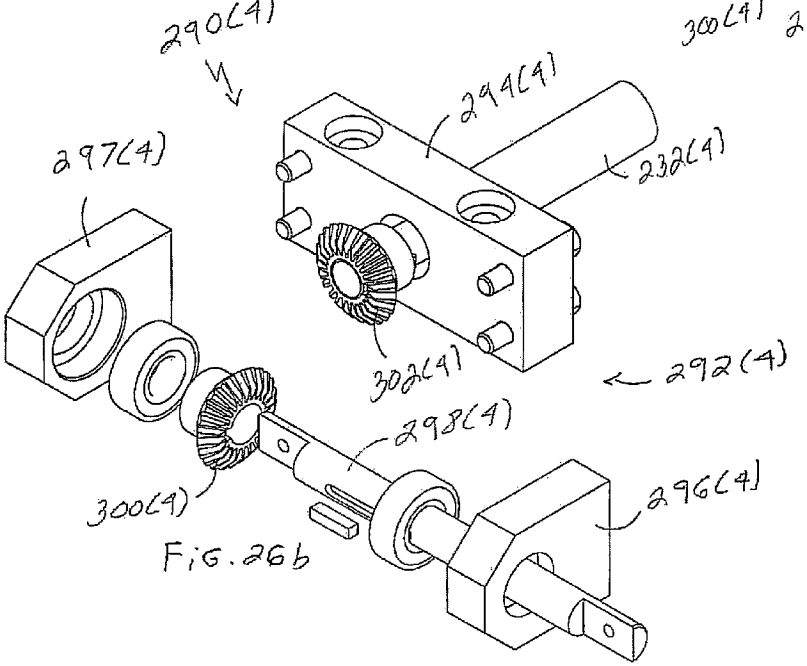
FIG. 26*b* is an exploded perspective view of the representative mitre gear station shown in FIG. 26*a;*

FIGS. 26*a* & 26*b* can be described as one station along shaft assembly 224 in FIG. 23 where the shaft is coupled to a projection's mitre gear. In particular, FIGS. 26*a* & 26*b* show an intermediate station. The remaining stations shown in FIG. 23 have similar constructions. With reference to FIGS. 26*a* and 26*b* representative station 290(4) includes an associated frame 292(4) which has a backing plate 294(4) and a pair of ears 296(4) and 297(4). Station 290(4) includes a notched shaft segment 298(4) about which is disposed a mitre gear 300(4), similar to mitre gear 264 described above. ACME shaft 232(4) supports a second mitre gear 302(4) and extends through backing plate 294(4), also similar to that described above with reference to FIGS. 26*a* & *b*. Accordingly, since shaft segment 298(4) interconnects shaft segments 224(4) and 224(5), they rotate in correspondence to cause a corresponding rotation of ACME shaft 232(4).

Typical width adjustment shafts have in the past consisted of a long one-piece constructions. Because of the length of the long one-piece shaft, it is not practical to machine keyways in order to attach the mitre gears to the shaft. It has been common practice to assemble the width adjustment assembly into the machine, align it to the mating mitre gears and then cross drill through the shaft and mitre gears to accommodate a roll pin which would then transmit the torque from the shaft to the mitre gears. Another difficulty with using the long one-piece shaft is the requirement for the shaft to fit through all of the support bearings. Typical low cost cold rolled steel shafting is not available with a diameter tolerance such that it will always fit through the support bearings. Therefore, an additional machining operation is typically required in order to allow the shaft to fit through all of the bearings.

This invention replaces the long one-piece shaft and includes the use of multiple shaft segments (FIG. 23 224(1) through 224(5) and 225(1) through 225(5)). The shaft segments are joined by use of half-lap joints where one shaft segment has a clearance hole and the mating shaft has a tapped hole. Also, because of the shortened length the specific shaft segments that need to be attached to the mitre gears (i.e. FIG. 26*b* 298(4)) have a keyway machined in them along with a keyway in the mating mitre gear 300(4) to accept a key. Since the width adjustment shaft is made up of multiple short sections only the outside diameter on the shaft segments that are captured by support bearings need be machined to allow them to fit in the bearings. The shaft segments that are not supported by bearings do not have to have an extra machining operation on their outside diameter.

With an appreciation of the foregoing construction for the principal components of the forming machine, a changeover sequence will now be described in order to more fully appreciate the advantages of its construction. During a typical changeover sequence, the machine's current toolset is replaced with a new toolset to allow for the forming machine to generate a new profile. Accordingly, an initial step in the changeover sequence may be to remove the existing toolset from the machine. Then, the new toolsets are dropped down onto the machine and set into place. More particularly, as discussed above, for example with reference to FIG. 17, the toolsets on the right side of the forming machine may be placed in either an inboard or an outboard position relative to the drive rollers. A chart may be used to inform an operator, as to each toolset used for a given profile, whether the toolset needs to be placed in the inboard or outboard position. Prior to actually attaching the right side toolsets, it is more convenient to place their associated right side support bar in the inboard or outboard position as determined by the chart. The toolsets are then mounted on their associated right support bars, and the indicia which is labeled on each toolset facilitates their placement, as discussed above.

Figure 27:
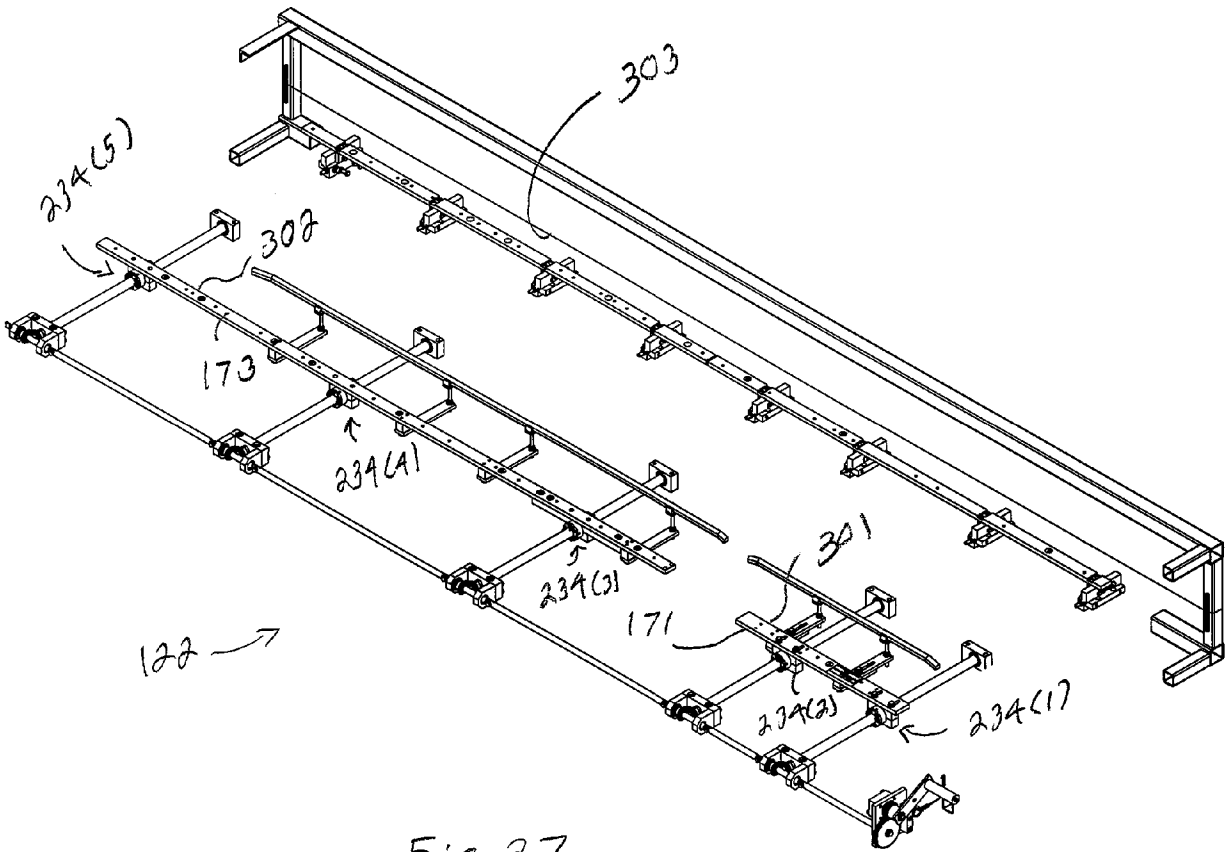
FIG. 27 is a perspective view, similar to FIG. 16*a*, of the left and right support assemblies for mounting the tooling sets, but additionally illustrating a portion of the framework and a string line which may be used during initial calibration.

Reference is now made to FIG. 27 to explain how the initial calibration for the left side may occur. It is recalled from FIG. 16*a* that left tooling support assembly 122 includes support bar (or rail) segments 171, 173. During manufacture these segments 171, 173 are initially calibrated such that their interior facing surfaces 301 & 302, respectively, are located a desired distance from a string line 303 which spans between portions of the framework 30 along the right side of the machine. This may entail rotation of the Acme nuts along their associated Acme shafts to properly position them. Each downstream Acme nut support clamp assembly (or clamp block assembly) 234(3)-234(5) that is associated with downstream rail segment 173 has a clearance hole in its upper half and a tapped hole in its bottom half. Thus, for example, with brief reference again to FIG. 24 holes 404(1) and 404(2) associated with top support clamp 238(3) are clearance holes that are aligned with corresponding tapped holes (not shown) in bottom support clamp 236(3). Screw fasteners (not shown) are received through these aligned holes so that, once fastened, the clamp block does not move relative to its Acme nuts. This construction for the downstream clamp blocks 234(3)-234(5) maintains downstream rail segment 173 in a fixed position during operation of the forming machine.

Figure 28:
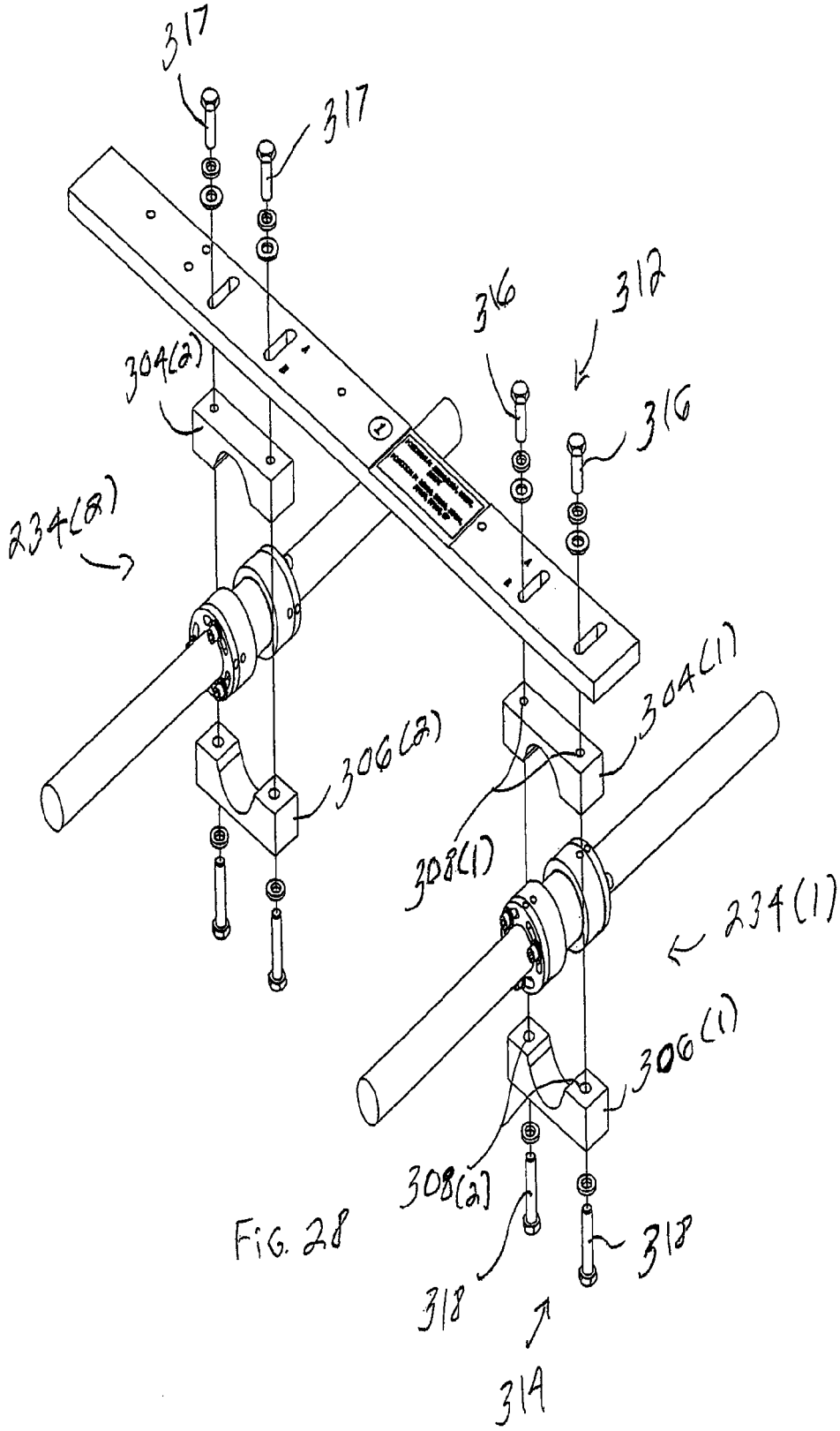
FIG. 28 is an exploded perspective view showing the mounting of the upstream rail segment to the machine's Acme shafts.
Figure 29:
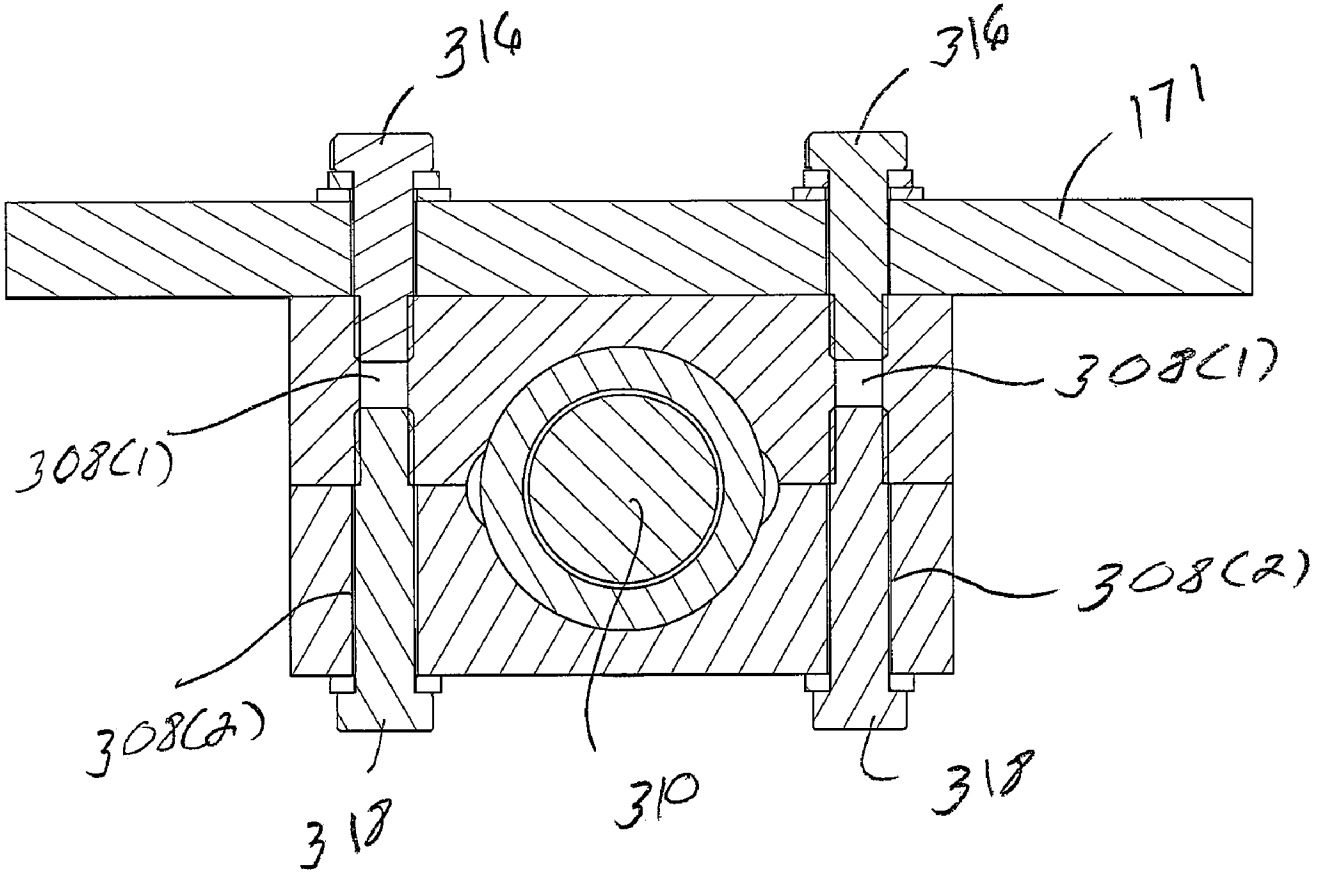
FIG. 29 is a cross-sectional view showing the rail segment mounted to one of the machine's Acme shafts.

The construction for upstream clamp block assemblies 234(1) & 234(2) are somewhat different. With reference to FIG. 28 clamp block assembly 234(1) includes a top support clamp 304(1) and a bottom support clamp 306(1). Similarly, clamp block assembly 234(2) includes a top support clamp 304(2) and a bottom support clamp 306(2). The top support clamp of each of these assemblies includes two threaded holes, while their bottom support clamps include two clearance holes. It may thus be seen in FIGS. 28 & 29 that representative clamp block assembly 234(1) has associated threaded holes 308(1) while bottom support clamp 306(1) has associated clearance holes 308(2). These support clamps and their associated rail segment 171 are secured about threaded Acme nut via upper and lower fastener assemblies 312 & 314, respectively. Upper fastener assembly 312 includes hex head cap screws 316 and their associated washers, while lower fastener assembly 314 includes hex head cap screws 318 and associated washers, as shown. Screws 318 are longer than screws 316, allowing lower screws 318 to fasten the upper and lower support clamps about the Acme nut. Screws 316 secure rail segment 171 to top support clamp 304(1). However, when upper screws are loosened, the rail segment 171 may be moved relative to the clamp block assembly 234(1) which, itself, remains fixed. This is unlike the downstream clamp block assemblies 234(3)-234(5) which incorporate only top fasteners each of which is long enough to be threadedly received through rail segment 173, their associated top support clamp, and at least a portion of their associated bottom support clamp. As such the entire assembly remains fixed and rail segment 173 is not permitted to move relative to the clamp block assemblies.

Figure 30A:
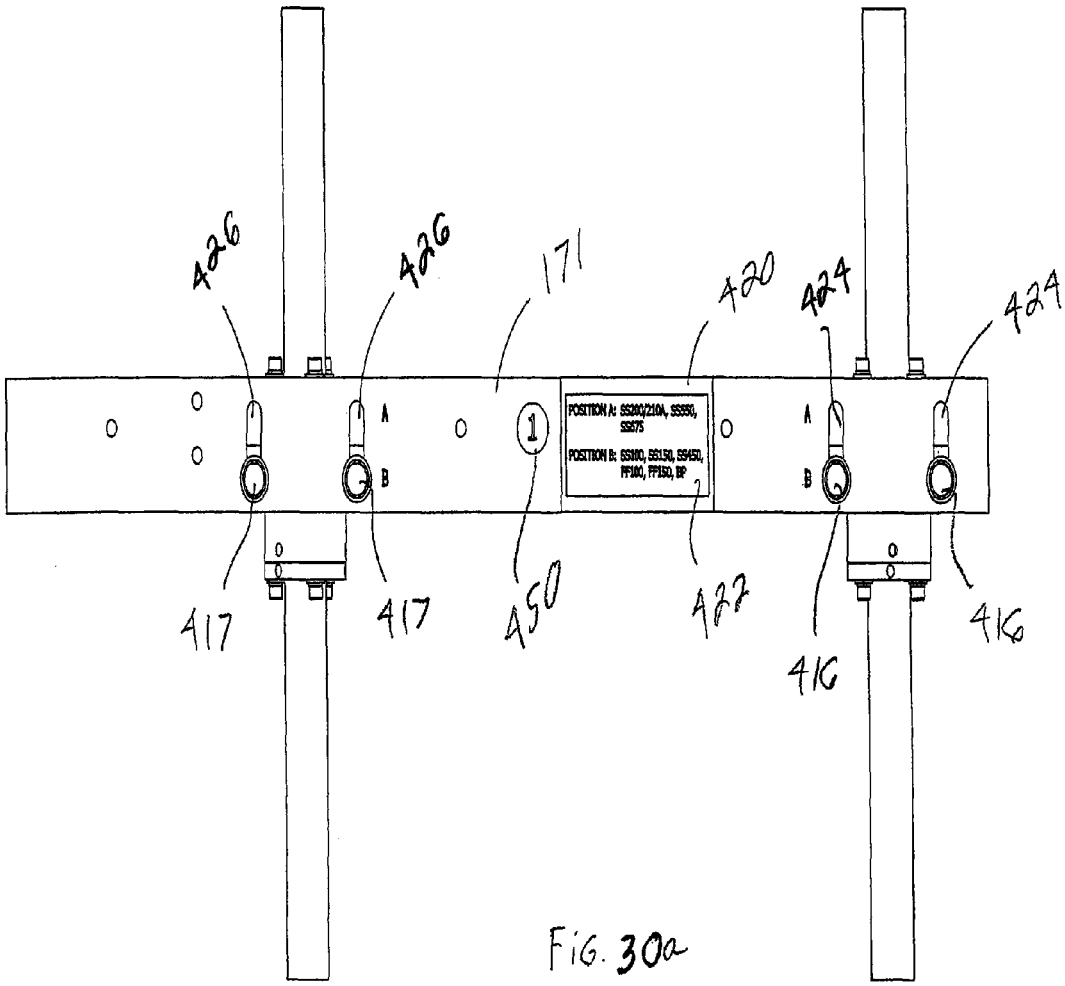
FIGS. 30*a* & *b*, respectively, depict the rail segment in inboard and outboard offset positions along the Acme shafts.
Figure 30B:
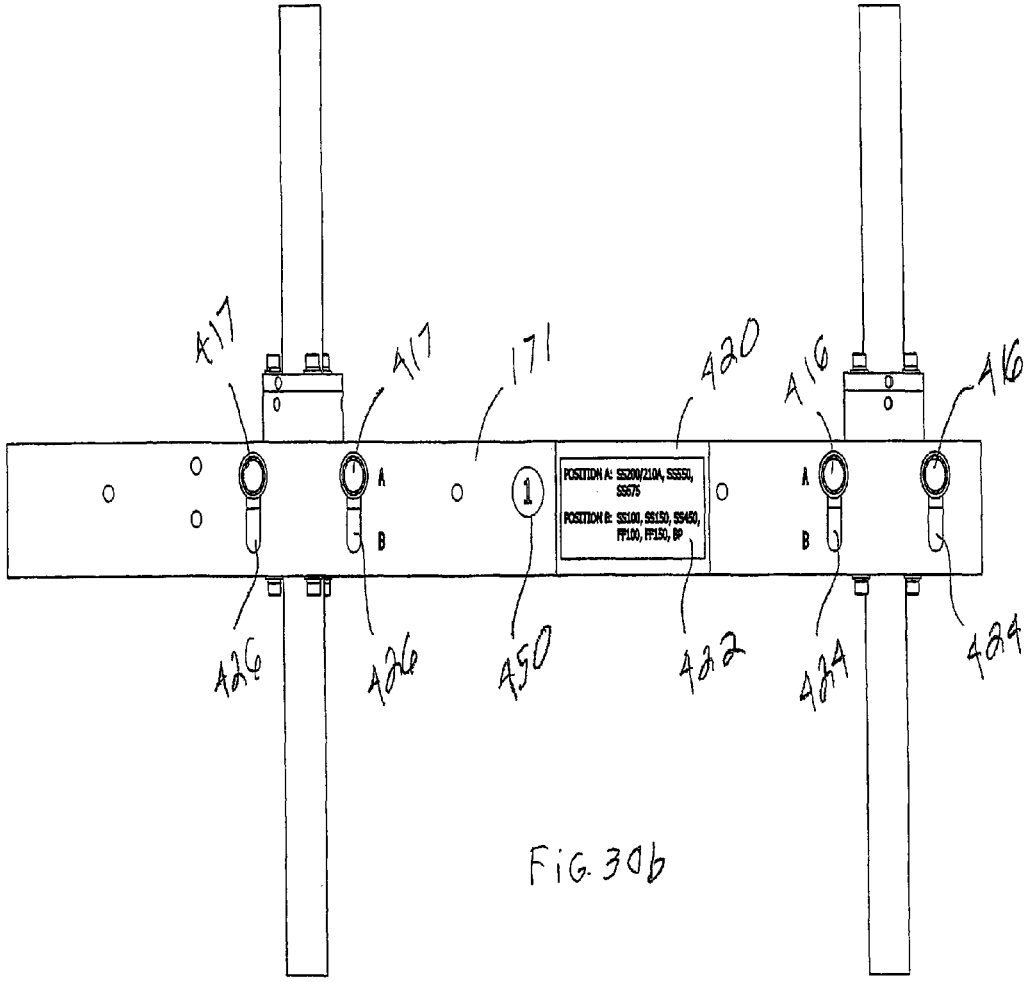

Once rail segments 171 & 173 have been properly located relative to the string line, upstream rail segment 171 is situated in the appropriate offset position relative to downstream rail segment 173. As perhaps best shown in FIGS. 30*a* & 30*b* rail segment 171 includes a relief region 420 which receives a decal 422. Depending upon the profile desired to be formed with the machine decal 422 identifies, with respect to the available profiles, whether rail segment 171 needs to be placed in the inboard or outboard position relative to rail segment 173. FIG. 30*a* depicts rail segment 171 in the inboard position which corresponds to position "B" on the decal and the rail segment. FIG. 30*b* depicts rail segment 171 in the outboard position which corresponds to position "A" on the decal and the rail segment. Slotted channels 424 and 426 are formed through rail segment 171 so that when fasteners 416 and 417 are loosened rail segment 171 may be moved to the appropriate offset position "A" or "B" and subsequently fastened into place.

Figure 31:
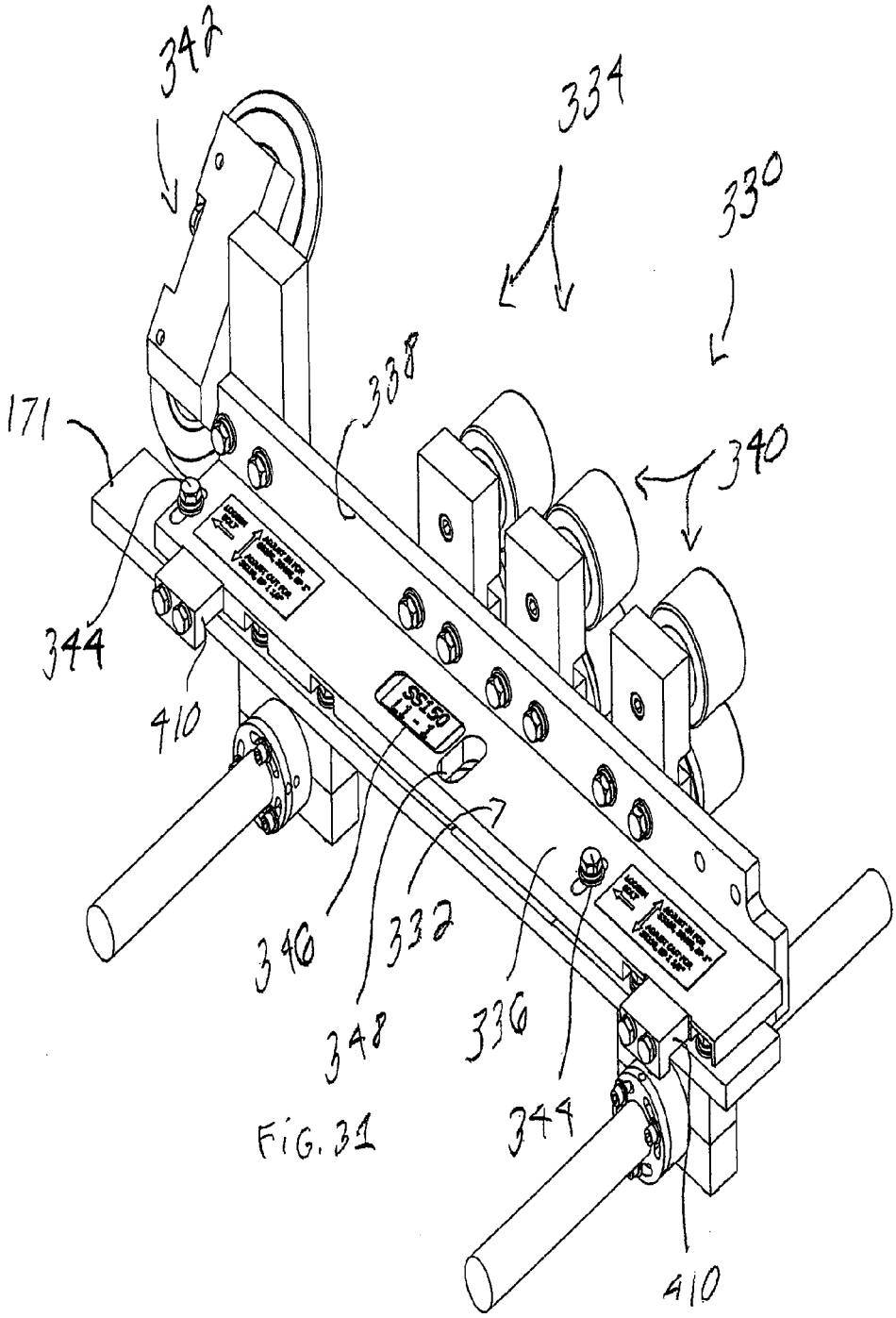
FIG. 31 is a perspective view showing a representative tooling set mounted on the upstream rail segment.
Figure 32:
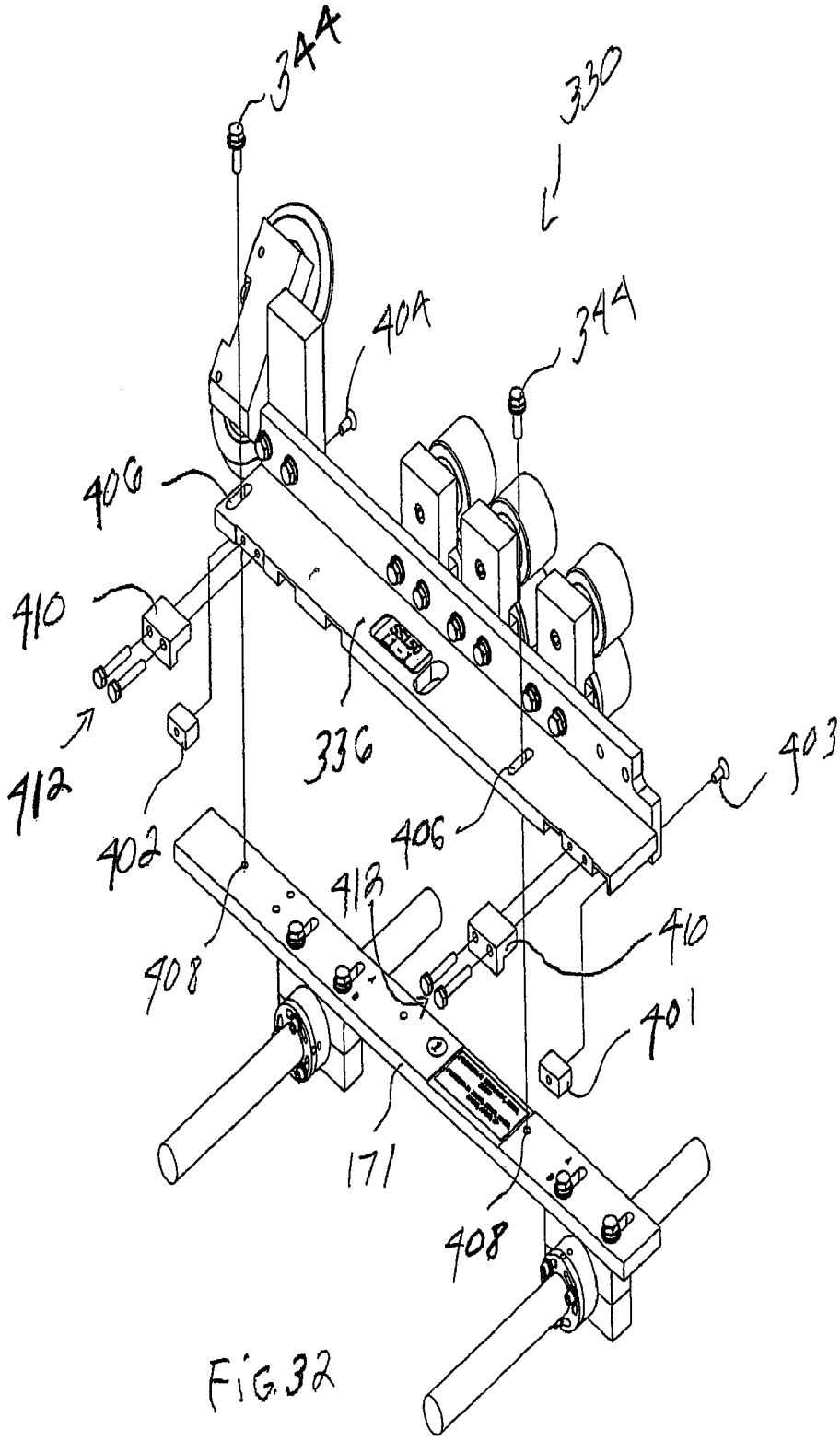
FIG. 32 is an exploded perspective view of the tooling set mounted on the upstream rail segment.

At this point, the appropriate tooling for the left side of the machine is mounted onto rail segments 171 & 173. A representative tooling set 330 is shown in FIGS. 31 & 32 and includes a tooling rail segment 332 and roller set 334. Tooling rail segment 332 includes a horizontal base plate 336 and a vertical wall 338. Roller set 334 includes free-wheeling forming rollers 340, 342, also referred to as forming elements, which are arranged to define a plurality of forming stations. Four such forming stations are shown in FIGS. 31 & 32. Horizontal base plate 336 is secured to rail segment 171 via tooling fasteners 344, while the rollers comprising roller set 334 are secured to the tooling rail segment's vertical wall 338. Channels 345 are formed within the lower surface of horizontal base plate 336 so that it can move inwardly and outwardly relative to rail segment 171, as discussed in more detail below, without interfering with fasteners 316, 317.

As with the tooling on the right side of the machine, each tooling set, such as tooling set 330 on the left side of the machine, includes a label 346 which contains certain identifying information. For example, representative label 346 identifies the profile as "SS150" and additionally identifies, via the designation "L1-1", that tooling set 330 is the first (or upstream-most) tooling set and that it's window 348 is to be aligned with the designation of "1" on rail segment 171. This designation 450 may be seen for example in FIGS. 30*a* & 30*b*.

It should be appreciated that, for a given profile, each tooling set will have different characteristics of forming rollers and free-wheeling rollers. This is known in the art. Thus, for example, the characteristics of the forming rollers and free-wheeling rollers shown for representative toolset 330 may vary for other profiles. The same holds true for the other tooling sets which, together, comprise the overall tooling for use in generating a given profile. Moreover, once the left and right rail segments have been appropriately located within the machine, a given profile will dictate a desirable spacing between the left and right tooling sets. For the tooling sets on the right side of the machine, appropriate spacer blocks, such as block 159 in FIGS. 18*a* & 18*b*, can be machined to dimension and sandwiched between the tooling rail and the rail segment (or mounting rail) to achieve a desired position. In similar fashion, and as perhaps best shown in FIG. 32, spacer blocks 401 and 402 are secured to an exteriorly facing lower portion of vertical wall 338 which projects below horizontal base plate 336. These spacer blocks 401 & 402 may be secured via suitable fastening screws 403 & 404, respectively.

Figure 33A:
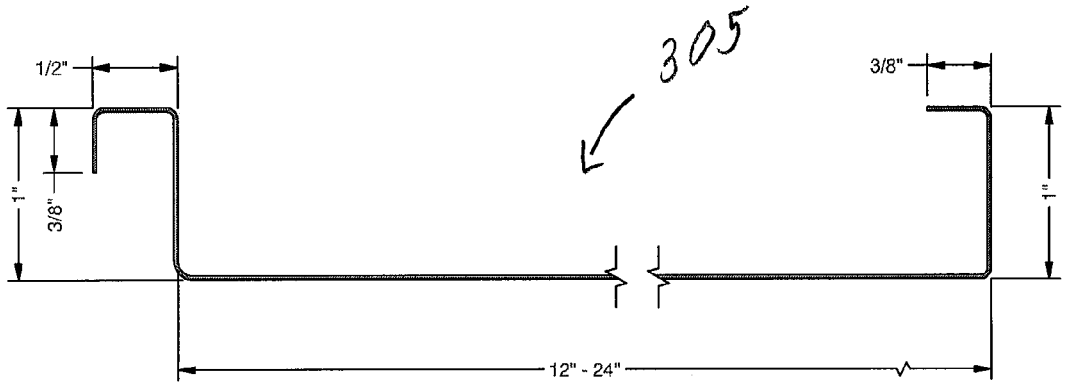
FIGS. 33*a* & 33*b* depict two different leg heights which may be achieved for a selected profile.
Figure 33B:
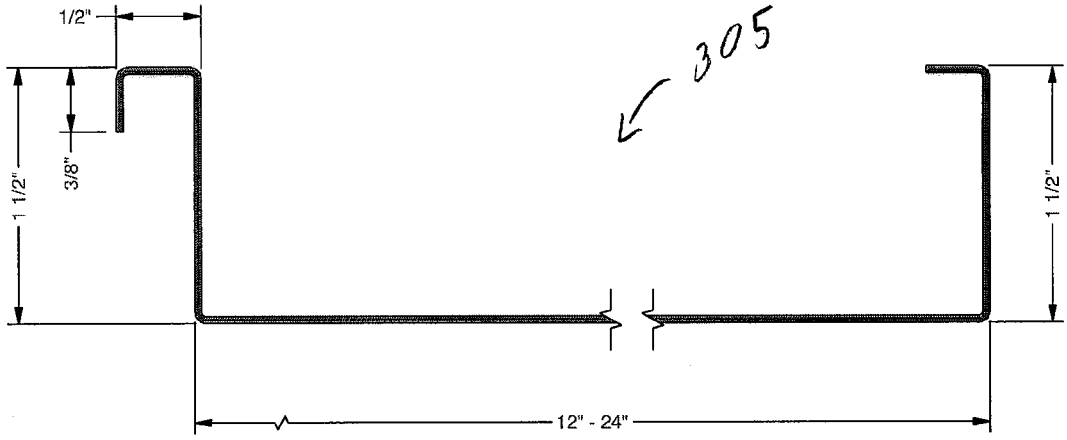

Certain profiles such as the "SS150" available from New Tech Machinery Corp. can have two different leg heights. As shown in FIGS. 33*a* &*b*, respectively, the SS150 profile 305 can have a leg height of either 1 inch or 1.5 inches. It is desirable to provide the ability to generate either leg height for the profile with little tooling adjustment. Therefore, tooling set 330 shown in FIGS. 31 & 33 has been designed to accommodate such versatility. To this end, fasteners 344 travel within slotted channels 406 formed within horizontal base plate 336. These fasteners 344 are threadedly received within mounting holes 408 formed within mounting rail segment 171. This permits tooling set 330 to move inwardly and outwardly relative to rail segment 171 once rail segment 171 is located within the appropriate offset position "A" or "B". Movement of the tooling set 330 in the inward or outward direction allows for the generation of either a 1 inch or 1.5 inch leg height for the given profile.

More particularly, a pair of limit stops 410 are secured to the exterior face of horizontal base plate 336 via suitable screw fasteners 412. Each limit stop 410 would have a suitable dimension D1 (FIG. 34*a*) which, in conjunction with dimension D2 associated with its corresponding spacer block, allows for the different leg heights to be achieved.

Figure 34A:
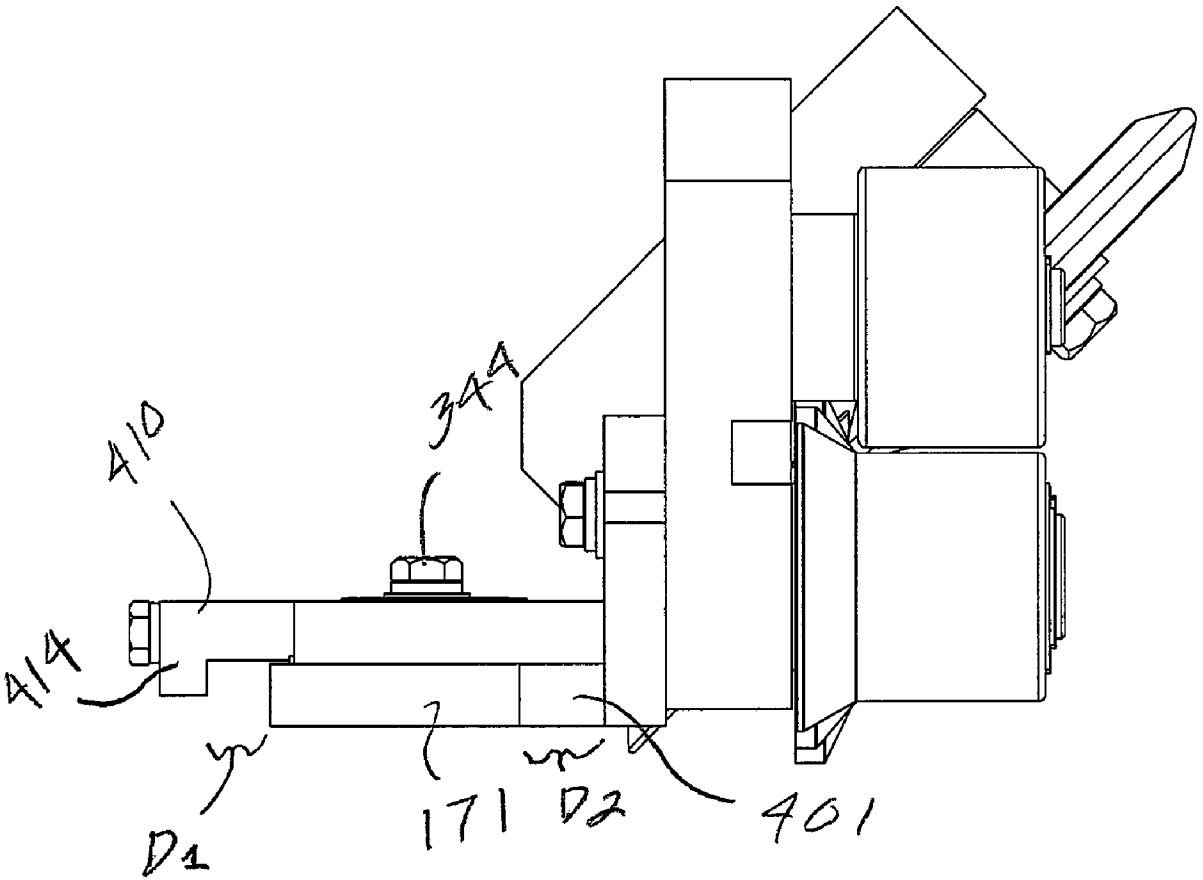
FIGS. 34*a* & 34*b*, respectively, show outboard and inboard positions for the tooling set on the rail segment in order to achieve different leg heights for a desired profile.
Figure 34B:
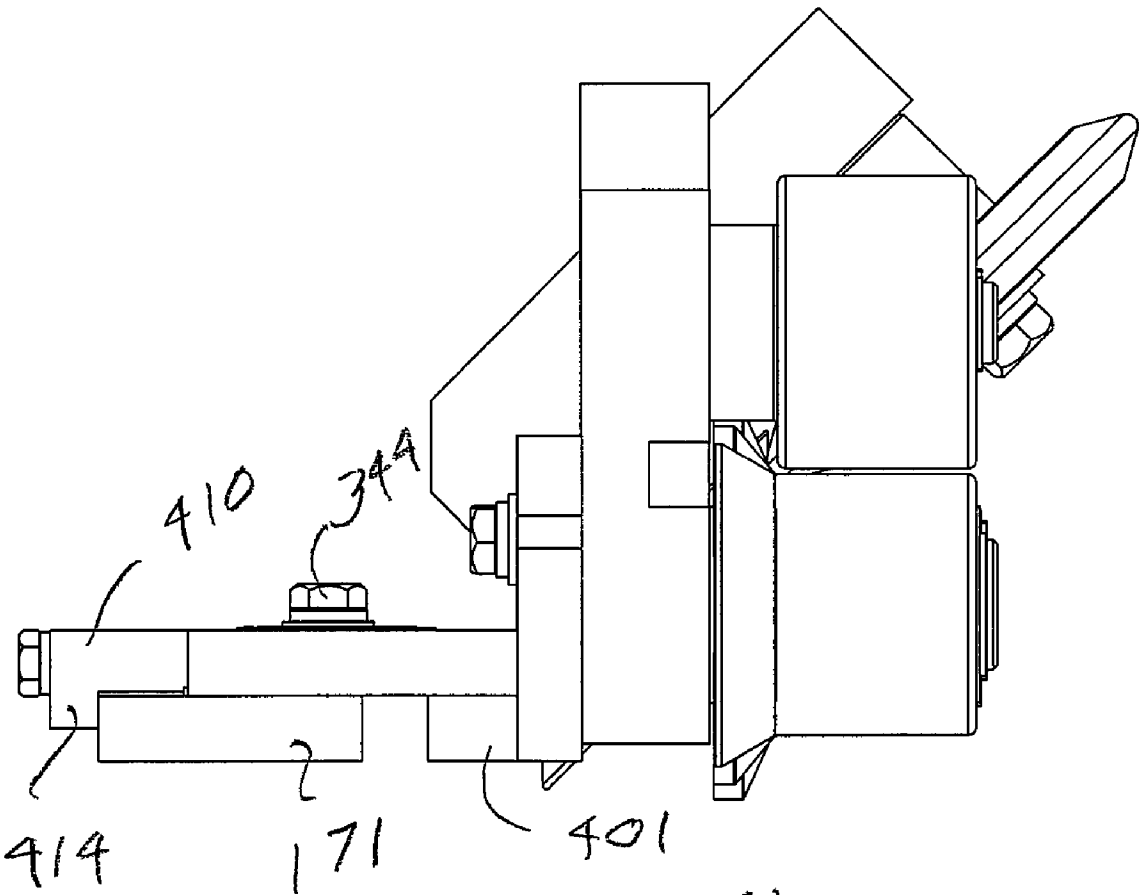

When the tooling set is positioned such that it is in the extreme outboard position wherein the vertical face spacer 401 abuts the interior vertical face of mounting rail 171 a 1.5 inch leg height for profile SS150 can be achieved. This position is shown in FIG. 34*a* wherein it may be seen that a downwardly projecting leg 414 of limit stop 410 is spaced from rail segment 171. When the tooling set is positioned such that it is in the extreme inboard position wherein the vertical face of limit stop 414 abuts the exterior vertical face of mounting rail 171, a 1 inch leg height for profile SS150 can be achieved.

Only the tooling sets which are mounted to rail segment 171 need be constructed to accommodate movement relative to rail segment 171. The downstream tooling sets which mount to rail segment 173 on the left side of the machine remain fixed in position unless a changeover to another profile requires that they be replaced. The same holds true for the tooling sets on the right side of the machine.

Figure 35:
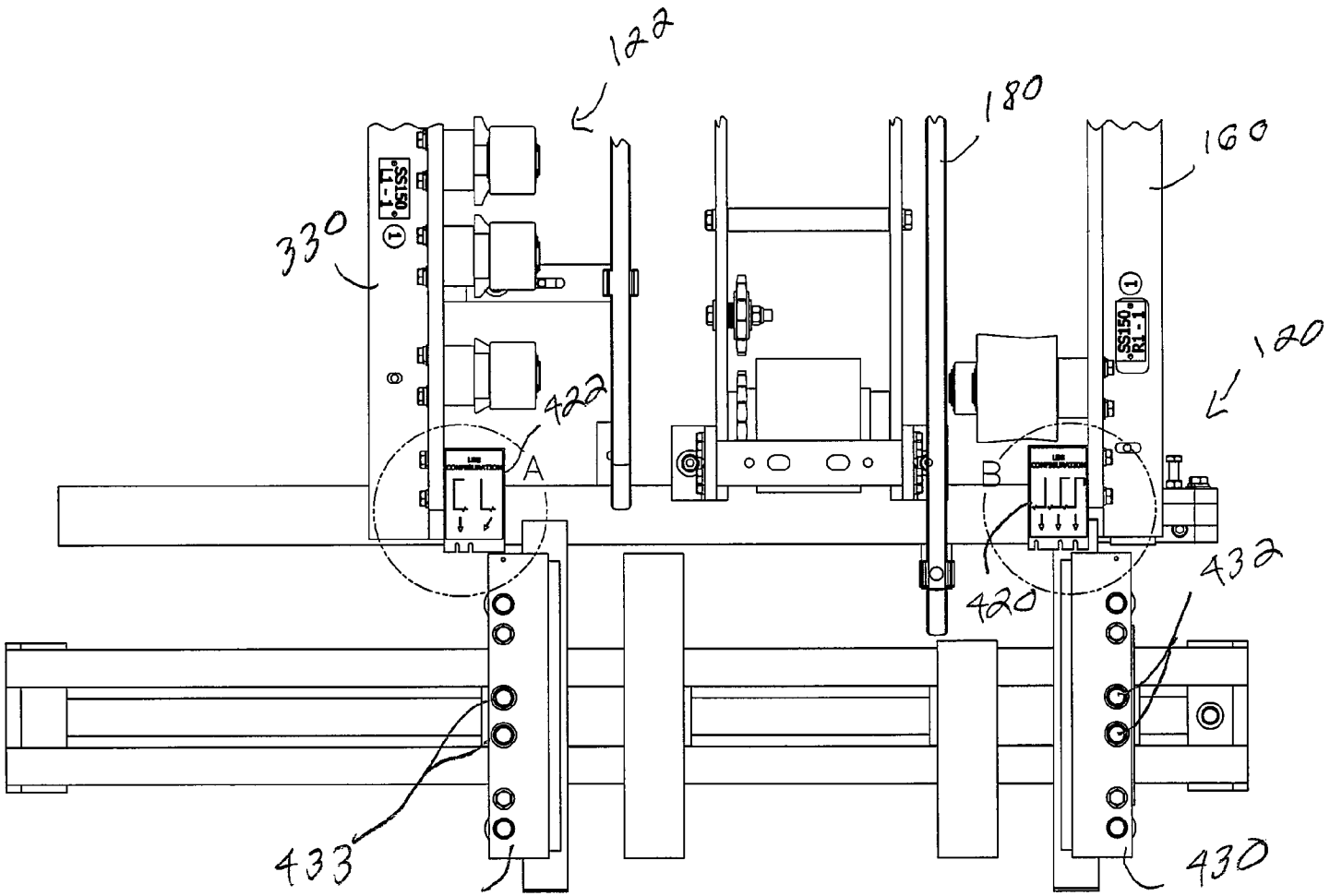
FIG. 35 is a diagrammatic top plan view of the front end portion of the forming machine to illustrate a representative orientation of various components at the beginning of a changeover sequence.
Figure 36B:
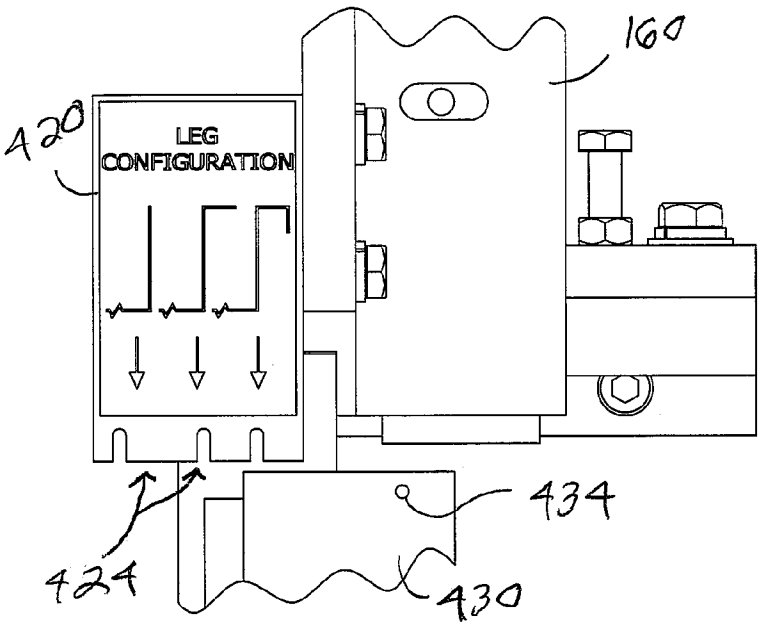
FIGS. 36*a*-36*b*, 37*a*-37*b* & 38*a*-38*b* respectively, are enlarged diagrammatic views showing representative positions for the forming machine's left and right legend plates during a changeover sequence.
Figure 36A:
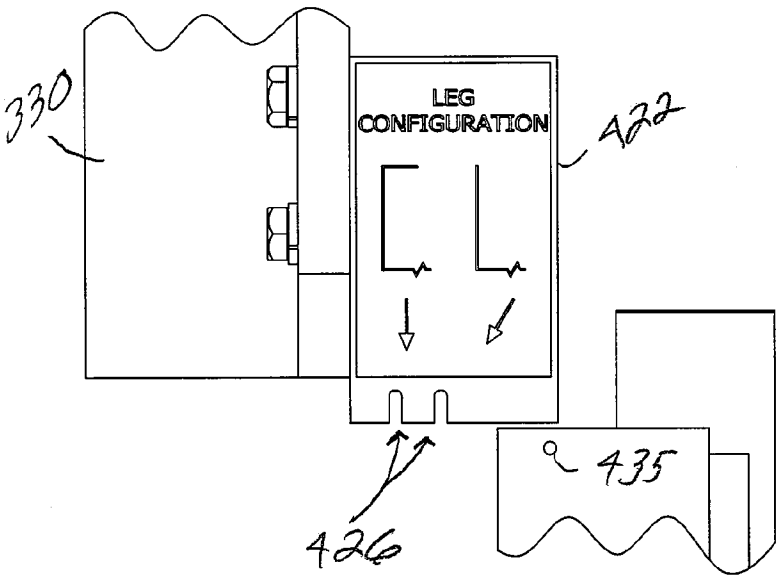

Once the tooling sets have been properly mounted and positioned on the left and right sides, the forming machine 10 may appear as shown in FIGS. 35, 36*a* & 36*b* wherein each tooling set, such as upstream-most right and left tooling sets 160 & 330, respectively, are mounted on their associated support bar assemblies 120, 122. Each tooling set includes a legend plate which identifies the various leg options for the profile, in this case "SS150", which may be formed for the profile. As such, tooling set 160 has an associated legend plate 420 which identifies three possible leg configurations, while tooling set 330 has an associated legend plate 422 that also identifies a plurality of leg configurations. Each legend plate is notched to identify a position which would correspond to each leg configuration. Thus, for example, legend plate 420 includes three such notches, generally 424, while legend plate 422 includes similar notches, generally 426. As can be seen in FIGS. 35, 36*a* & 36*b*, each of the left and right tooling sets will likely be out of alignment at this point.

Figure 37A:
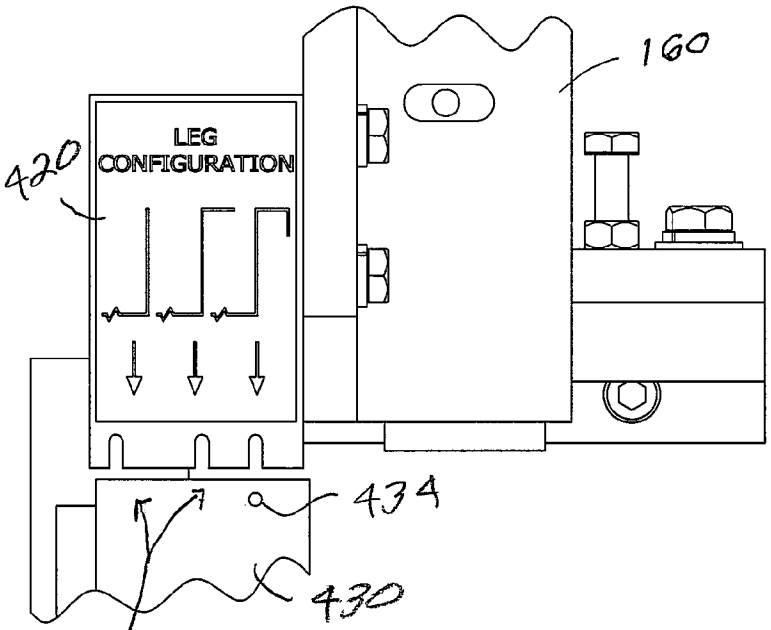
Figure 37B:
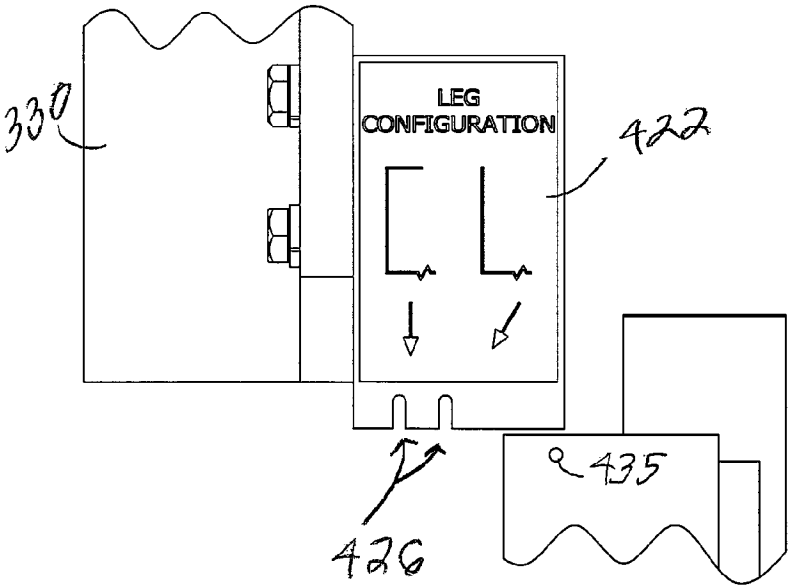

Once the tooling sets are mounted and the left and right leg configurations are determined for the particular profile, the forming machine's right entry guide 430 may be loosened up and positioned, by loosening one or more of screws 432, such that its orientation pin 434 is aligned with the particular notch 424 corresponding to the right leg configuration that is desired for the profile. This, for example, is shown in FIG. 37*a* where it may be seen that orientation pin 434 is aligned with the rightmost notch of legend plate 420, while legend plate 422 is out of alignment. As known in the art, the entry guides 430 and 431 serve to position the coiled sheet material and guide it into the forming machine. As such, the entry guides provide lateral support for the material as it is fed into the machine. Of course, in order for the entry guides to function properly, where overhead racks are employed, it is important to have the material properly positioned laterally on these racks on top of the machine. Typically, a chart is used to inform an operator of the lateral position of the coils on these racks for the desired profile. The right and left entry guides are necessarily then fixed into these positions by tightening their associated screws.

Figure 38A:
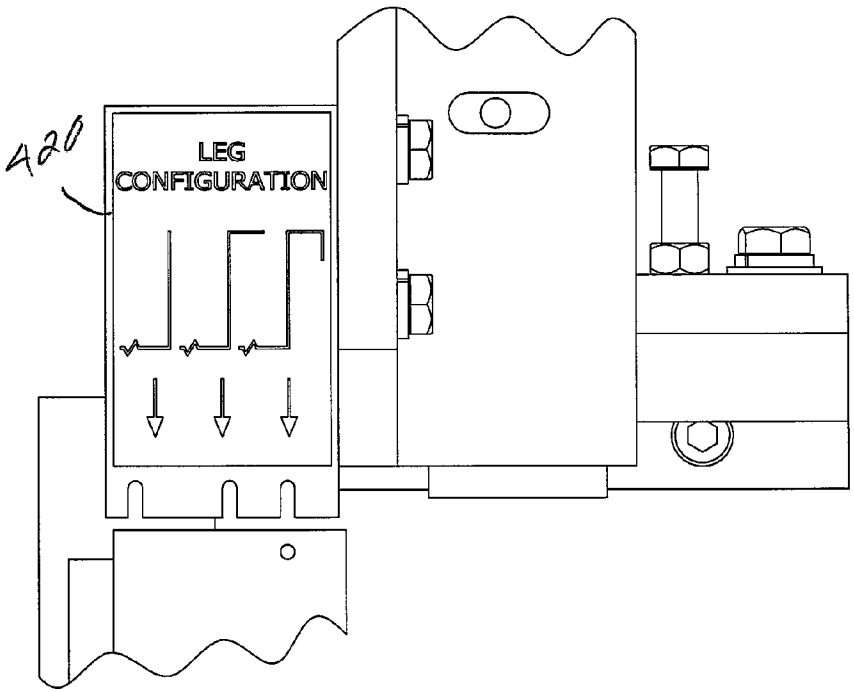
Figure 38B:
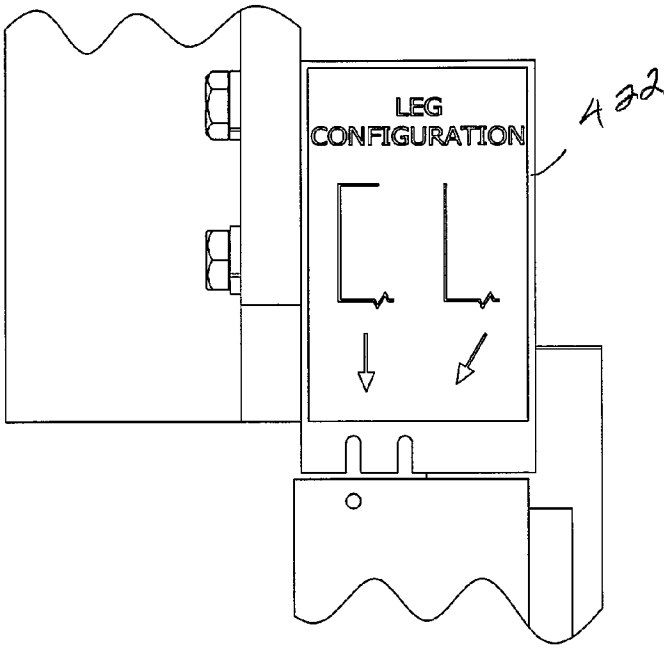

Once the desired offset has been set (i.e., position "A" or "B"), the left entry guide 431 may be loosened. At this point, the coil of sheet material is inserted between the right (fixed) and left (loose) entry guides, and then left entry guide is moved so material is securely captured between both entry guides. The left entry guide bolts 433 are then tightened. The crank handle 226 (FIG. 25) is then rotated so that alignment pin 435 aligns with the desired notch 426 associated with legend plate 422. Once this is accomplished, the left and right tooling sets and their associated legend plates 420, 422 would appear as in FIGS. 38*a* & 38*b*. At this point, the forming machine is ready to receive the sheet material and produced the desired profile. Of course, the ordinarily skilled artisan will recognize that various adjustments to the changeover sequence discussed above could be made, such as modifying or rearranging some of the particular steps discussed, while still accomplishing the appropriate end result Accordingly, the present invention has been described with some degree of particularity directed to the exemplary embodiments thereof. It should be appreciated that the present invention is defined by the following claims construed in light of the prior art so that modifications or changes may be made to the exemplary embodiments of the present invention without departing from the concepts contained herein.

What is claimed is:

1. A rail structure for use in a machine that is adapted to form a strip of material into a desired profile, comprising:

at least one projection shaft capable of being rotatably mounted to the machine;

at least one nut threadably engaged with said projection shaft;

a clamp block assembly secured about said nut and including:

a first clamp block including at least one threaded first hole;

a second clamp block including at least one second hole aligned with a respective said at least one first hole; and at least one first fastener extending into the aligned said first and second holes;

an elongate mounting rail fastened to said first clamp block, wherein said mounting rail includes at least one transversely extending slot, and including at least one second fastener extending through said at least one slot to engage said at least one threaded first hole, whereby said mounting rail is selectively adjustable along said slot; and a tool set mounted to said mounting rail, said tool set including a tooling rail and a plurality of forming elements secured thereto.

2. A rail structure according to claim 1 including indicia on said mounting rail indicative of an offset mounting rail position.

3. A forming machine adapted to form a longitudinal margin of a strip of material into a desired profile, comprising:

A. a framework having an interior including a forming region through which said strip may be advanced from an upstream entrance to a downstream exit;

B. a drive mechanism disposed in the interior of said framework and operative to engage said strip and advance said strip in a downstream direction from said entrance to said exit;

C. a rail structure, comprising:

a projection shaft rotatably mounted to the framework;

a nut threadably engaged with said projection shaft;

a clamp block assembly secured about said nut and including:

a first clamp block including at least one threaded first hole;

a second clamp block including at least one second hole aligned with a respective said at least one threaded first hole; and at least one first fastener extending into the aligned said threaded first hole and second hole; and an elongate mounting rail fastened to said first clamp block with at least one second threaded fastener extending into one of said threaded first holes; and D. a plurality of forming elements secured to said rail structure to define at least one forming station that is positioned to receive said longitudinal margin and operative to contribute to forming said longitudinal margin into the desired profile as said strip is advanced through the forming region by said drive mechanism.

4. A forming machine according to claim 3 wherein said mounting rail includes at least one transversely extending slot, and including at least one second fastener extending through said at least one slot to engage said at least one threaded first hole, whereby said mounting rail is selectively adjustable along said slot.

5. A forming machine according to claim 4 including indicia on the mounting rail indicative of an offset mounting rail position.

6. In a metal forming machine adapted to bend a longitudinal margin of a strip of metal into a desired profile, including: a framework having an interior including a forming region through which said strip may be advanced from an upstream entrance to a downstream exit; a drive mechanism disposed in the interior of said framework and operative to engage said strip and advance said strip in a downstream direction from said entrance to said exit; an elongated rail structure mounted relative to said framework and spaced laterally from said drive mechanism; and a tool set connected to said rail structure, said tool set positioned to receive said longitudinal margin and operative to bend said longitudinal margin as said strip is advanced through the forming region by said drive mechanism, the improvement comprising:

a mechanism for adjusting a separation distance between said rail structure and said drive mechanism, including:

a projection shaft rotatably mounted to the machine;

a nut threadably engaged with said projection shaft;

a clamp block assembly secured about said nut and including:

a first clamp block including at least one threaded first hole;

a second clamp block including at least one second hole aligned with a respective said at least one threaded first hole; and at least one first fastener extending into the aligned said threaded first hole and second hole; and an elongate mounting rail supporting said tool set and connected to said first clamp block, wherein said mounting rail includes at least one transversely extending slot, and including at least one second fastener extending through said at least one slot to engage said at least one threaded first hole, whereby said mounting rail is selectively adjustable along said slot.

7. The improvement according to claim 6 including indicia on said mounting rail indicative of an offset mounting rail position.

* * * * *